US010159866B2

(12) United States Patent
Carter

(10) Patent No.: US 10,159,866 B2
(45) **Date of Patent: *Dec. 25, 2018**

(54) GYM CAGE

(71) Applicant: Marcus Carter, Tampa, FL (US)

(72) Inventor: Marcus Carter, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/696,444

(22) Filed: Sep. 6, 2017

(65) Prior Publication Data

US 2018/0028854 A1 Feb. 1, 2018

Related U.S. Application Data

(63) Continuation-in-part of application No. 15/254,746, filed on Sep. 1, 2016.

(Continued)

(51) Int. Cl.
*A63B 21/00* (2006.01)
*A63B 21/04* (2006.01)

(Continued)

(52) U.S. Cl.
CPC ..... *A63B 21/00069* (2013.01); *A63B 17/02* (2013.01); *A63B 17/04* (2013.01);

(Continued)

(58) Field of Classification Search
CPC ..... A63B 1/0442; A63B 21/4035; A63B 21/4043; A63B 21/00047; A63B 21/00069; A63B 21/0087; A63B 21/153; A63B 21/16; A63B 23/03541; A63B 23/1209; A63B 71/022; A63B 21/4029; A63B 21/4034; A63B 21/4039; A63B 21/4047; A63B 21/005; A63B 21/023; A63B 21/0552; A63B 21/0557; A63B 21/0724; A63B 23/03525; A63B 23/03533; A63B 23/0405; A63B 23/1245; A63B 23/1254; A63B 2069/0062; A63B 2071/0647; A63B 2220/806; A63B 2225/093

(Continued)

(56) References Cited

U.S. PATENT DOCUMENTS 3,369,809 A * 2/1968 Morrill, Jr. ..... A63B 21/0023 482/131
3,948,513 A * 4/1976 Pfotenhauer ..... A63B 17/04 482/142

(Continued)

*Primary Examiner* — Andrew S Lo
(74) *Attorney, Agent, or Firm* — Robert M. Downey, P.A.

(57) ABSTRACT

An exercise apparatus has at least one vertical wall structure, a floor and a ceiling forming a cage that can be square, rectangular, circular, oval or another suitable configuration. An arrangement of strategically placed attachment points on the wall structure, floor and ceiling enables easy attachment and detachment of a variety of resistance devices (e.g., a handheld and/or inline cable operated resistance creation device, or a stretch band resistance device) to any of the vertical and/or horizontal structures within the gym cage, thereby providing a nearly 360 degree dimensional point of resistance to perform a wide variety of exercises for different muscle groups and subgroups of the body. In one embodiment, the cage includes an arrangement of spaced apart vertical and horizontal frame members forming a rear wall and opposite side walls.

8 Claims, 49 Drawing Sheets

Related U.S. Application Data

(60) Provisional application No. 62/213,230, filed on Sep. 2, 2015.

(51) Int. Cl.

| | |
|---|---|
| ***A63B 17/02*** | (2006.01) |
| ***A63B 21/008*** | (2006.01) |
| ***A63B 21/16*** | (2006.01) |
| ***A63B 23/12*** | (2006.01) |
| ***A63B 17/04*** | (2006.01) |
| *A63B 17/00* | (2006.01) |
| *A63B 21/005* | (2006.01) |
| *A63B 21/018* | (2006.01) |
| *A63B 21/02* | (2006.01) |
| *A63B 21/05* | (2006.01) |
| *A63B 21/055* | (2006.01) |
| *A63B 21/072* | (2006.01) |
| *A63B 23/035* | (2006.01) |
| *A63B 23/04* | (2006.01) |
| *A63B 69/00* | (2006.01) |
| *A63B 71/06* | (2006.01) |

(52) U.S. Cl.

CPC .... *A63B 21/00058* (2013.01); *A63B 21/0087* (2013.01); *A63B 21/0442* (2013.01); *A63B 21/153* (2013.01); *A63B 21/16* (2013.01); *A63B 21/4035* (2015.10); *A63B 21/4043* (2015.10); *A63B 23/03541* (2013.01); *A63B 23/1209* (2013.01); *A63B 17/00* (2013.01); *A63B 21/005* (2013.01); *A63B 21/00192* (2013.01); *A63B 21/018* (2013.01); *A63B 21/023* (2013.01); *A63B 21/05* (2013.01); *A63B 21/0552* (2013.01); *A63B 21/0557* (2013.01); *A63B 21/0724* (2013.01); *A63B 21/4029* (2015.10); *A63B 21/4034* (2015.10); *A63B 21/4039* (2015.10); *A63B 21/4047* (2015.10); *A63B 23/03525* (2013.01); *A63B 23/03533* (2013.01); *A63B 23/0405* (2013.01); *A63B 23/1245* (2013.01); *A63B 23/1254* (2013.01); *A63B 2069/0062* (2013.01); *A63B 2071/0647* (2013.01); *A63B 2220/806* (2013.01); *A63B 2225/093* (2013.01); *A63B 2225/10* (2013.01)

(58) Field of Classification Search

USPC ..... 482/92–93, 121–130

See application file for complete search history.

(56) References Cited

U.S. PATENT DOCUMENTS 4,198,044 A * 4/1980 Holappa ..... A63B 21/04 482/130
4,257,590 A * 3/1981 Sullivan ..... A63B 21/154 482/133
4,328,964 A * 5/1982 Walls ..... A63B 21/4035 473/229
4,907,798 A * 3/1990 Burchatz ..... A63B 21/06 482/104
5,295,930 A * 3/1994 Hogan ..... A63B 69/18 482/130
5,342,054 A * 8/1994 Chang ..... A63B 24/0003 434/252
5,551,934 A * 9/1996 Binette ..... A63B 23/0482 482/123
5,626,546 A * 5/1997 Little ..... A63B 21/0552 482/123
5,876,310 A * 3/1999 Mackey ..... A63B 21/153 482/114
6,056,671 A * 5/2000 Marmer ..... A61B 5/1124 482/10
6,220,994 B1 * 4/2001 Rich ..... A63B 21/0004 482/123
6,558,301 B1 * 5/2003 Jackson ..... A63B 21/0552 482/121
6,640,200 B1 * 10/2003 Baum ..... A63B 24/0021 273/108.3
6,709,351 B2 * 3/2004 Hori ..... A63B 63/00 463/3
7,070,546 B1 * 7/2006 Grasso ..... A63B 21/072 482/103
7,125,369 B2 * 10/2006 Endelman ..... A63B 21/023 482/142
7,229,392 B2 * 6/2007 Turnbull ..... A63B 21/04 482/129
7,309,303 B1 * 12/2007 Proctor ..... A63B 3/00 482/121
7,381,168 B2 * 6/2008 Bowser ..... A63B 21/04 482/121
7,520,843 B1 * 4/2009 Goddard ..... A63B 21/0724 482/104
7,699,756 B2 * 4/2010 Piane, Jr. ..... A63B 1/00 248/222.52
7,857,739 B2 * 12/2010 Caldwell ..... A63B 21/00047 482/130
8,905,904 B2 * 12/2014 Carter ..... A63B 21/0442 482/121
9,314,658 B2 * 4/2016 Kaye ..... A63B 21/0557
2005/0130814 A1 * 6/2005 Nitta ..... A63B 1/00 482/121
2006/0046911 A1 * 3/2006 Leight ..... A63B 21/025 482/91
2006/0135329 A1 * 6/2006 Owen ..... A63B 21/04 482/123
2006/0160681 A1 * 7/2006 McBride ..... A63B 1/00 482/123
2007/0087920 A1 * 4/2007 Dachraoui ..... A63B 21/0552 482/123
2008/0113852 A1 * 5/2008 Caldwell ..... A63B 21/00047 482/133
2008/0171643 A1 * 7/2008 Baudhuin ..... A63B 21/00 482/148
2009/0054215 A1 * 2/2009 McBride ..... A63B 1/00 482/129
2009/0215594 A1 * 8/2009 Panaiotov ..... A63B 21/0552 482/130
2011/0251021 A1 * 10/2011 Zavadsky ..... A63B 21/00 482/5
2012/0053014 A1 * 3/2012 Zhu ..... A63B 21/00069 482/5
2012/0322635 A1 * 12/2012 Carter ..... A63B 21/0442 482/129
2013/0023390 A1 * 1/2013 Ree ..... A63B 21/0442 482/124
2013/0065680 A1 * 3/2013 Zavadsky ..... A63B 21/00 463/30
2013/0225376 A1 * 8/2013 Kinsbourne ..... A63B 21/0552 482/121
2013/0324378 A1 * 12/2013 Rountree ..... A63B 21/0442 482/129
2014/0018215 A1 * 1/2014 Donofrio ..... A63B 1/00 482/129
2014/0031182 A1 * 1/2014 Donofrio ..... A63B 21/0442 482/129
2014/0087928 A1 * 3/2014 Luedeka ..... A63B 21/4023 482/130
2014/0106948 A1 * 4/2014 Agostini ..... A63B 21/0442 482/129
2014/0113779 A1 * 4/2014 Loach ..... A63B 21/0004 482/115
2014/0142864 A1 * 5/2014 Spears ..... A61B 5/1112 702/19
2014/0205980 A1 * 7/2014 Braier ..... G09B 5/02 434/247

(56) References Cited

U.S. PATENT DOCUMENTS

| | | | | |
|---|---|---|---|---|
| 2014/0228712 | A1* | 8/2014 | Elliott | A63B 71/06 600/587 |
| 2015/0024911 | A1* | 1/2015 | Ross | A63B 21/0442 482/129 |
| 2015/0251039 | A1* | 9/2015 | Mikulski | A63B 21/0442 482/126 |
| 2015/0273263 | A1* | 10/2015 | Guttman | A63B 21/0442 482/129 |
| 2016/0243396 | A1* | 8/2016 | Taylor | A63B 21/4049 |
| 2017/0165524 | A1* | 6/2017 | Eder | A63B 24/0062 |

* cited by examiner

FIG. 14
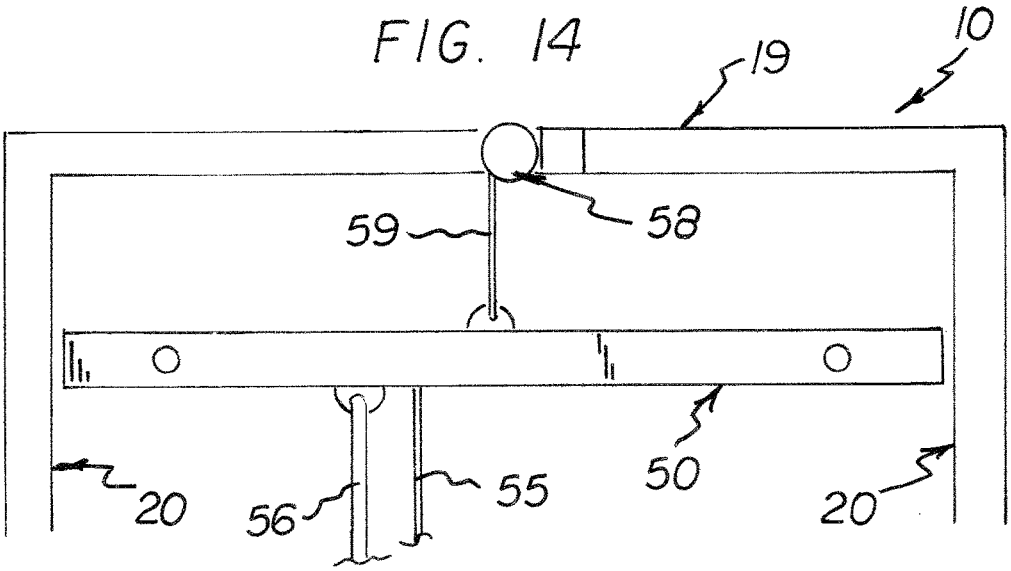
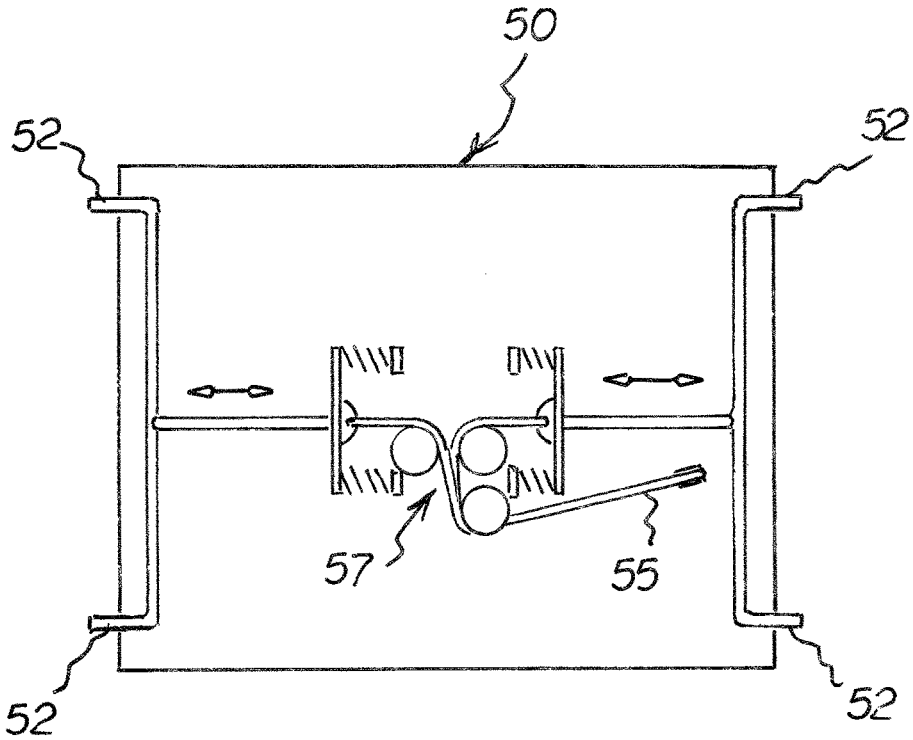
FIG. 15

FIG. 16
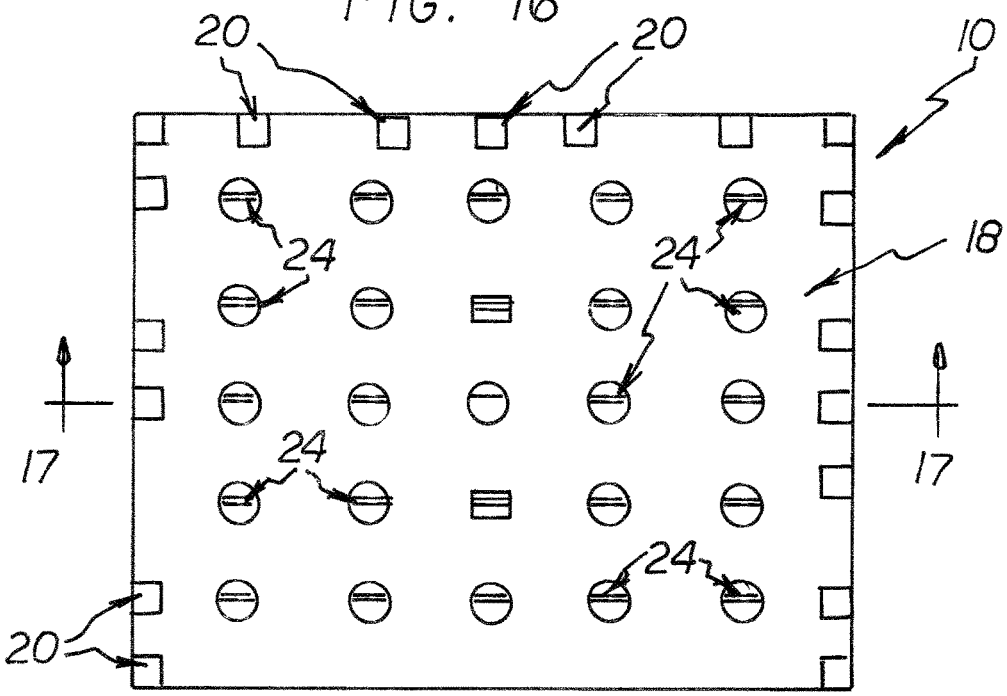
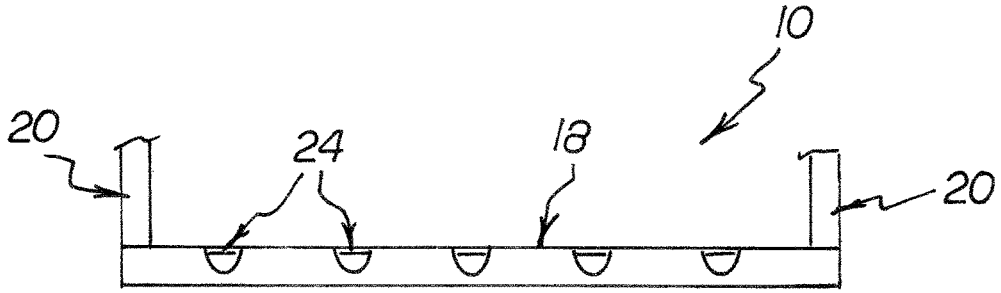
FIG. 17

FIG. 18
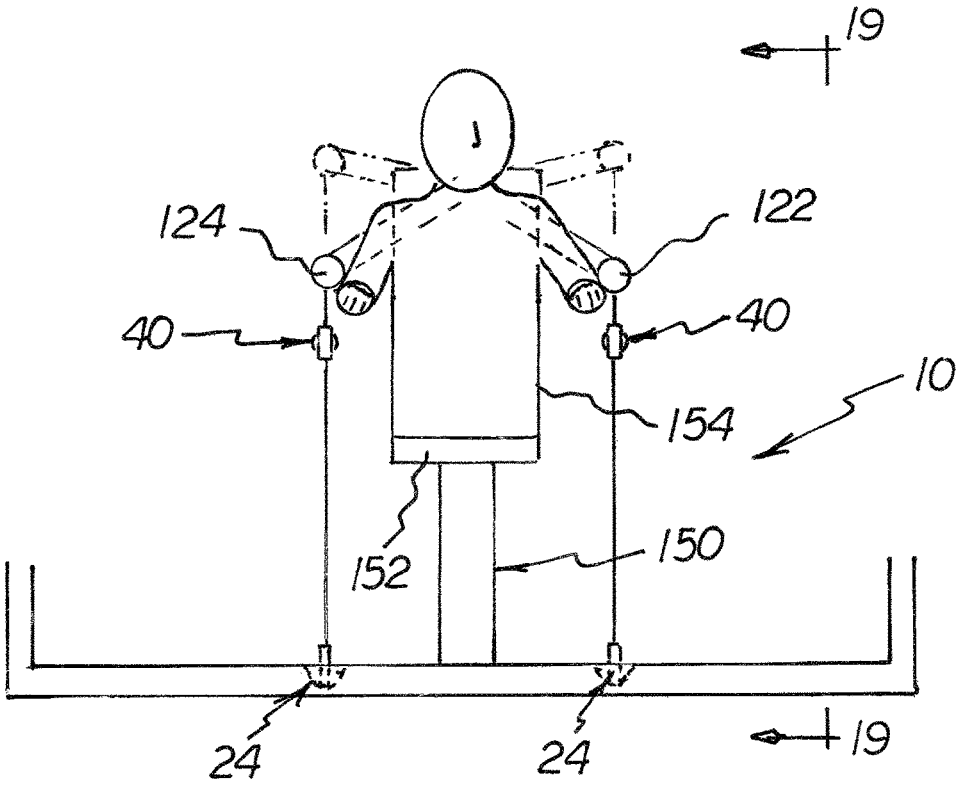
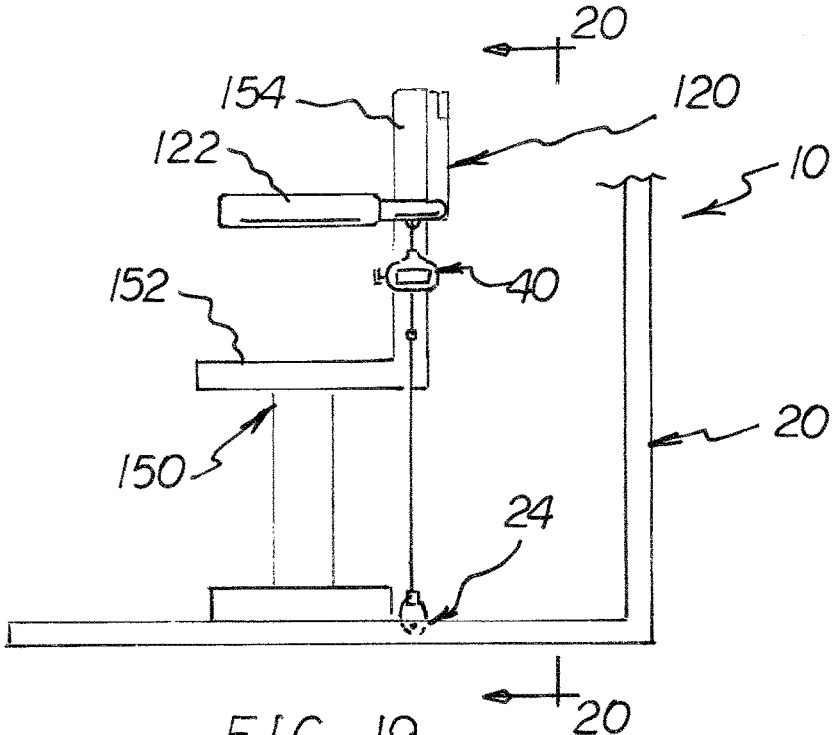
FIG. 19

FIG. 24
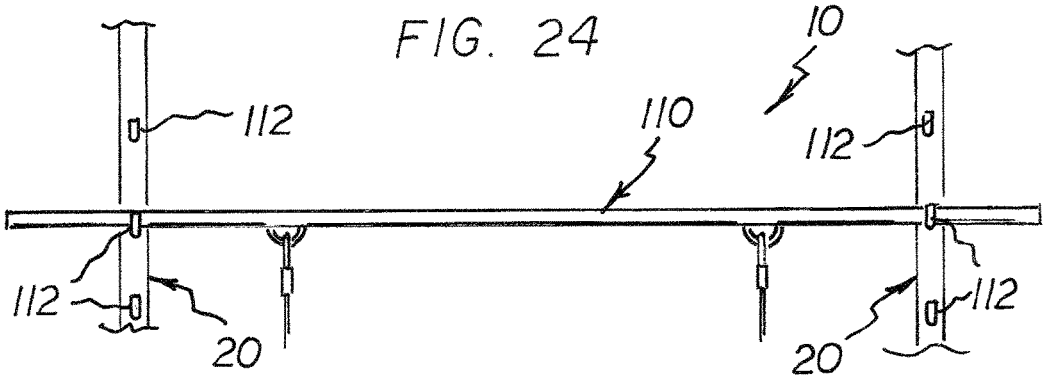
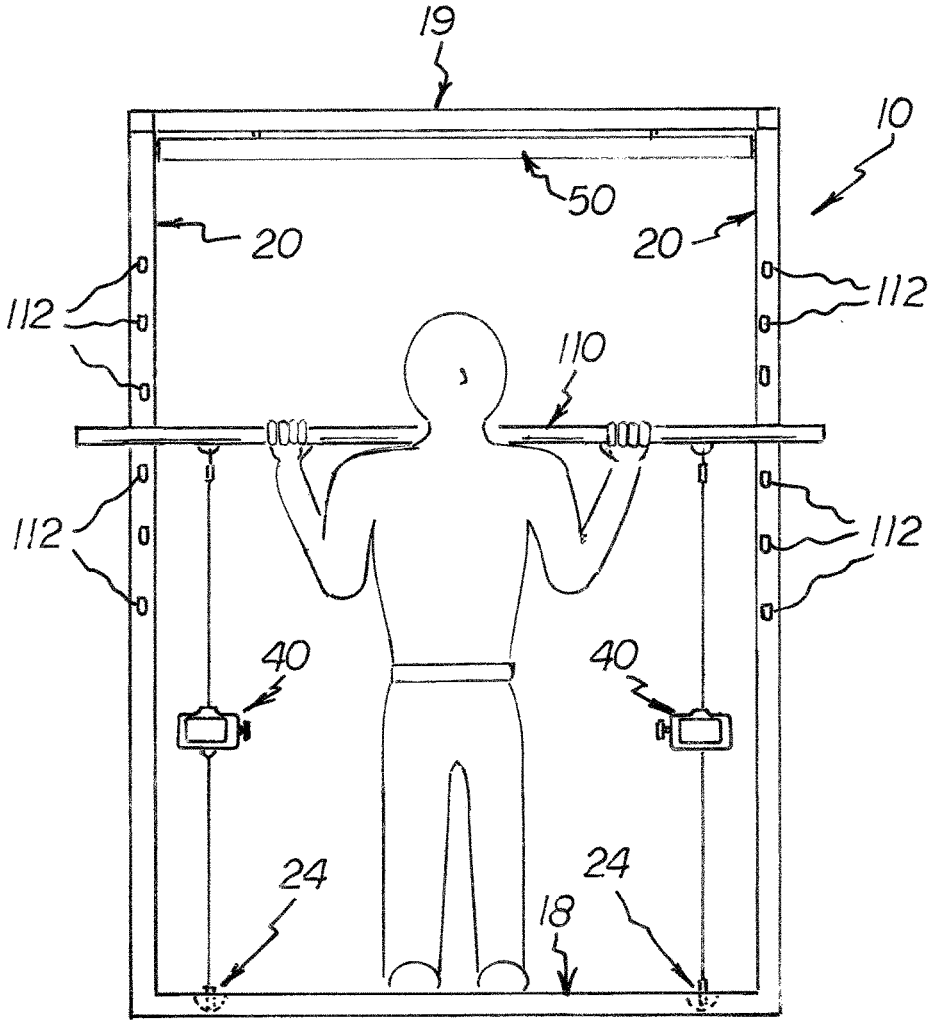
FIG. 25

FIG. 26
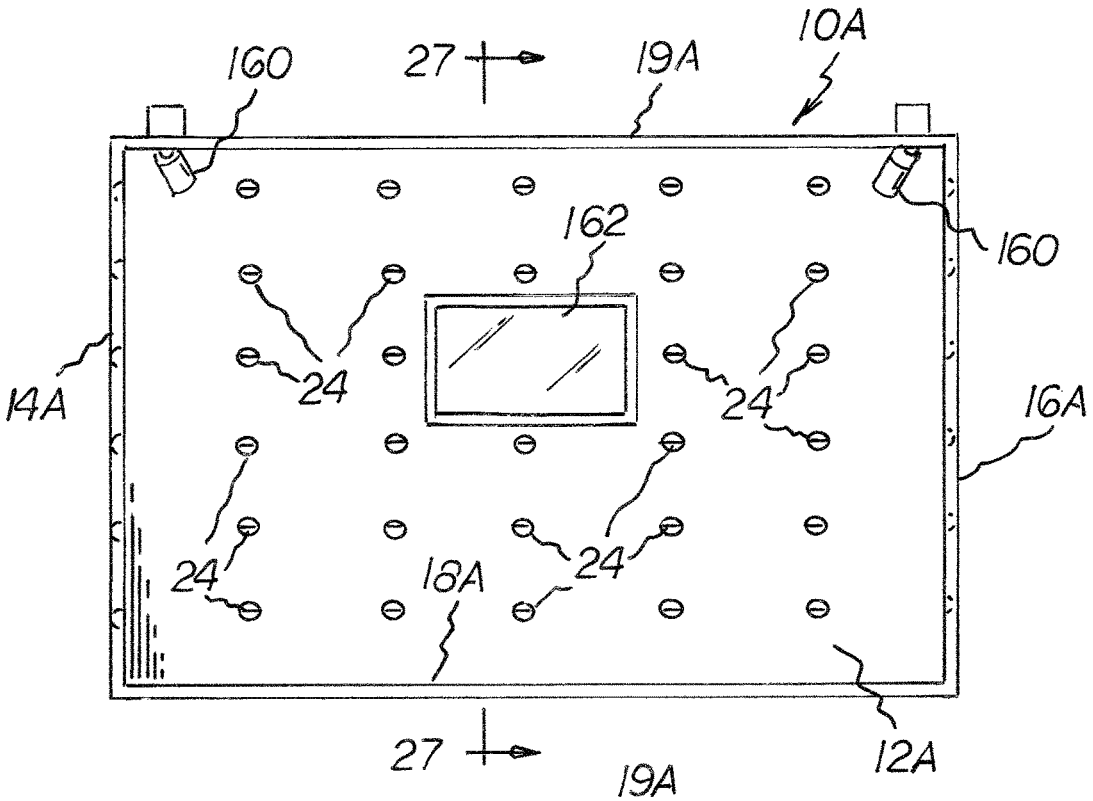
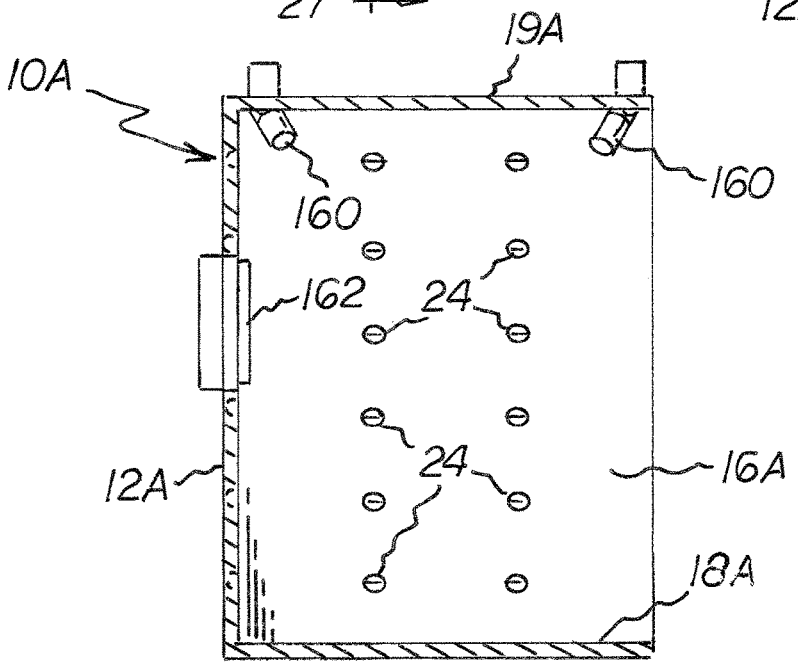
FIG. 27

FIG. 36
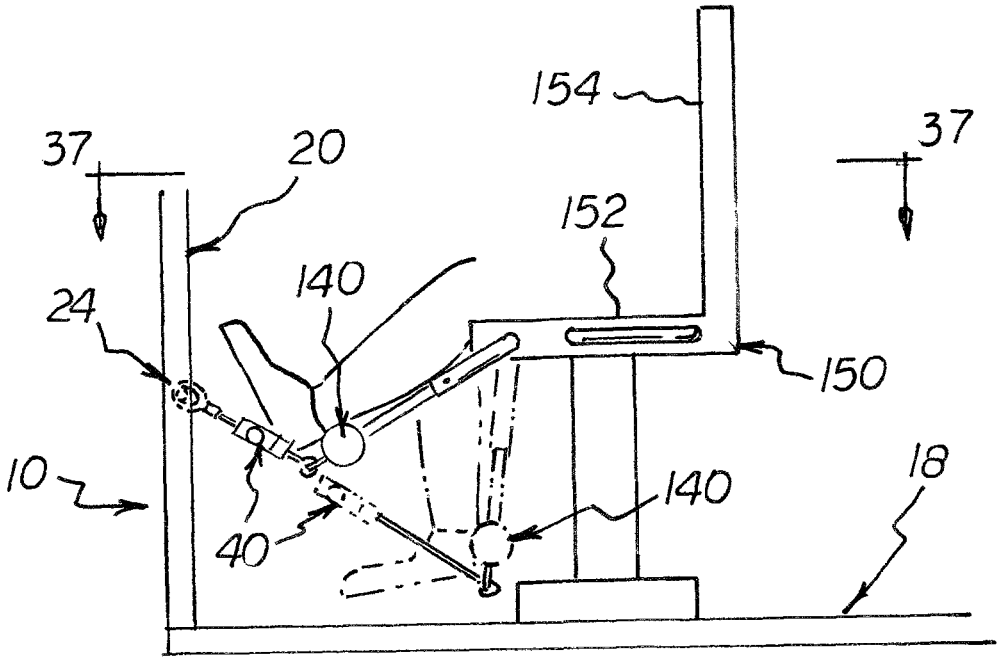
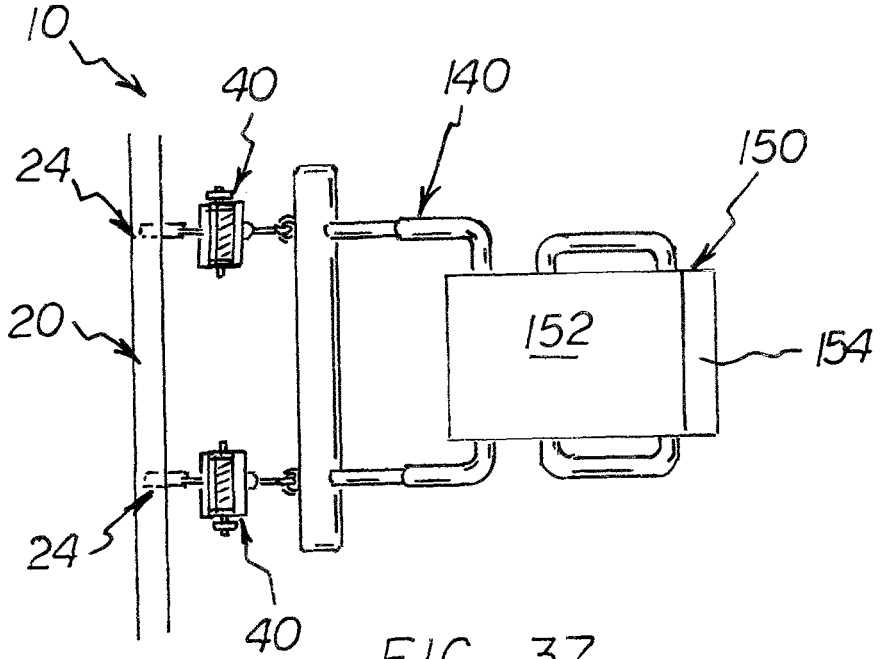
FIG. 37

FIG. 44
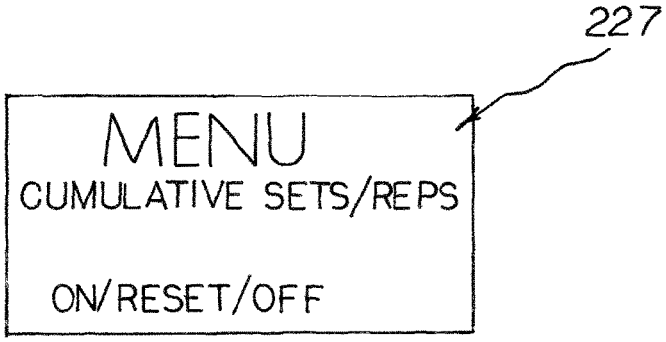
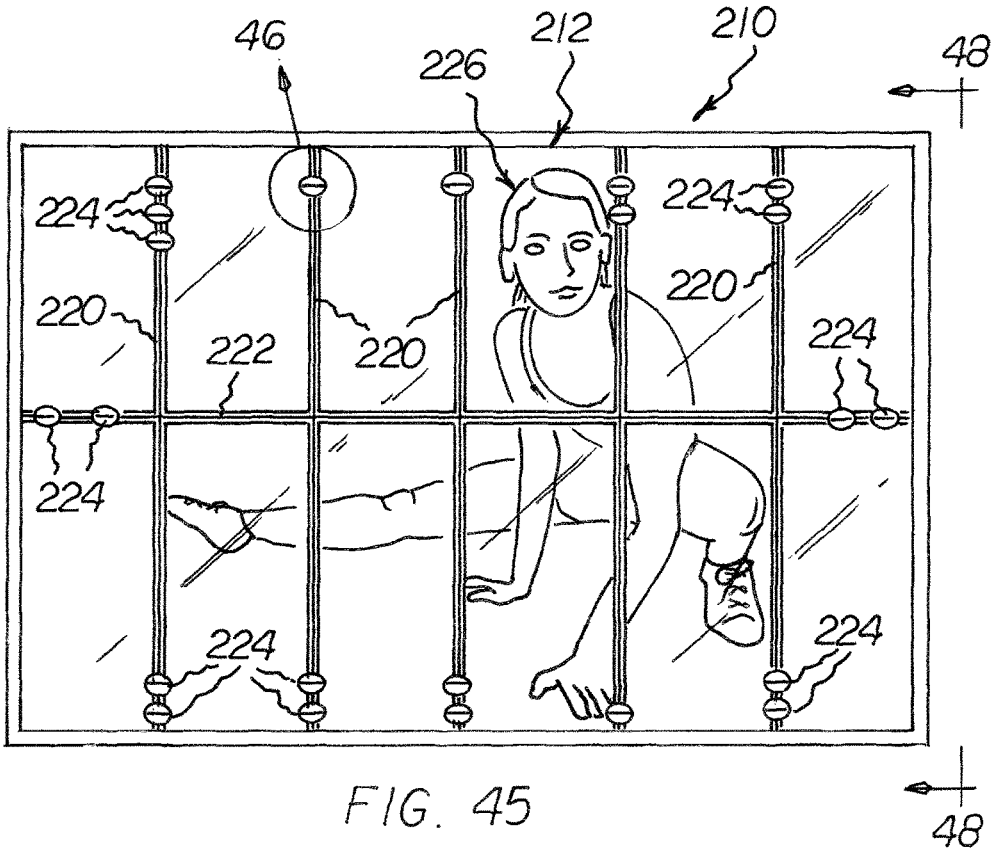
FIG. 45

FIG. 54
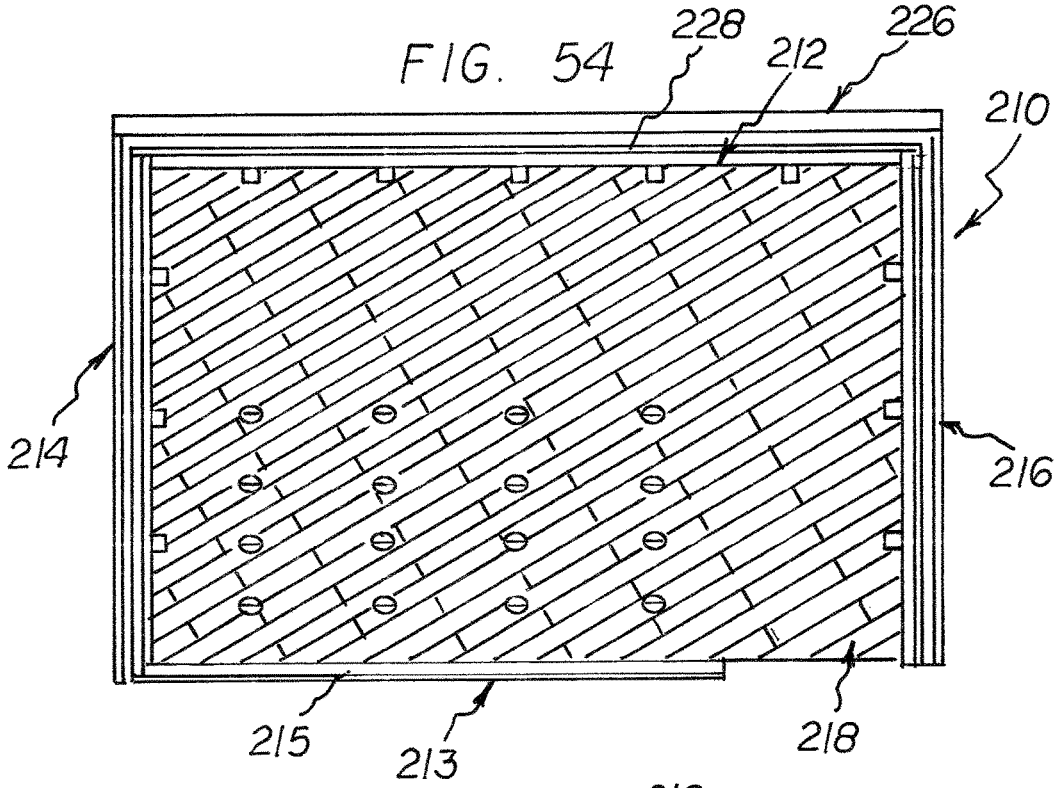
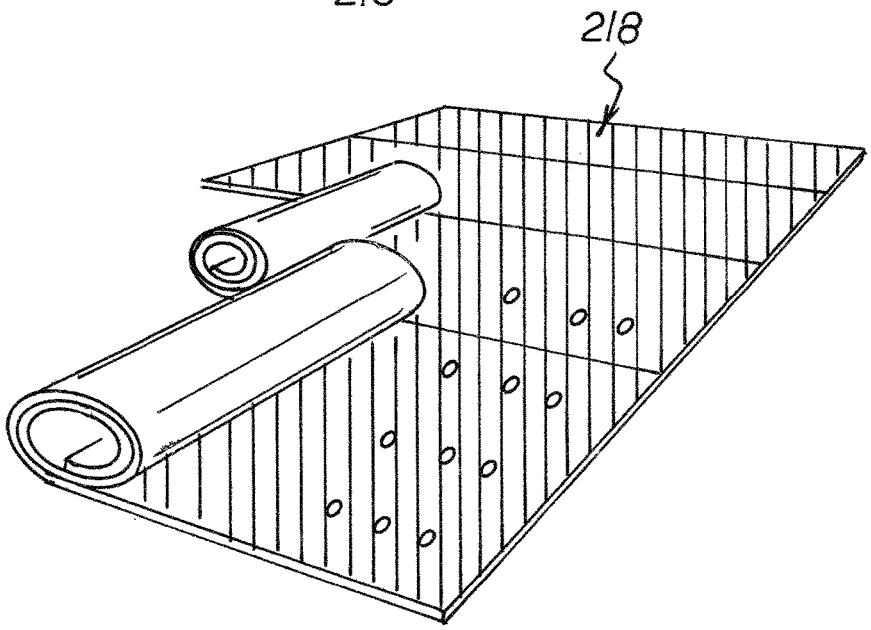
FIG. 55

FIG. 63
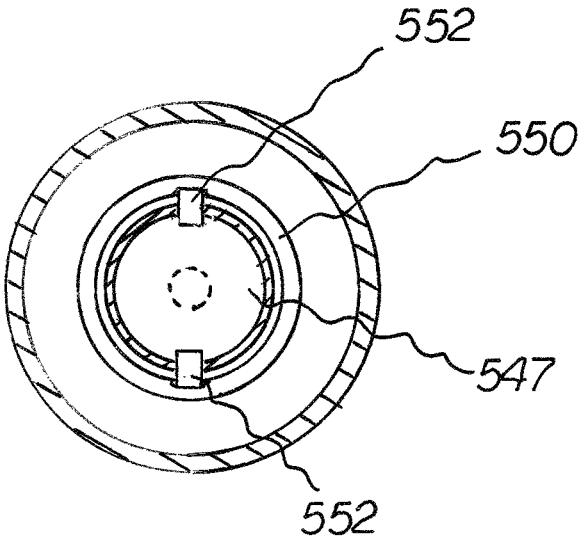
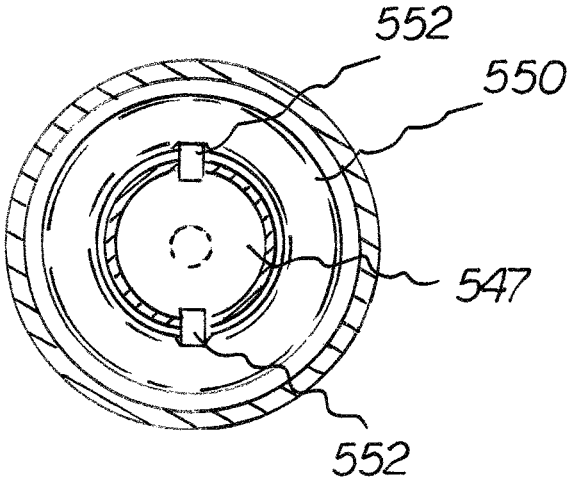
FIG. 64

FIG. 67
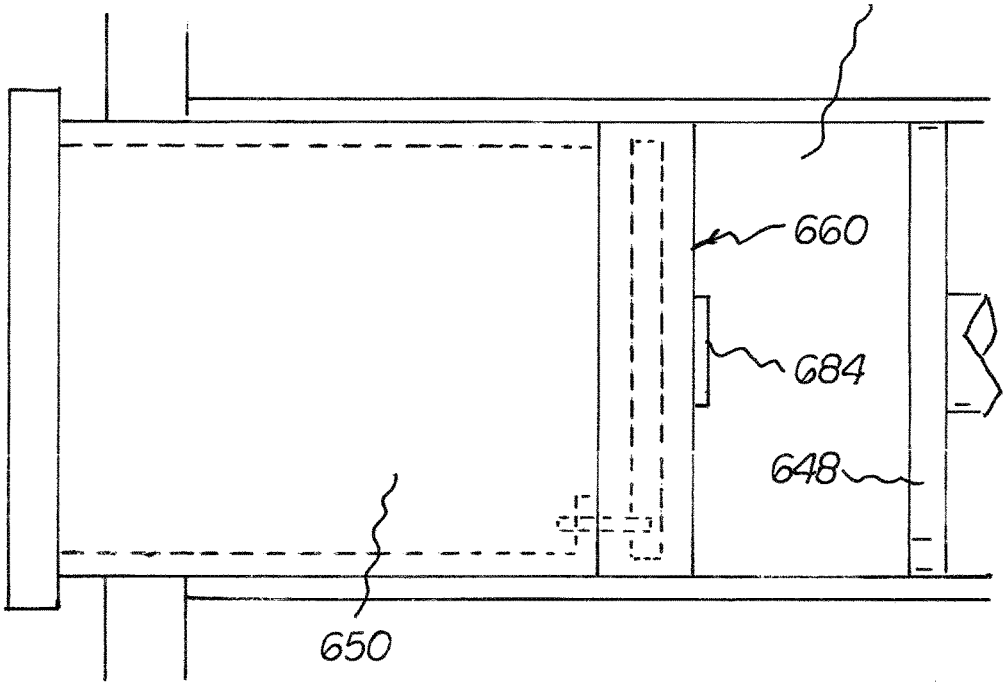
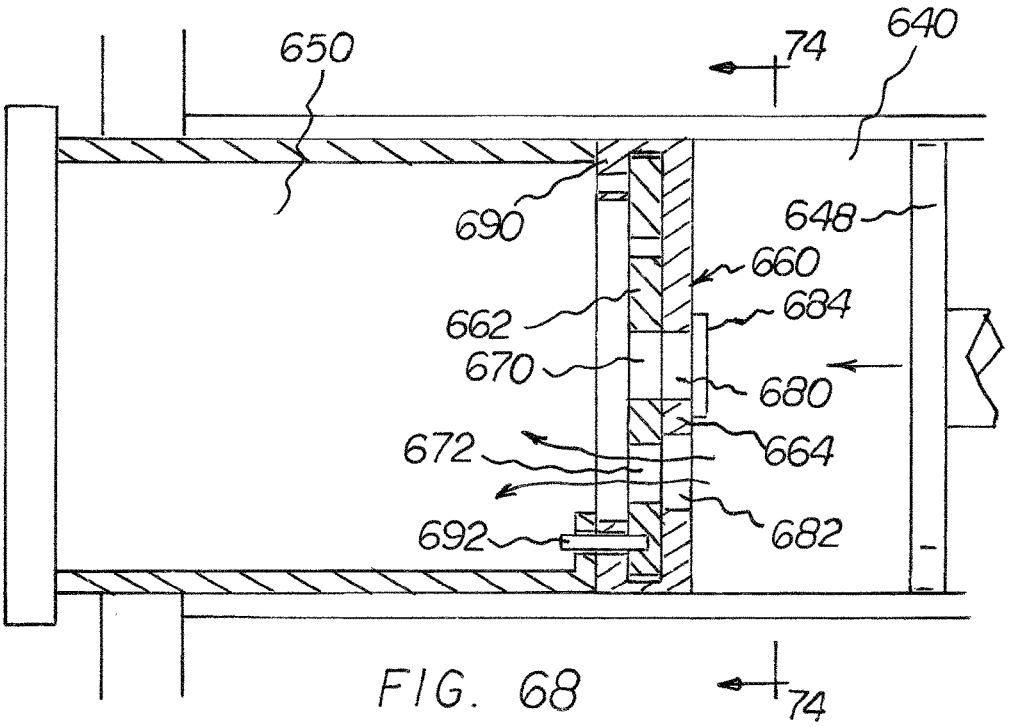
FIG. 68

FIG. 71
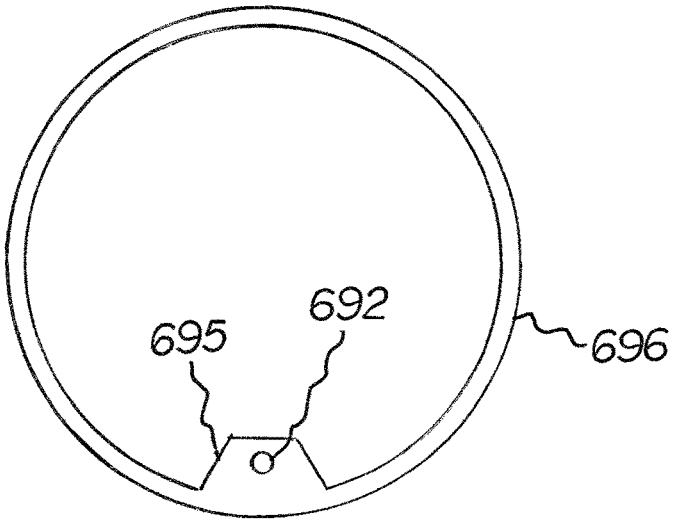
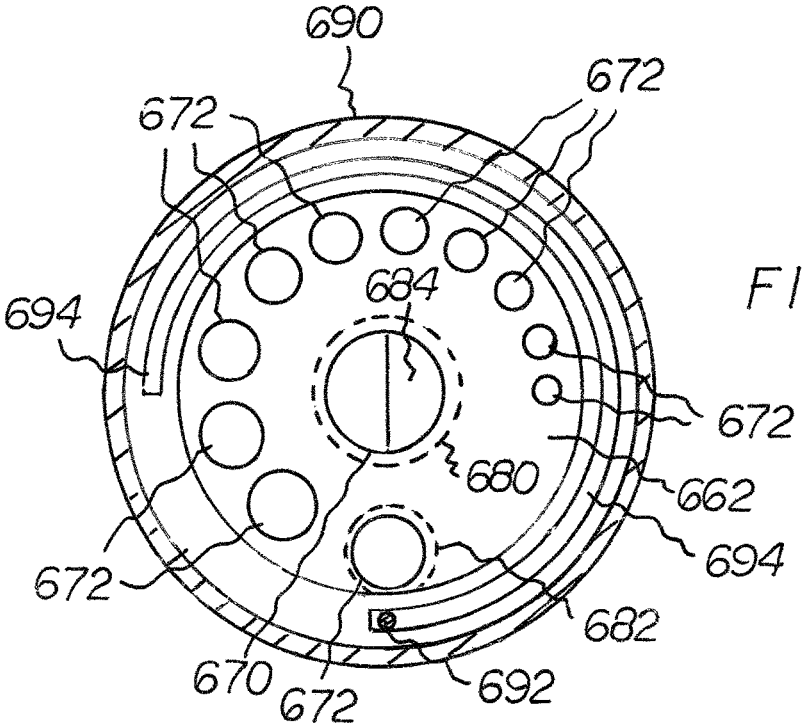
FIG. 72

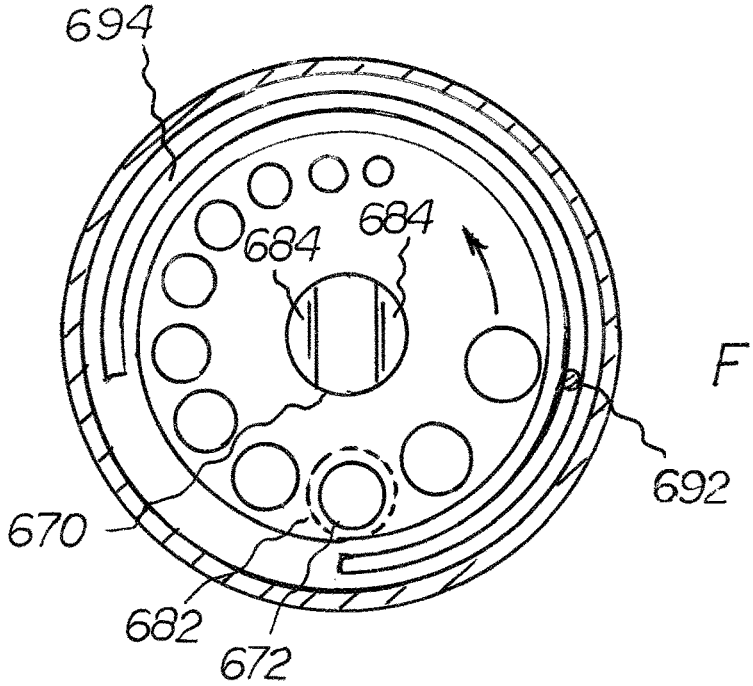
FIG. 73
FIG. 74
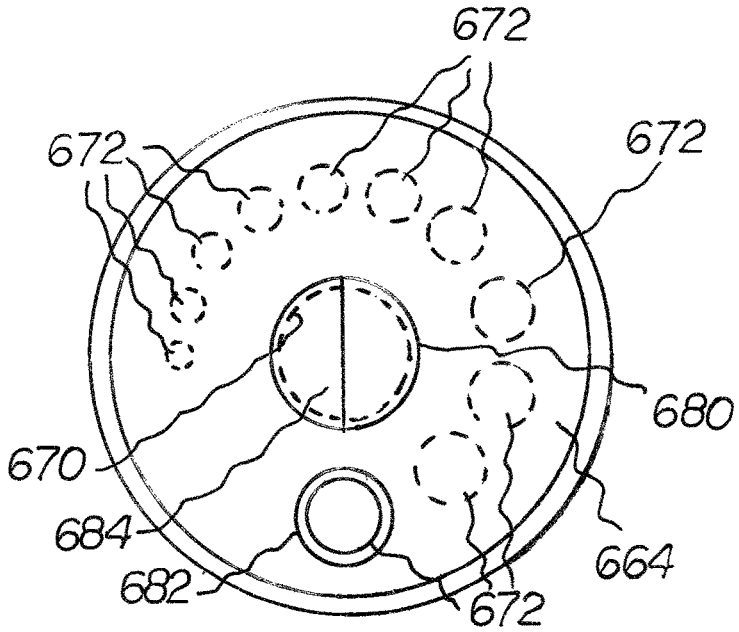

FIG. 78
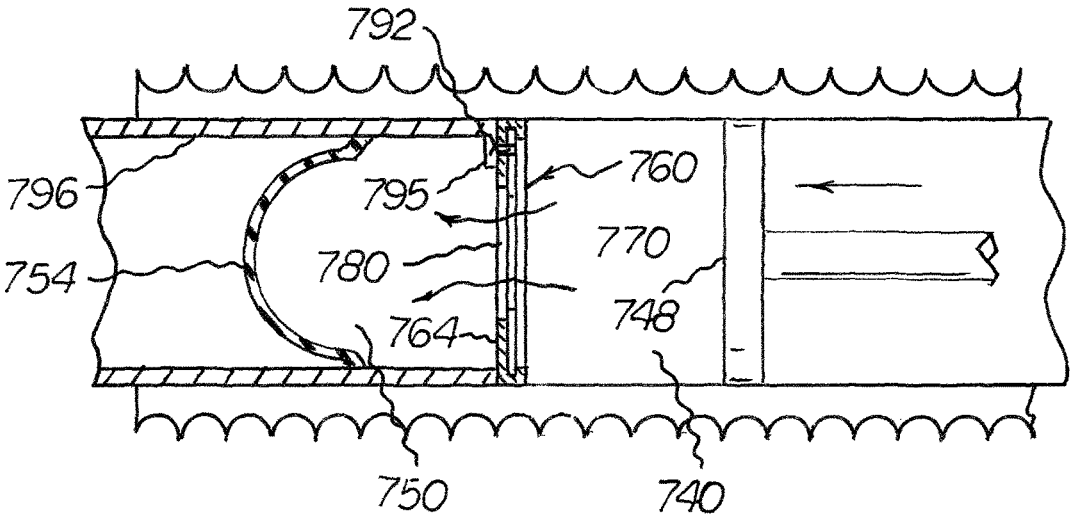
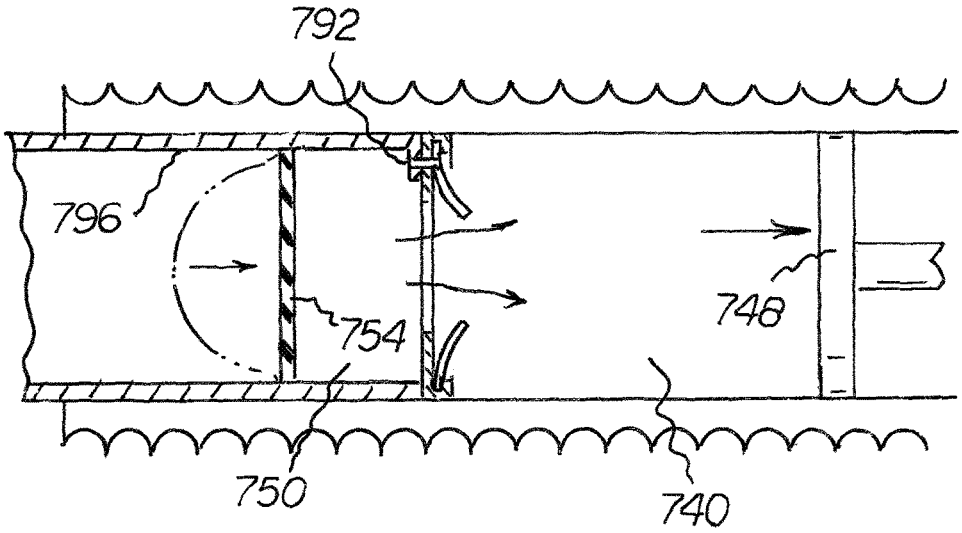
FIG. 79

FIG. 80
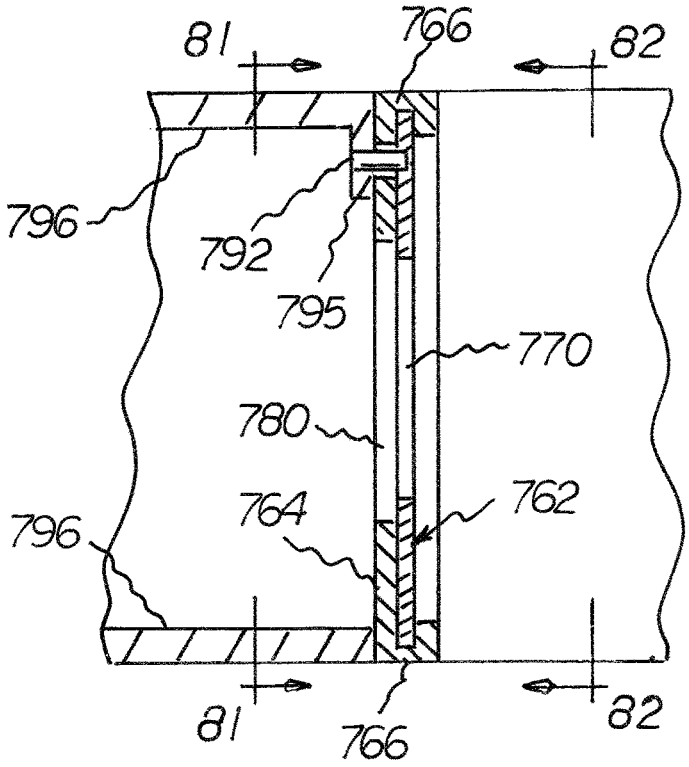
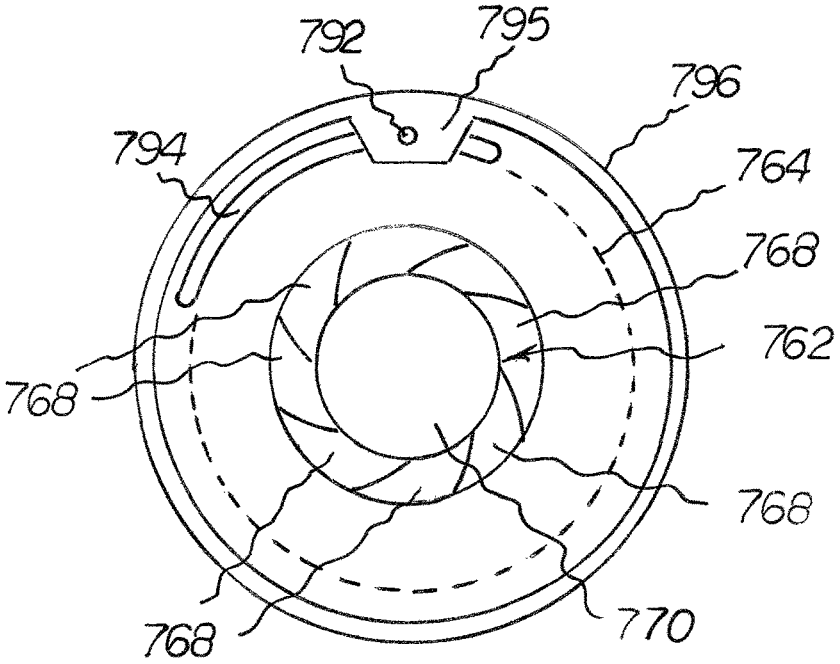
FIG. 81

FIG. 85
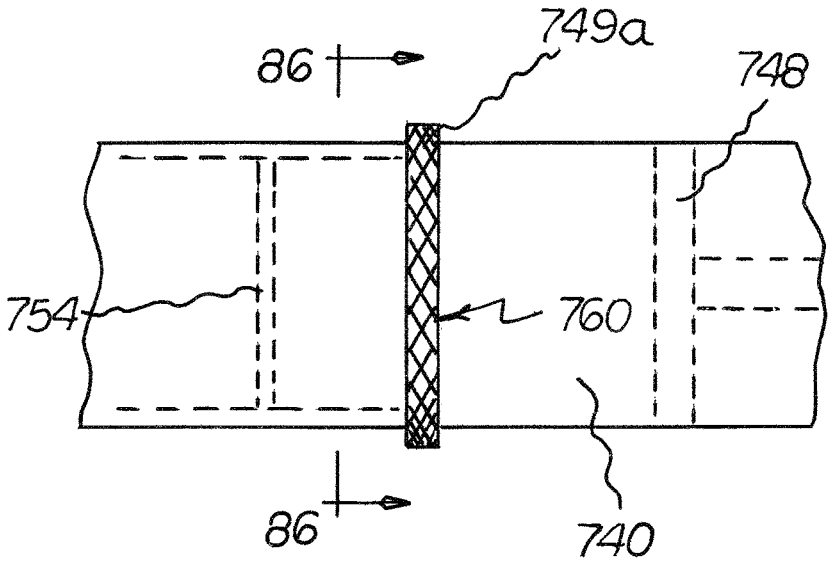
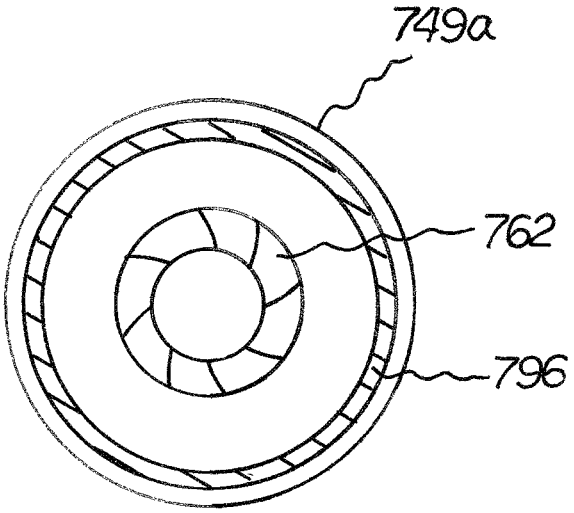
FIG. 86

GYM CAGE

This patent application is a Continuation-In-Part of non-provisional patent application Ser. No. 15/254,746 filed Sep. 1, 2016, which is based on provisional patent application Ser. No. 62/213,230 filed Sep. 2, 2015.

BACKGROUND OF THE INVENTION

Field of the Invention

The present invention relates to an exercise apparatus and, more particularly, to a apparatus having one or more vertical walls or frame members with attachment points thereon to facilitate selective attachment of various resistance devices thereto in order to perform a variety of exercises of different muscle groups.

Discussion of the Related Art

The exercise and development of different muscle groups and subgroups of the human body requires an extensive variety of movement of the arms, legs, back and shoulders through various ranges of movement at different angles while moving against the force of resistance. Conventionally, exercises of the various muscle groups have been performed with the use of free weights, such as on a barbell or dumbbells. Over time, more advanced equipment has been developed for exercising targeted muscle groups by moving a bar, handgrip or other device through a range of movement. In many cases, these various types of equipment will use a cable that is directed through a series of pulleys and attached to a stack of weights. The user can select the amount of weight by using an adjustably positionable pin within the stack of weights so that only the selected amount of weight is lifted by the cable as the user performs the exercise movement. The angle of movement is usually restricted to a certain range and limited number of exercises for specific targeted muscle groups. Accordingly, in order to exercise all of the various muscle groups and subgroups of the human body, it is necessary to have a large number of different exercise machines, with each exercise machine limited to a specific muscle group and/or subgroup. For convenience, various home gyms have been developed that allow for a variety of exercise movements to be performed, usually by using different stations on the home gym and interchanging various equipment, such as handles, bars, leg engaging devices, etc. However, home gyms have limitations and are not able to provide for a full range of exercises to properly strengthen, tone and build all the different muscle groups and subgroups of the human body.

Accordingly, there remains a need for a single apparatus that allows for exercise of all the different muscle groups and subgroups of the human body, for purposes of strength training, muscle toning and muscle building (i.e., bodybuilding). Moreover, there remains a need for a single apparatus that allows for attachment of various resistance devices at all different angles through virtually a 360 Degree dimensional point of attachment so that a user can perform all different types of exercises to properly exercise and develop all the different muscle groups and subgroups of the human body. Furthermore, there remains a need for a single apparatus that allows for use of various resistance devices that selectively attach to a large number of attachment points at different angles throughout virtually a 360 Degree dimensional point of attachment while eliminating the need for heavy weights, such as weight plates.

SUMMARY OF THE INVENTION

The present invention is directed to an exercise apparatus, and more particularly a gym cage that is designed to be used as a supporting structure for a variety of other exercise devices.

The apparatus consists of a metal skeletal frame having one or more walls and can be square, rectangular, circular, oval, or various other configurations. A rectangular shape with four sides and three walls is illustrated in the attached drawings. The gym cage can be constructed in various dimensions as long as it is sufficiently tall, wide, and deep to allow for a tall standing person to complete a variety of exercises within its dimensions. The embodiments illustrated in the attached drawings are approximately 8 foot tall, 7 foot wide, and 5 feet deep.

The gym cage apparatus does not utilize weight plates, rather it relies upon a variety of strategically placed attachment points that enable cabled resistance devices to be attached. By attaching a hand held resistance device (see FIGS. 38-40), a stretch band resistance device (not shown), or any other similar resistance device to any of the vertical bars, and/or horizontal bars and/or adjustable height ceiling, and/or metal floor of the gym cage, the user has virtually a 360 degree dimensional point of resistance to perform a wide variety of exercises.

The key function of the gym cage apparatus is to provide the strategically placed attachment points for easily and quickly attaching and disconnecting the resistance devices throughout a workout routine. Presently, three types of attachment points are contemplated and include inset (i.e., recessed) attachment points, fixed hook attachment points and adjustably positionable hook attachment points. Other attachment mechanisms and designs are contemplated within the scope of the invention as well. Resistance devices that are fully contemplated for use with the present invention include, but are not limited to, adjustable resistance devices, such as disclosed in U.S. Pat. No. 8,905,904, which can include adjustable resistance handgrip devices, and bar devices, as well as adjustable resistance inline devices. Elastomeric resistance bands and cords are also contemplated for use with the present invention.

BRIEF DESCRIPTION OF THE DRAWINGS

For a fuller understanding of the nature of the present invention, reference should be made to the following detailed description taken in conjunction with the accompanying drawings in which.

Figure 3:
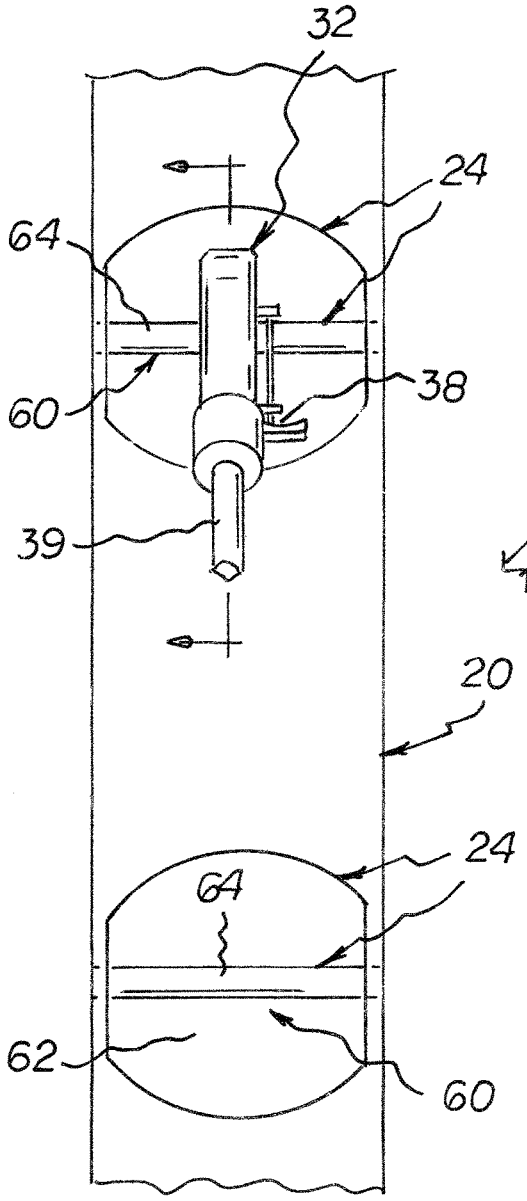
FIG. 3 is an isolated front elevational view of a coupler and inset attachment point illustrating the quick connect coupler locked into the inset attachment point on one of the bars of the gym cage structure.
Figure 5:
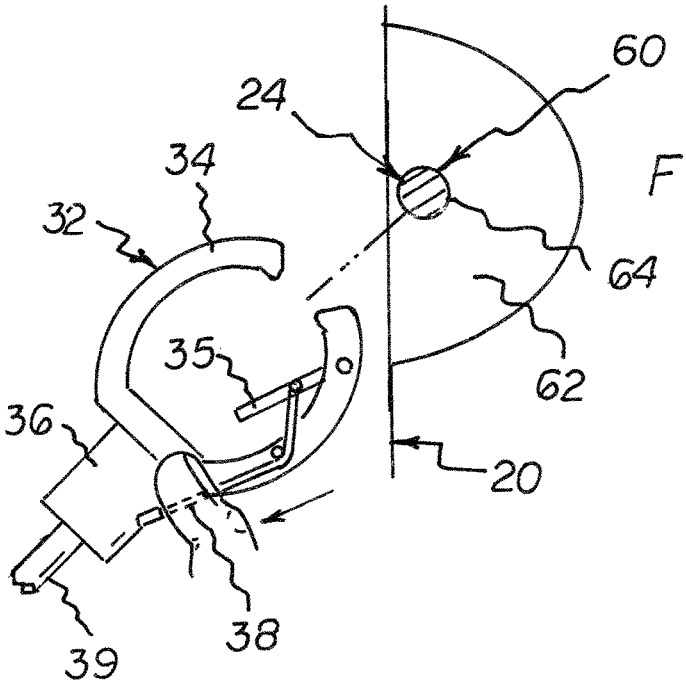
Figure 6:
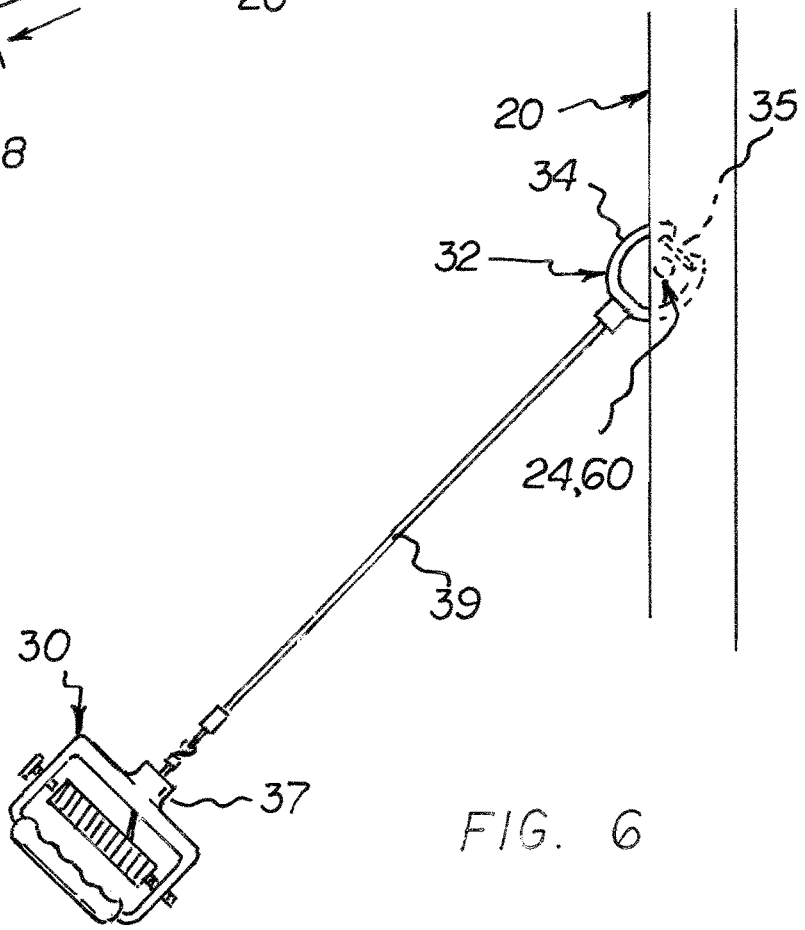
Figure 6A:
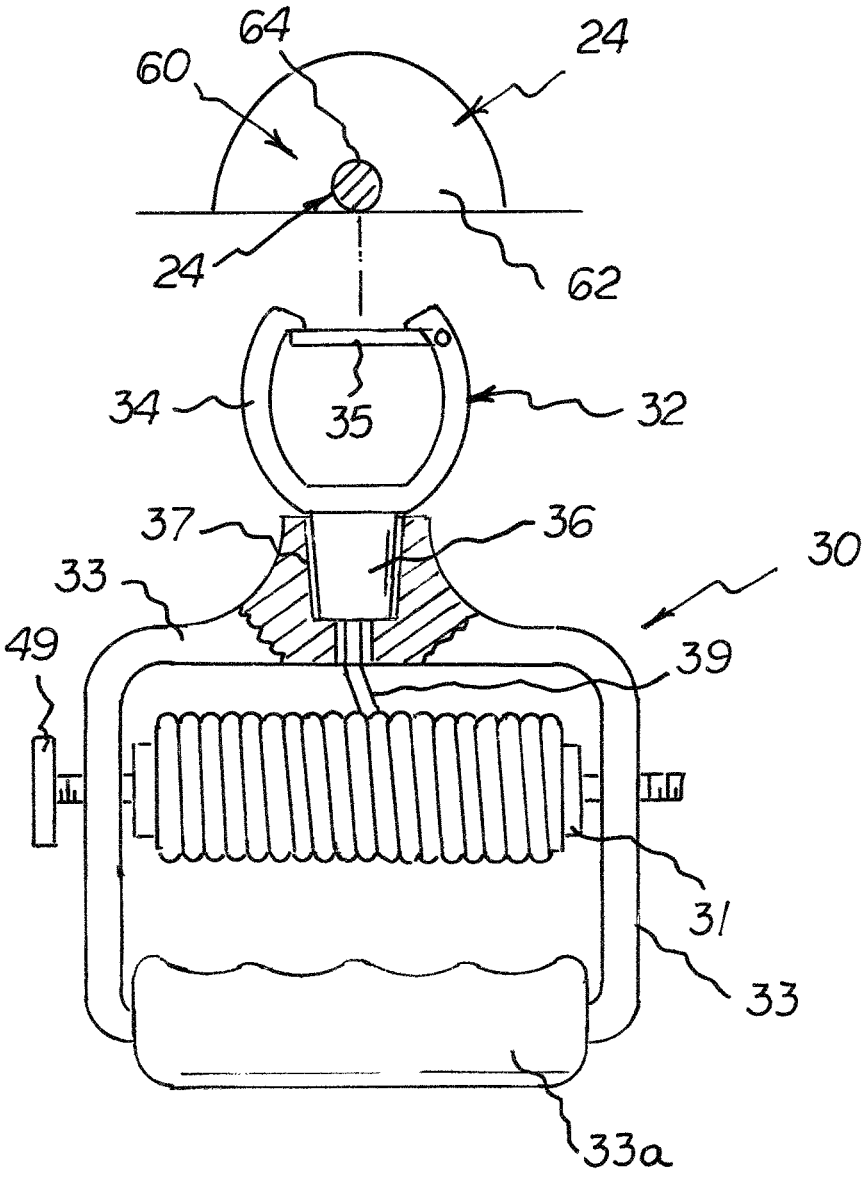
Figure 7:
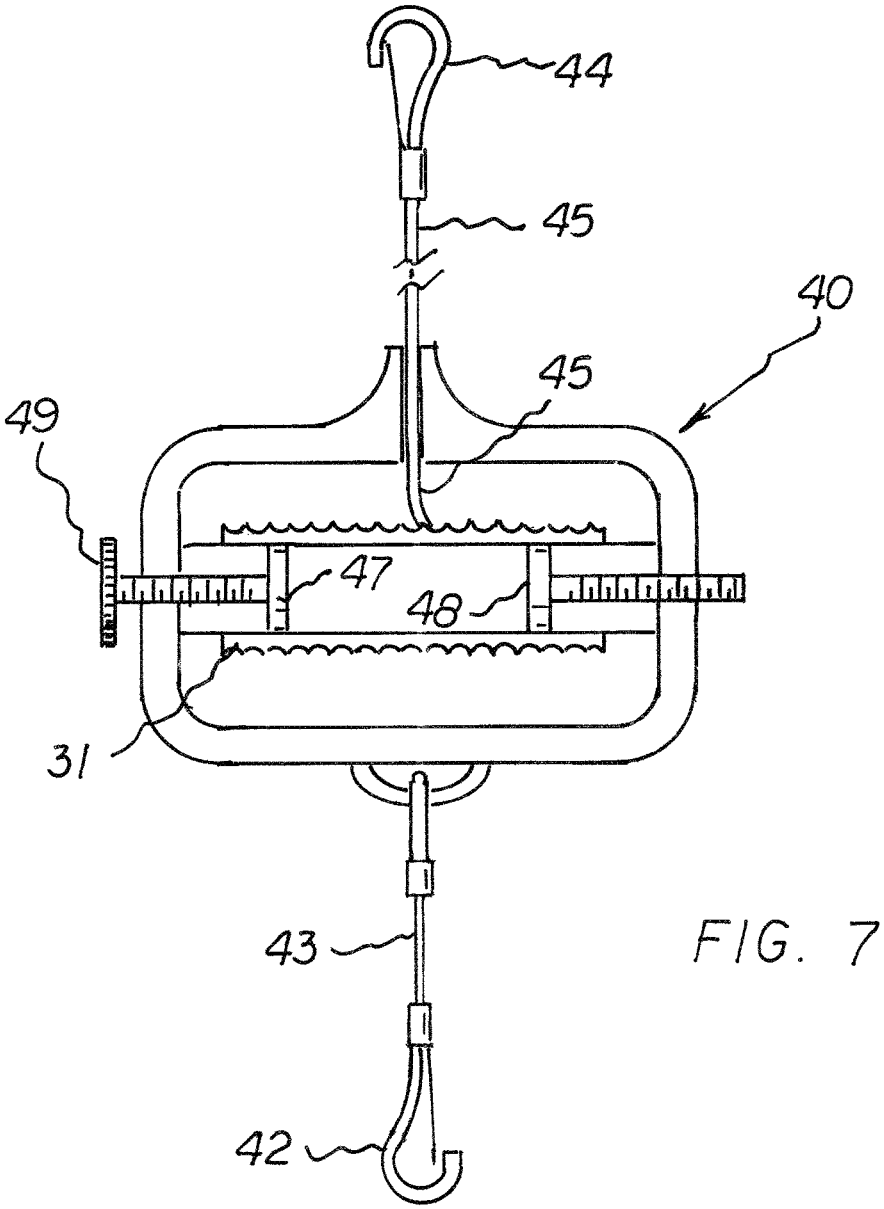
Figure 8:
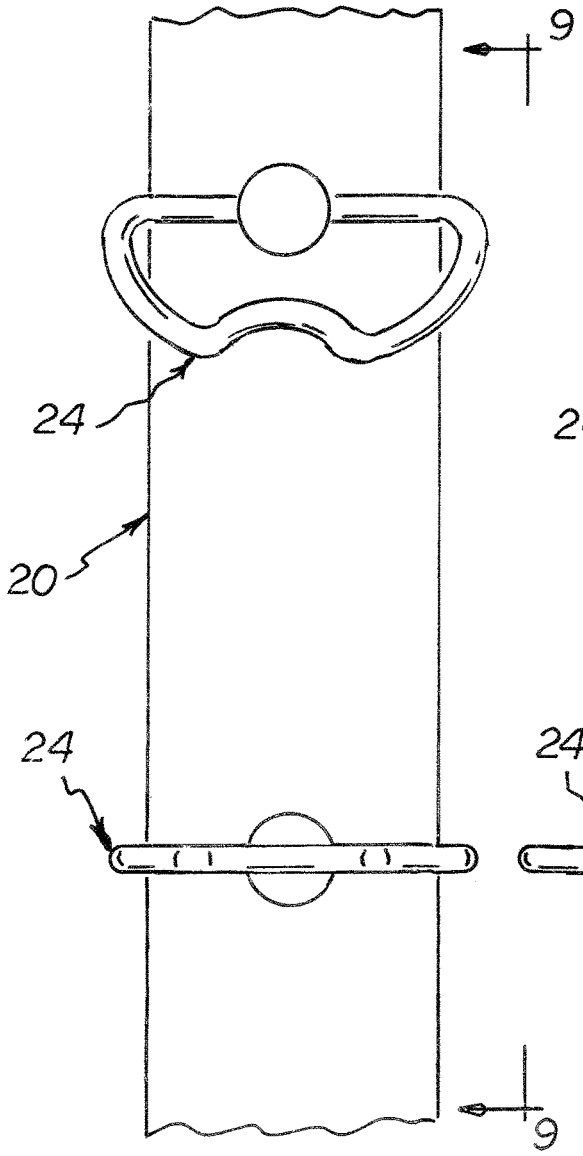
Figure 9:
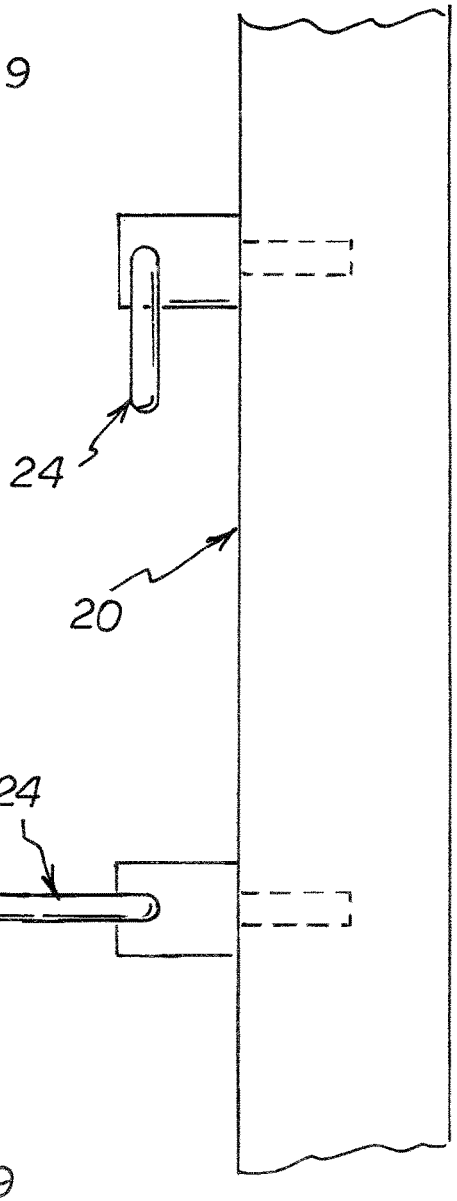
Figure 10:
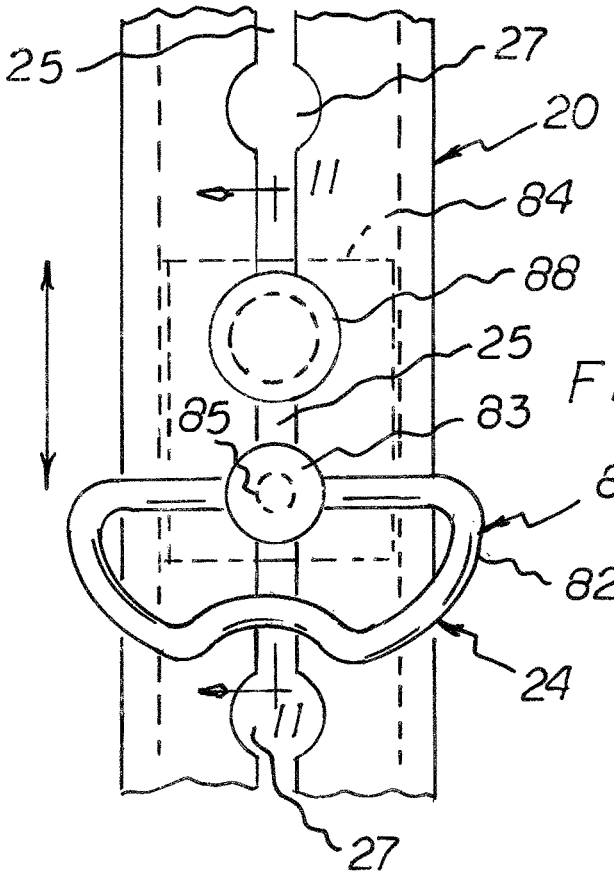
Figure 11:
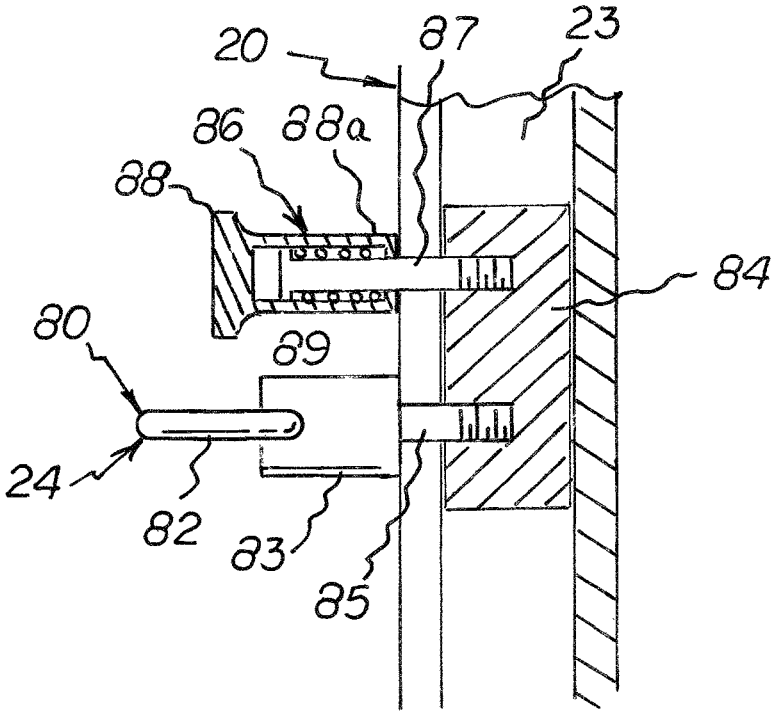
Figure 12:
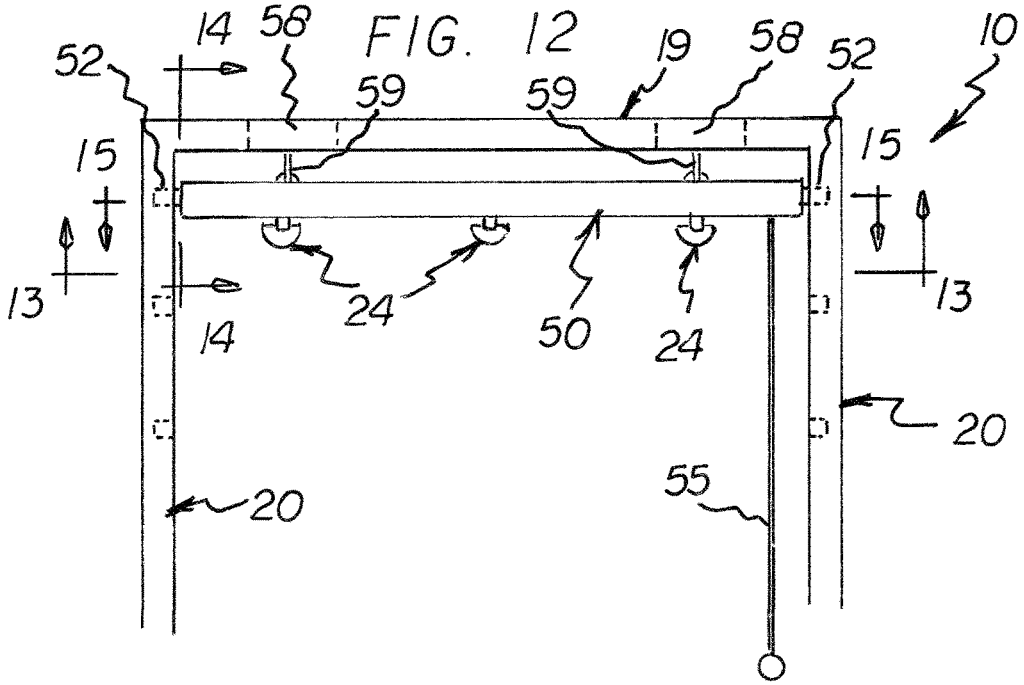
Figure 13:
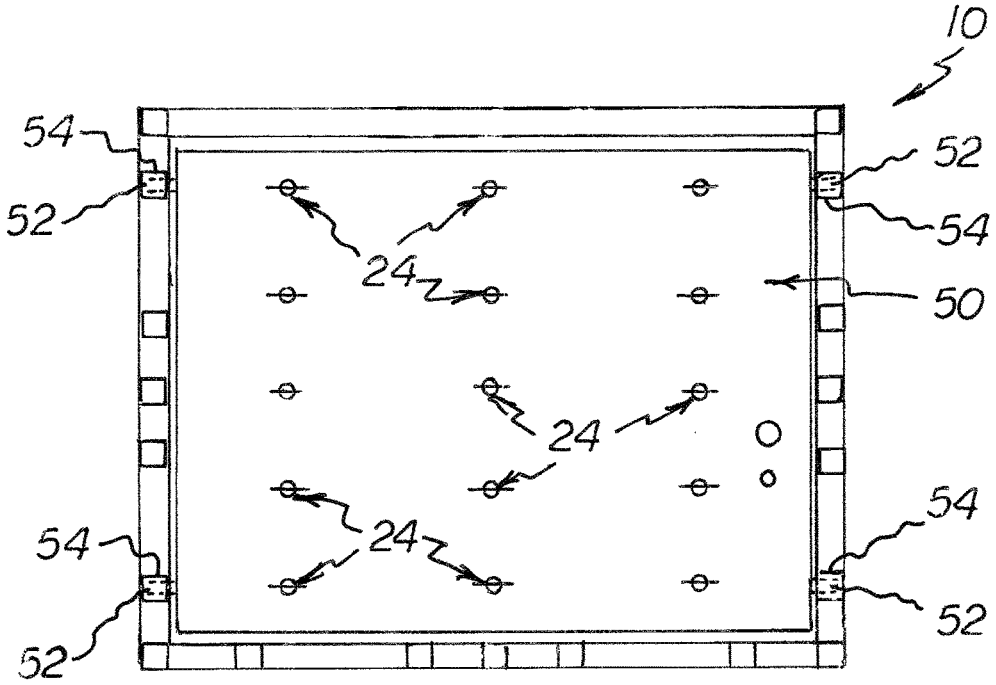
Figure 20:
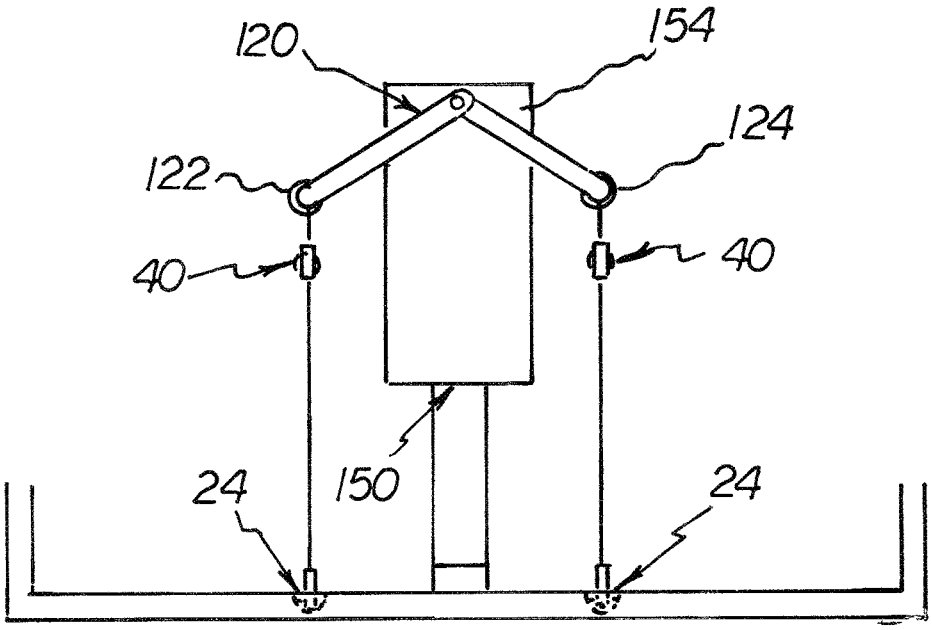
Figure 21:
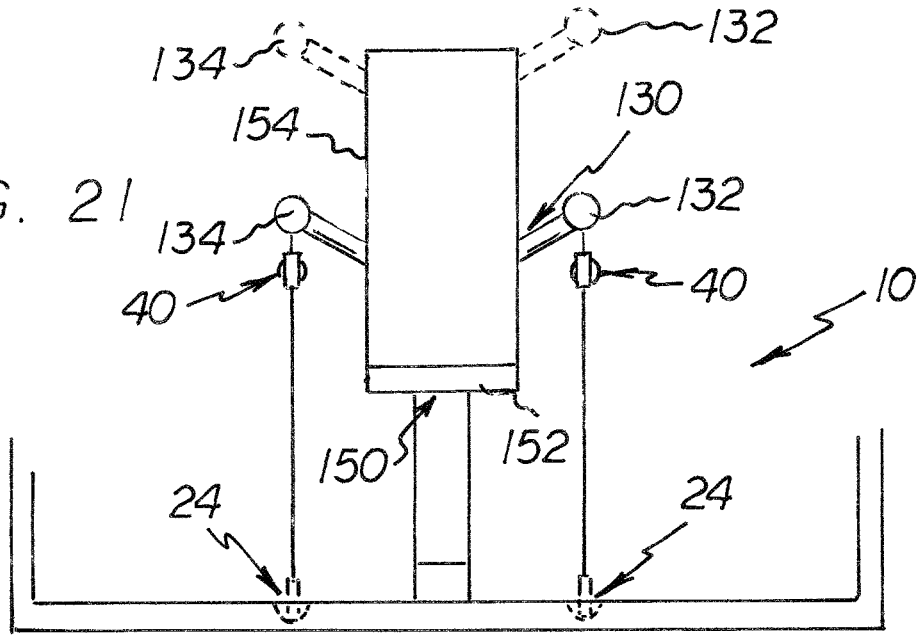
Figure 22:
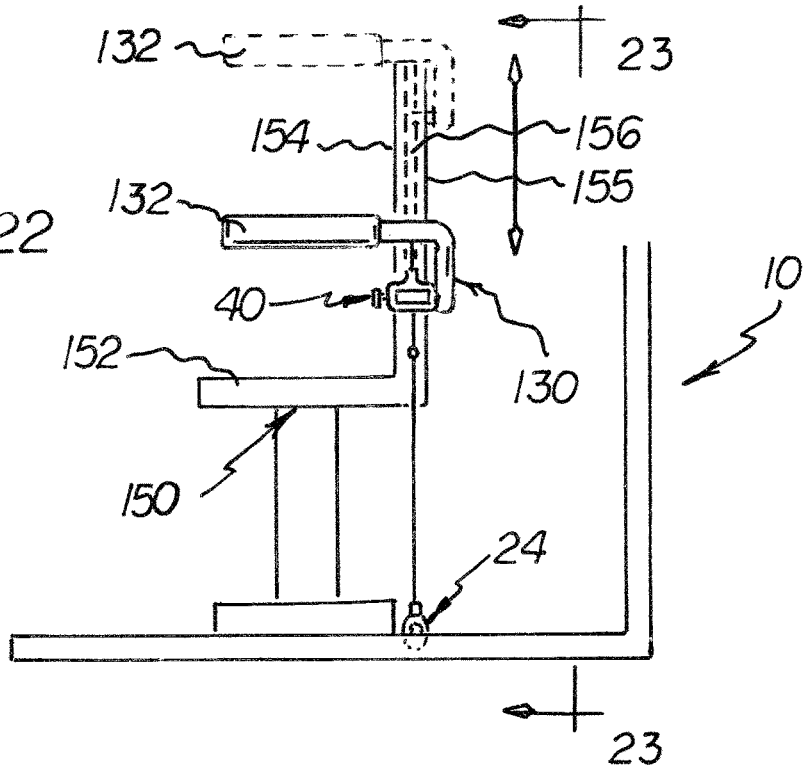
Figure 23:
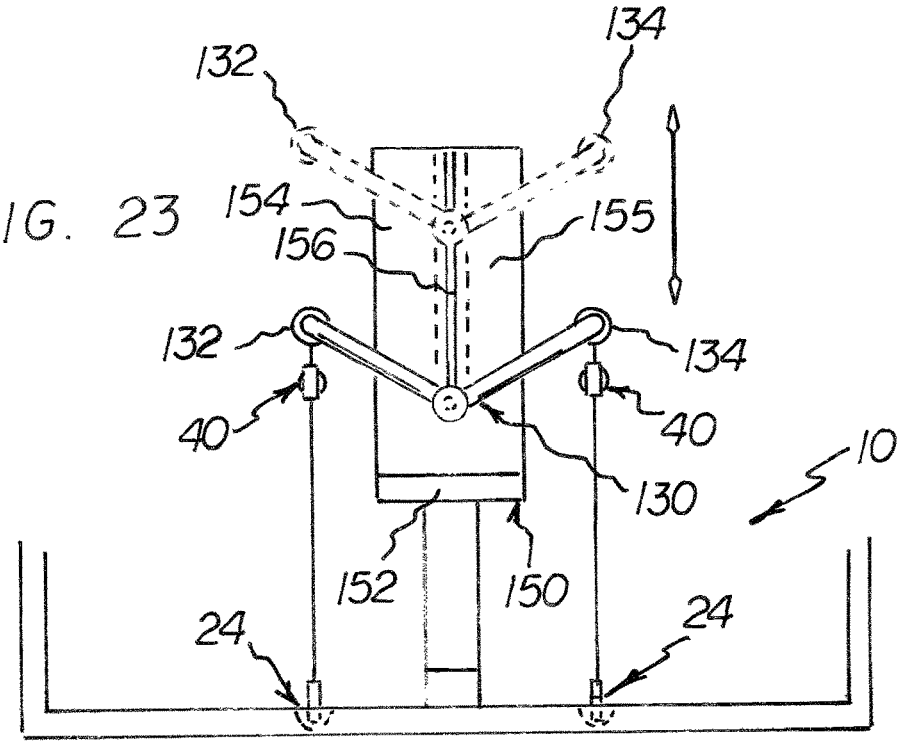
Figure 28:
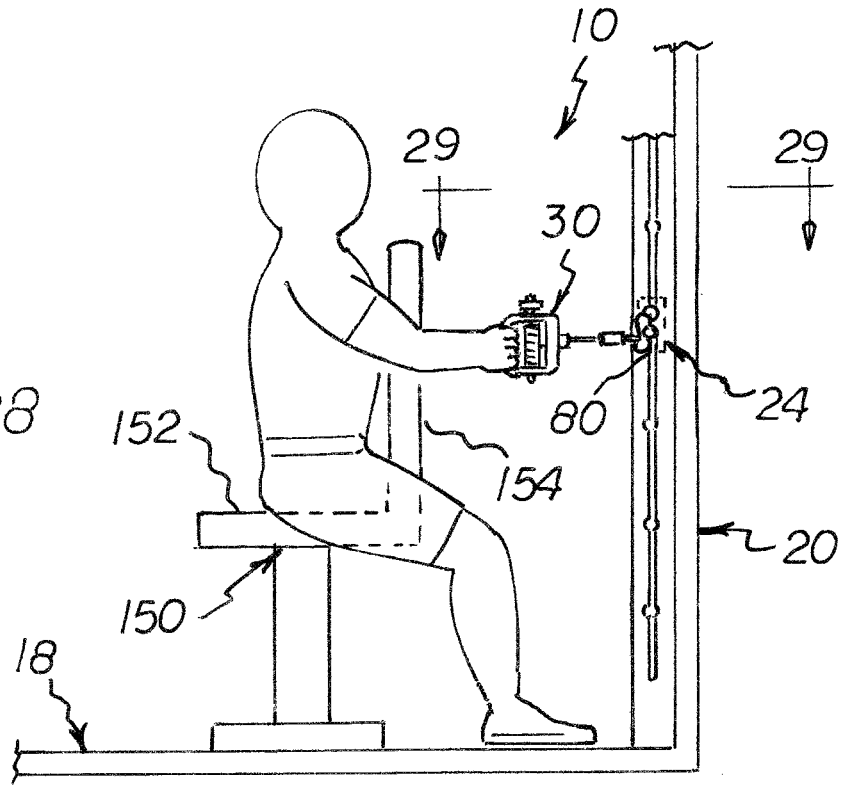
Figure 29:
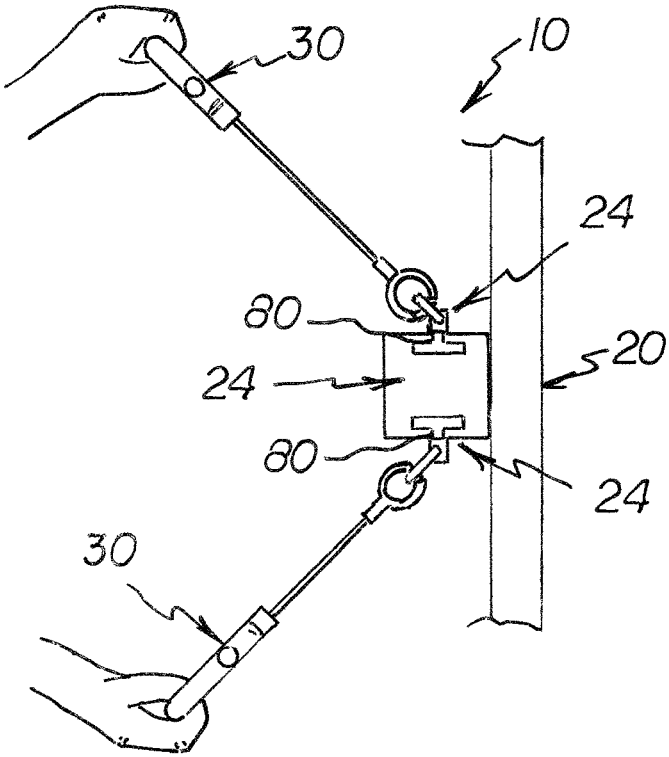
Figure 30:
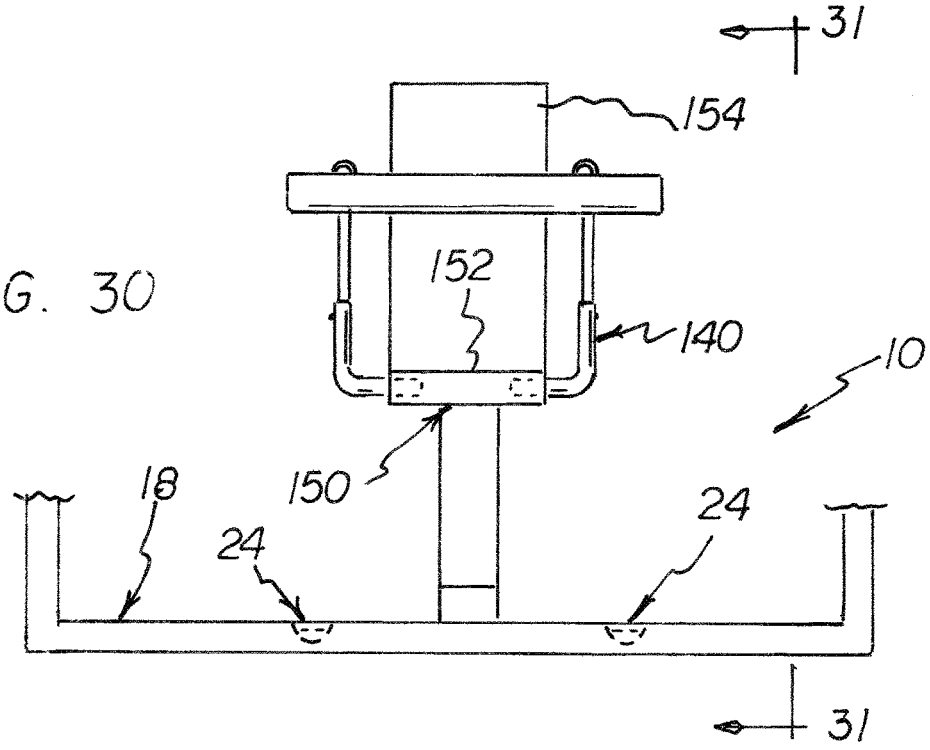
Figure 31:
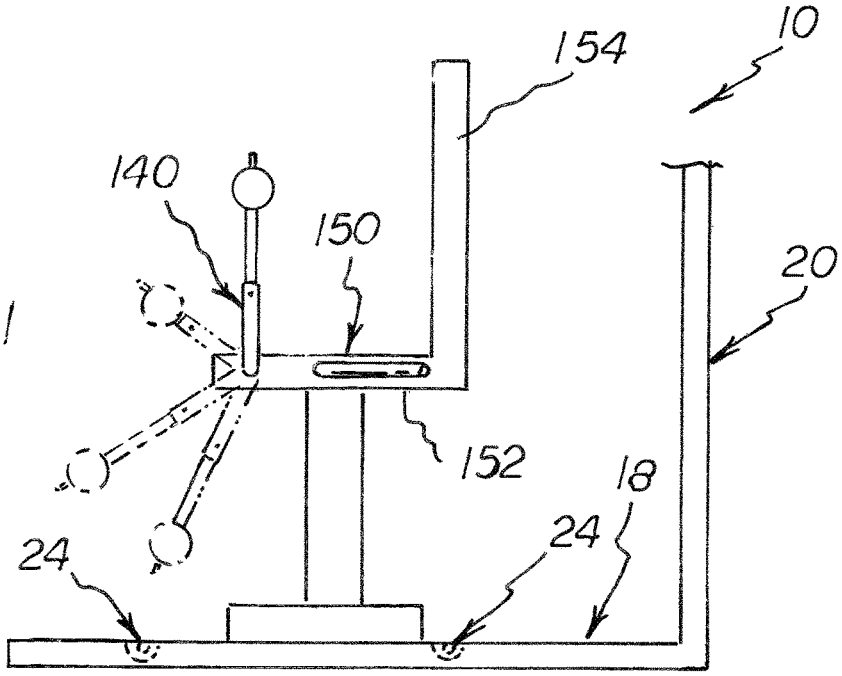
Figure 32:
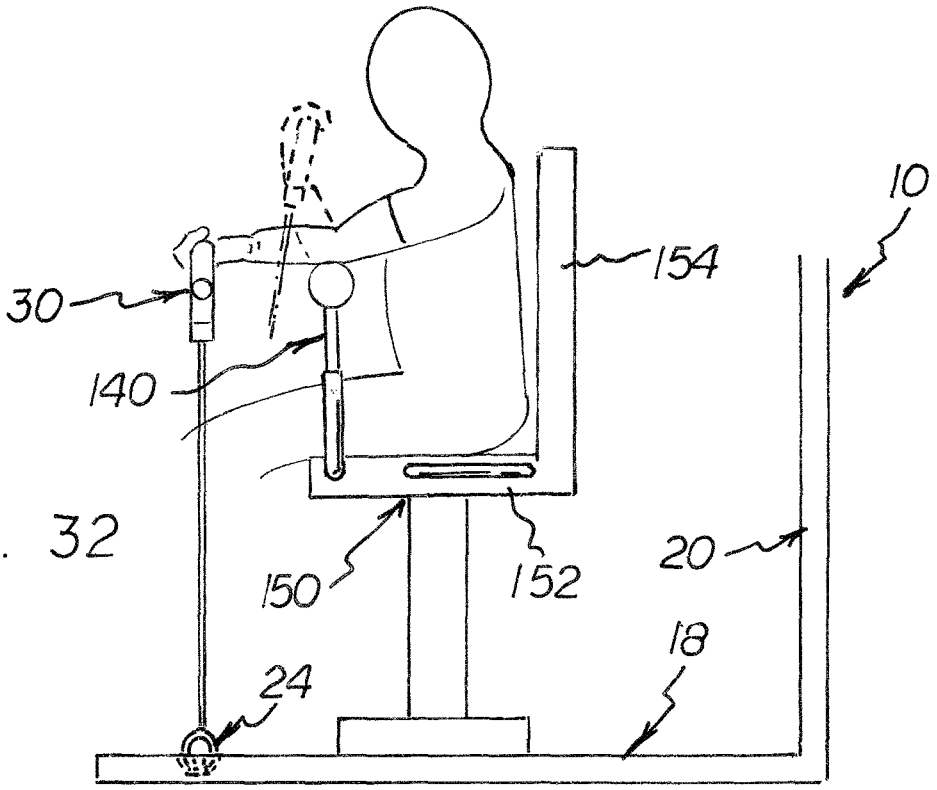
Figure 33:
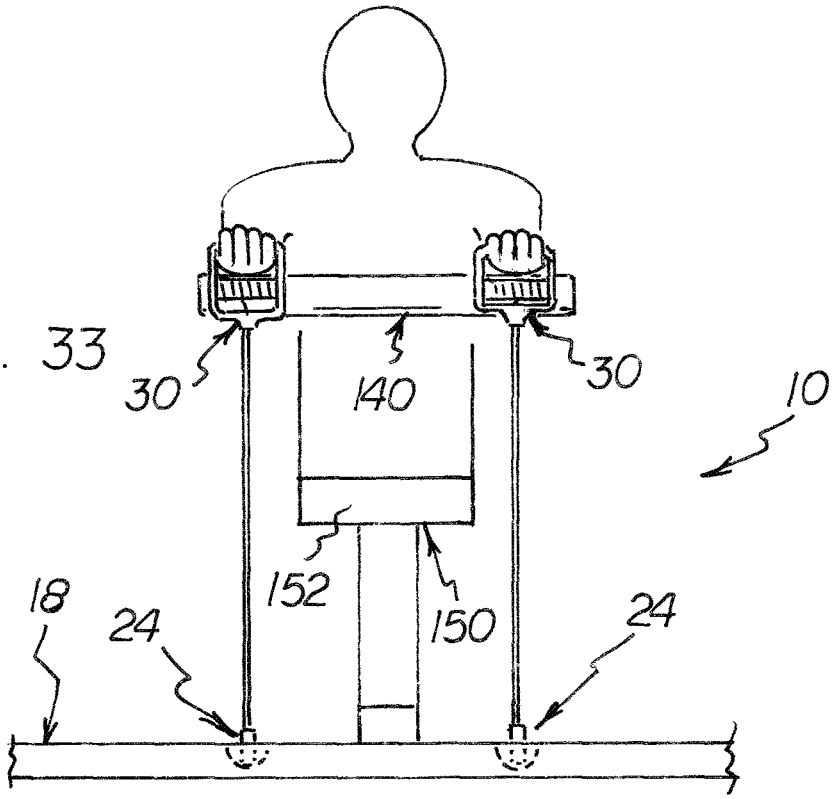
Figure 34:
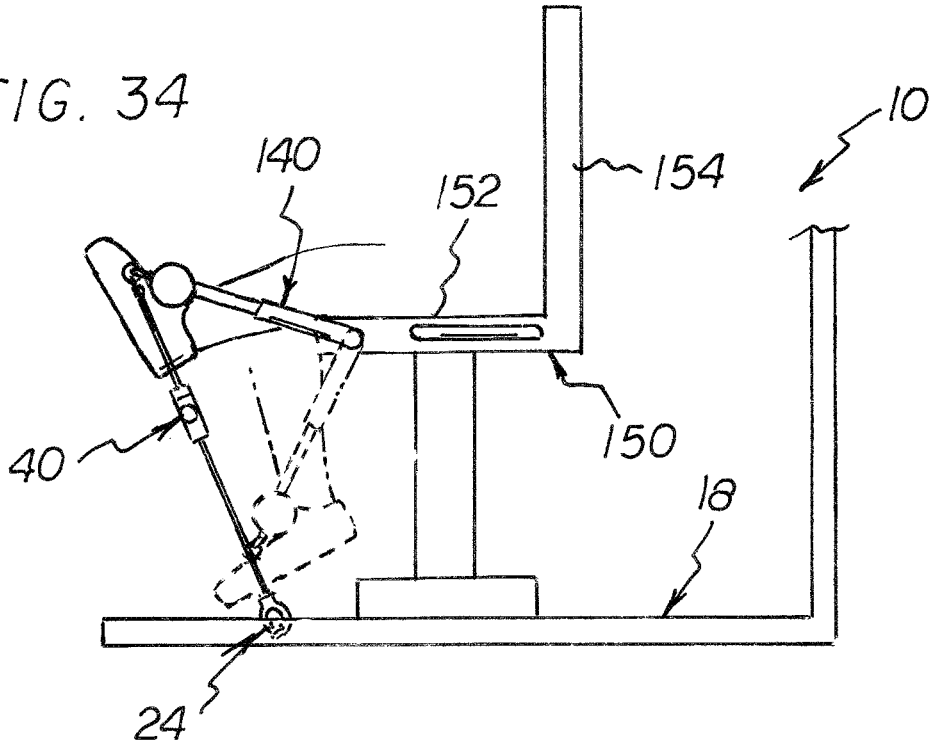
Figure 35:
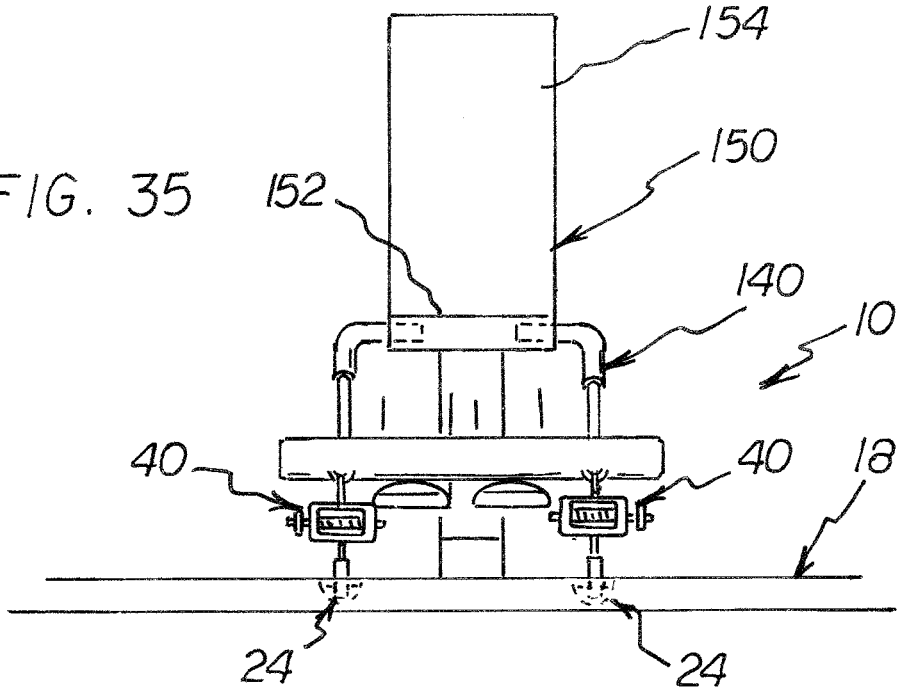
Figure 38:
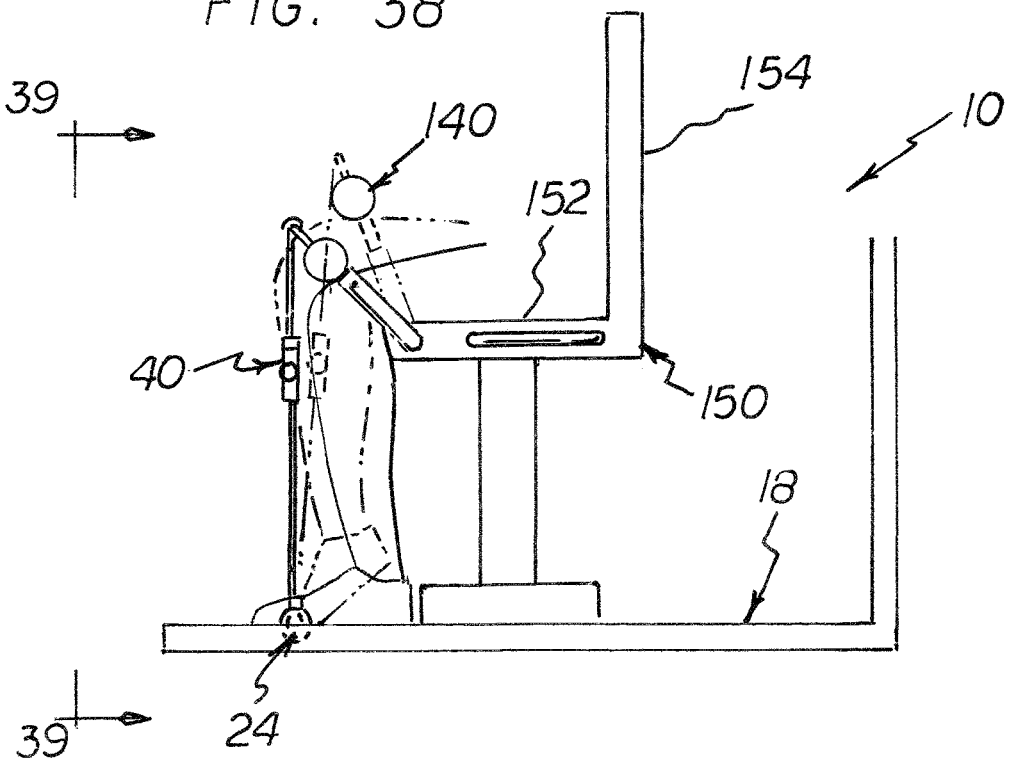
Figure 39:
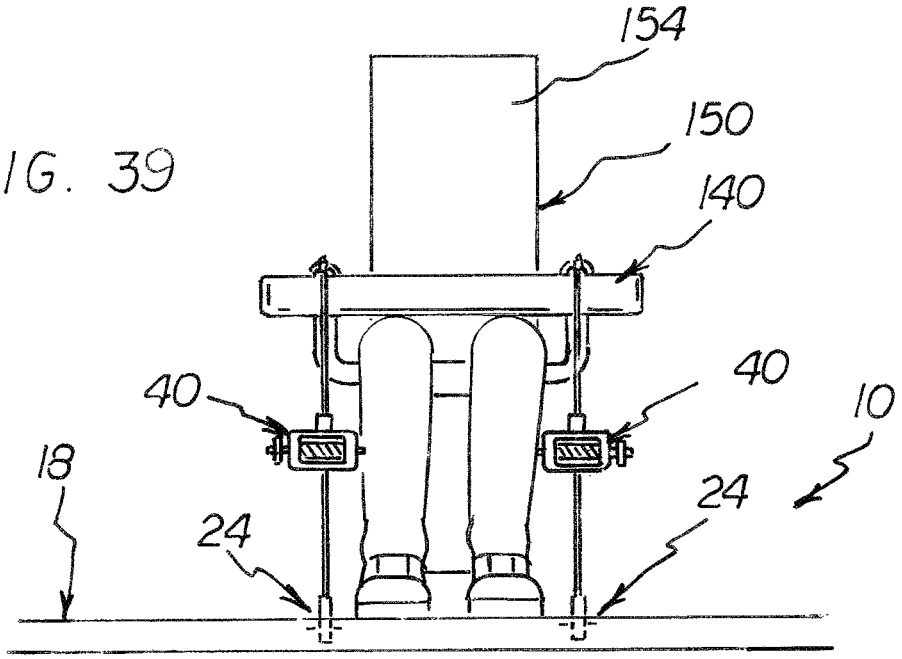
Figure 40:
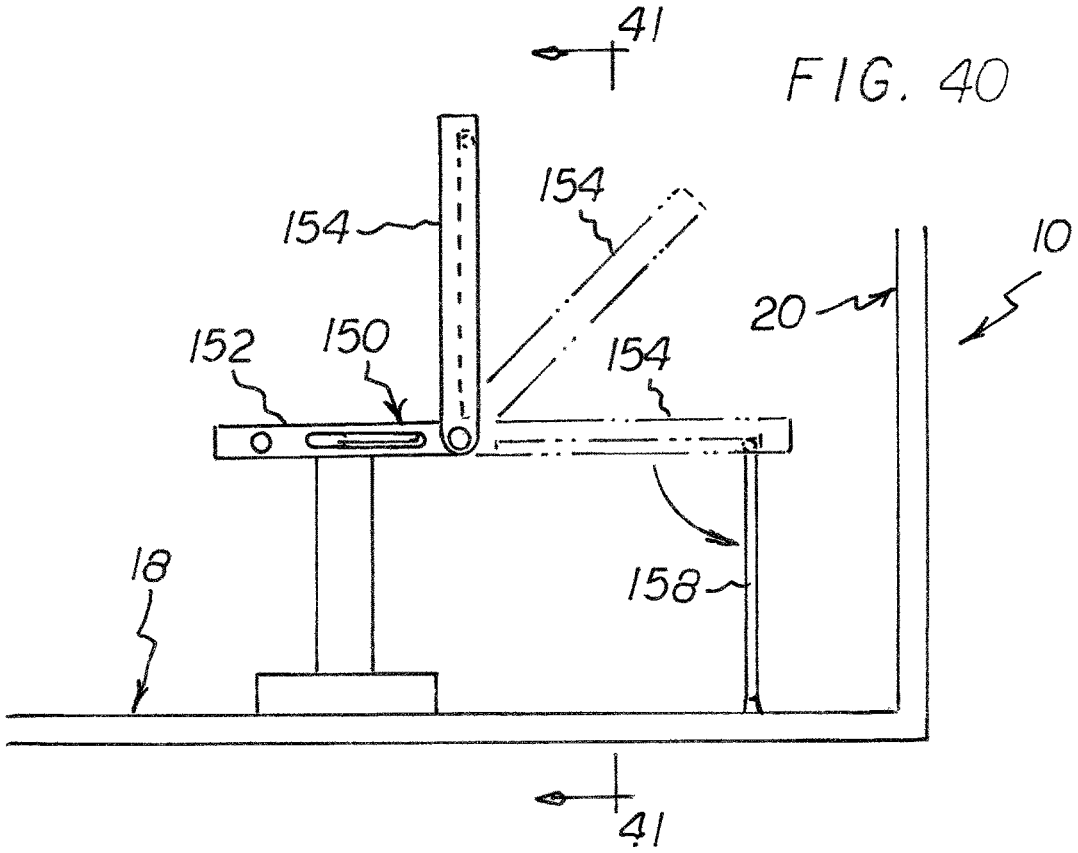
Figure 41:
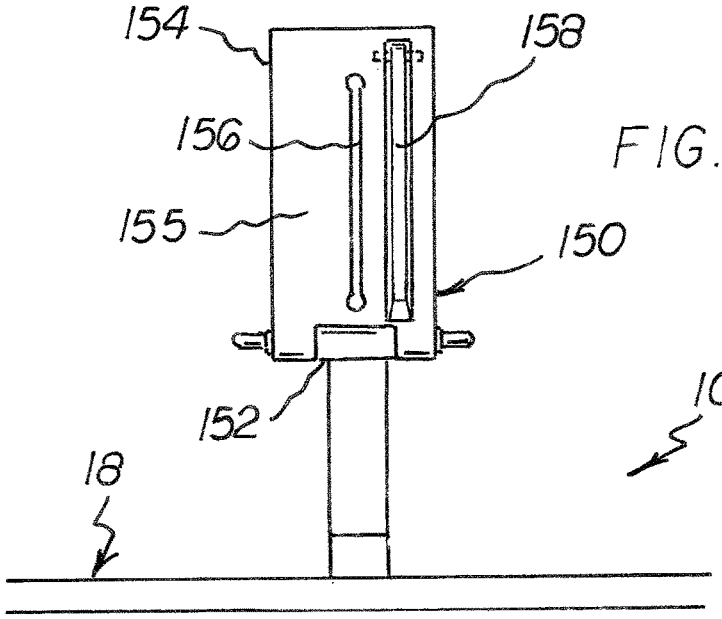
Figure 42:
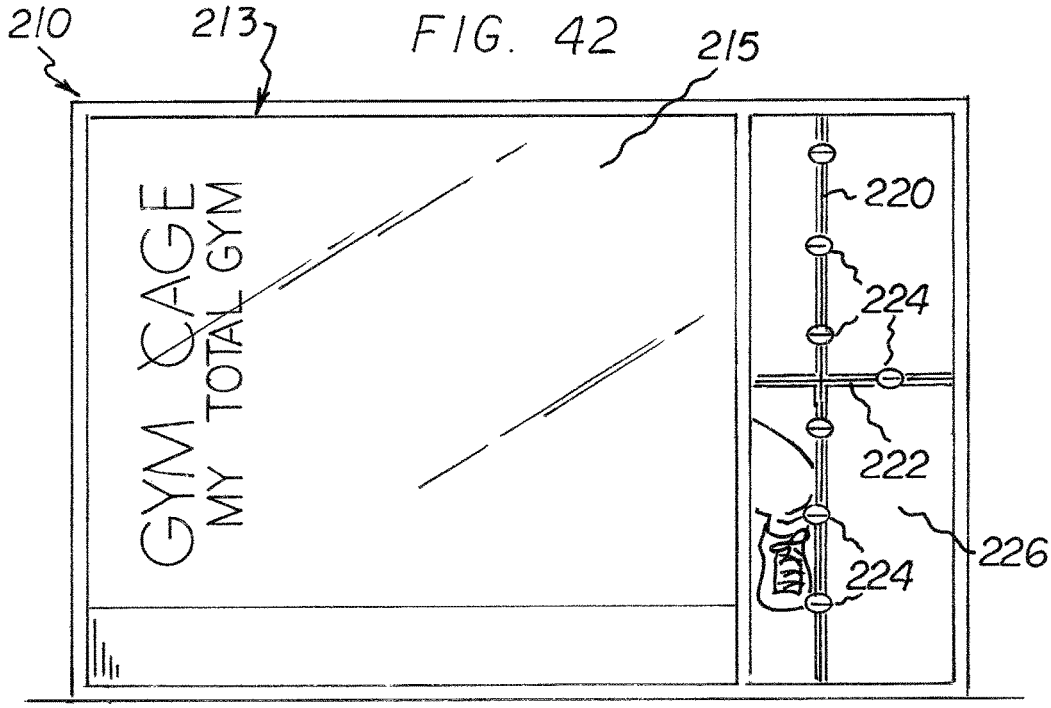
Figure 43:
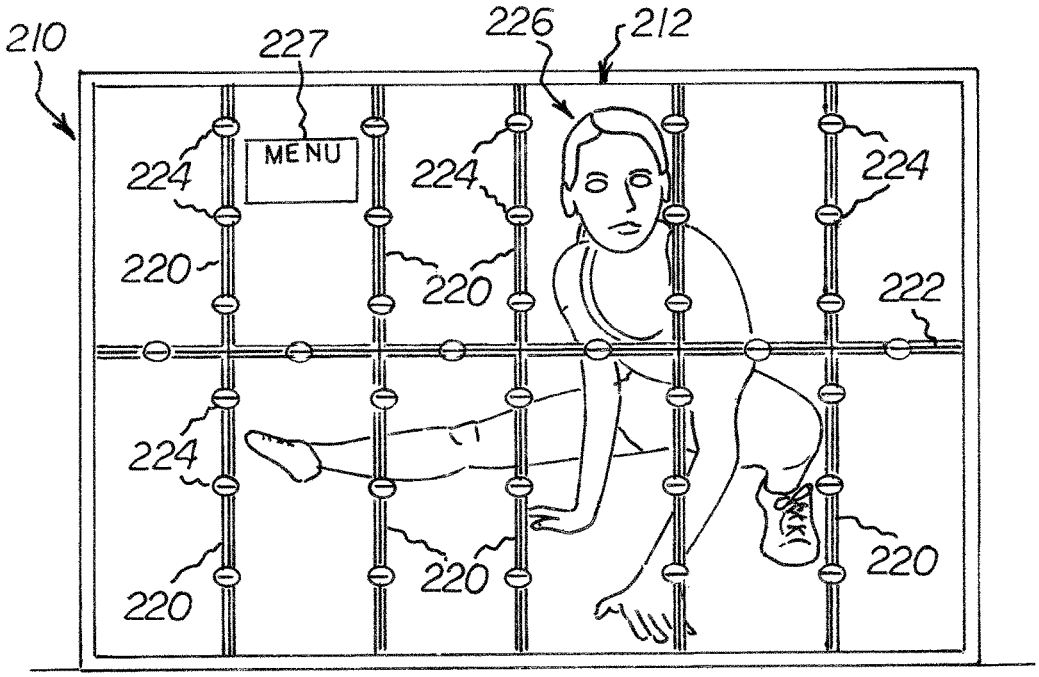
Figure 46:
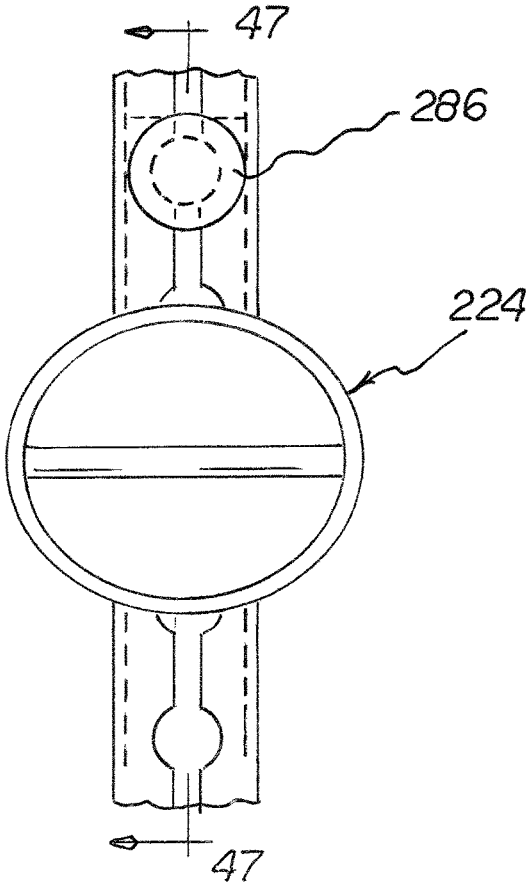
Figure 47:
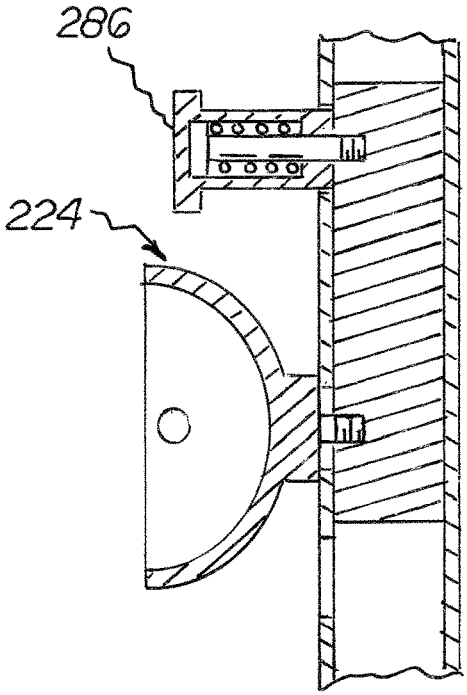
Figure 48:
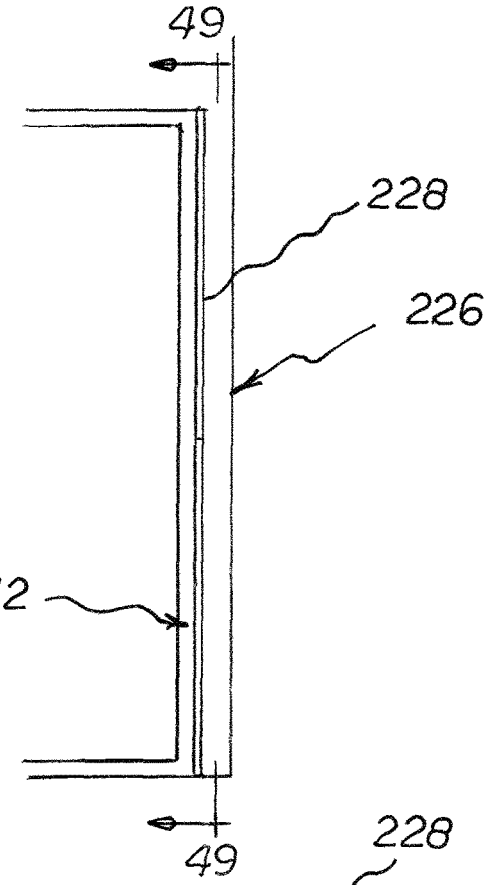
Figure 49:
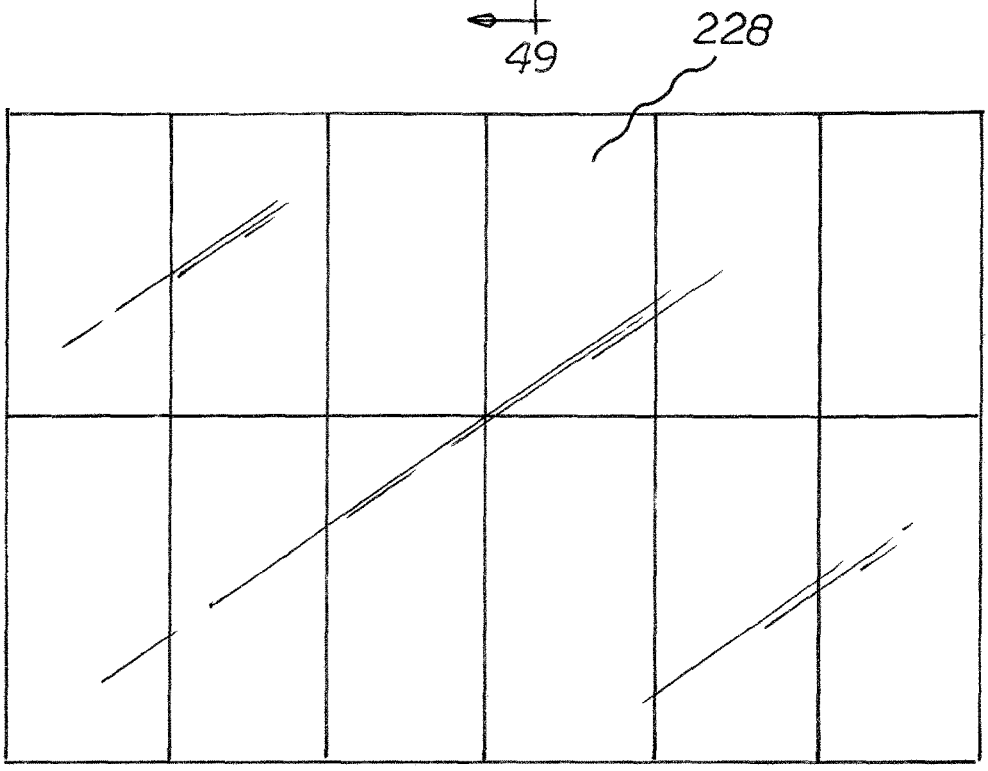
Figure 50:
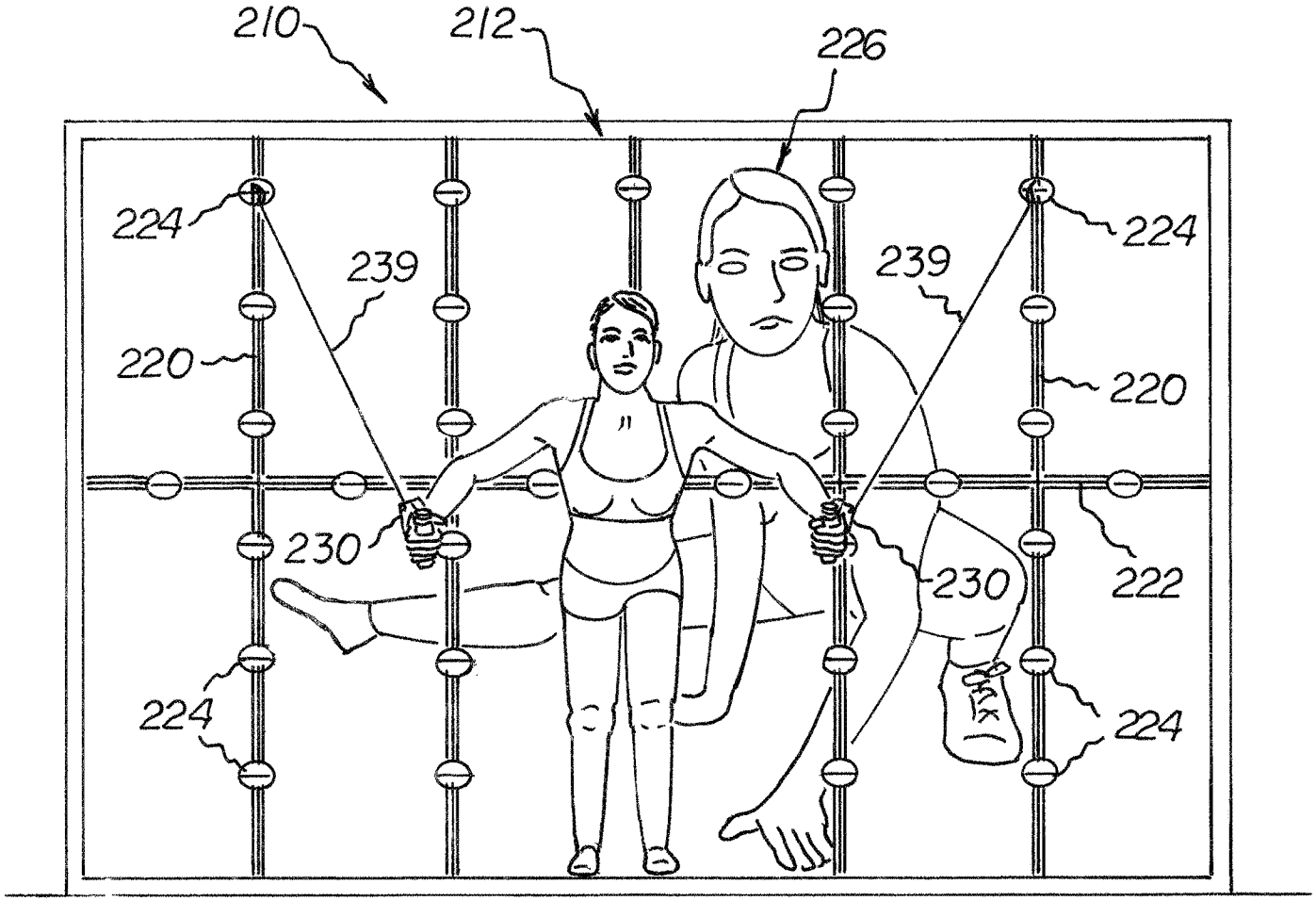
Figure 51:
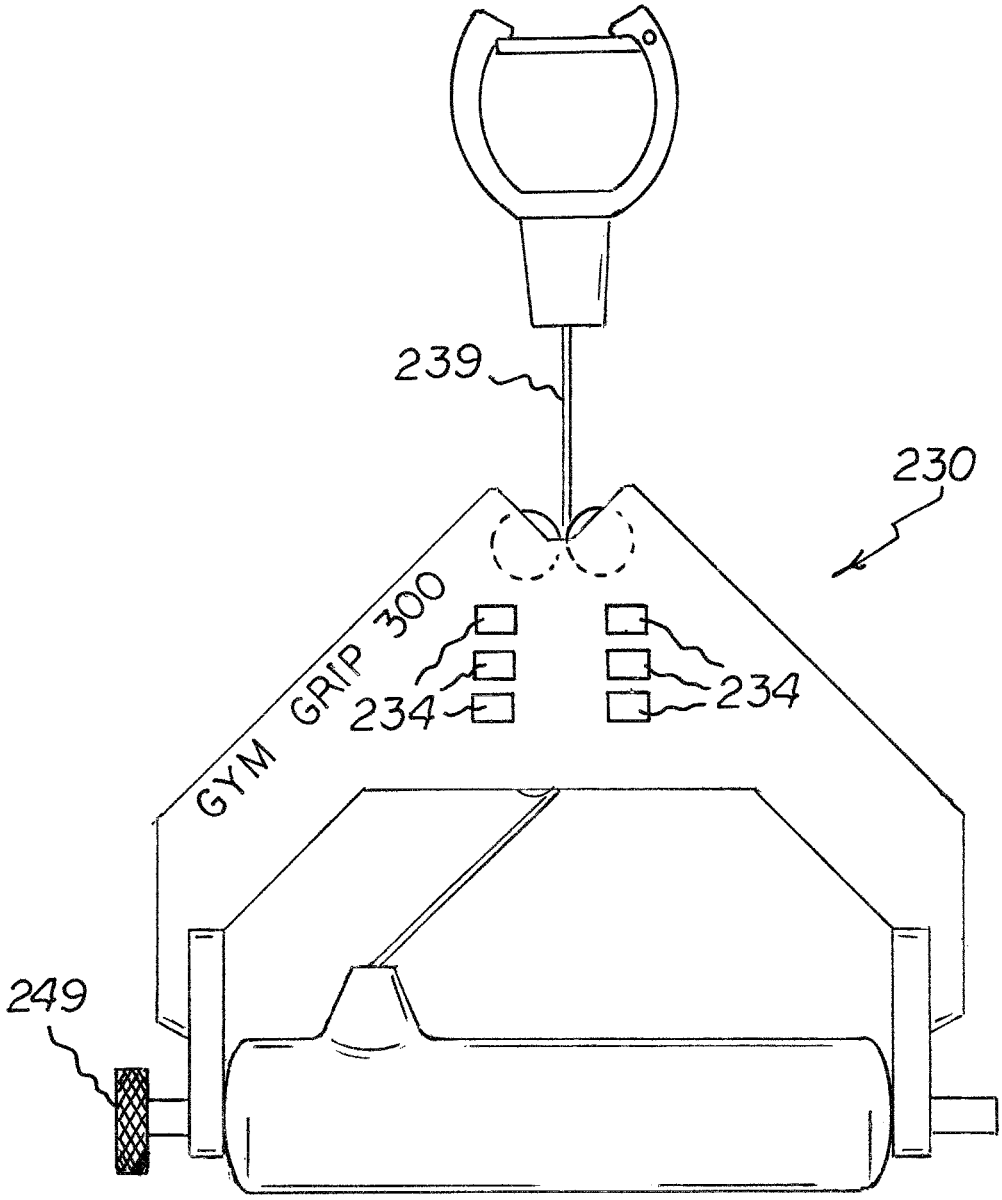
Figure 52:
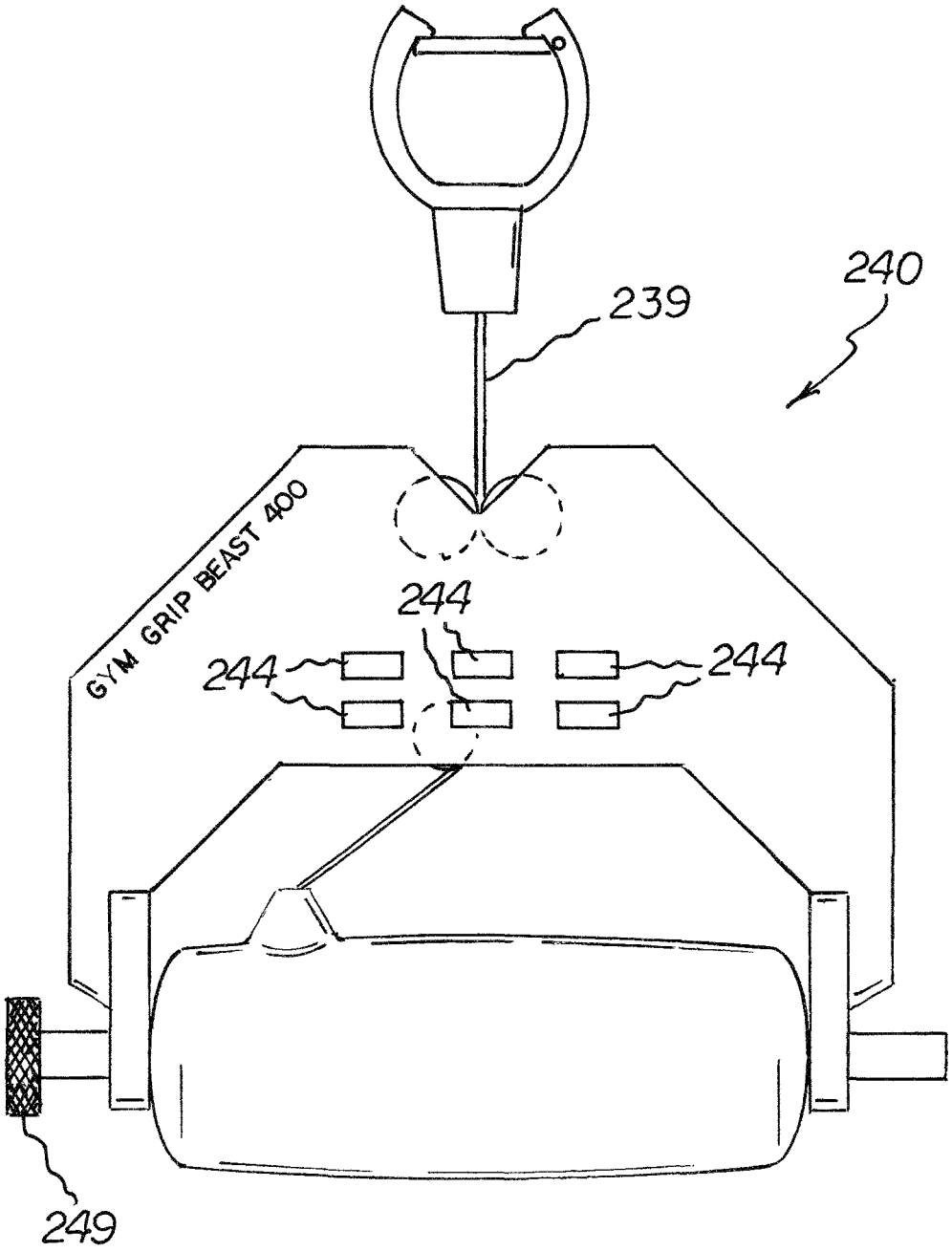
Figure 53:
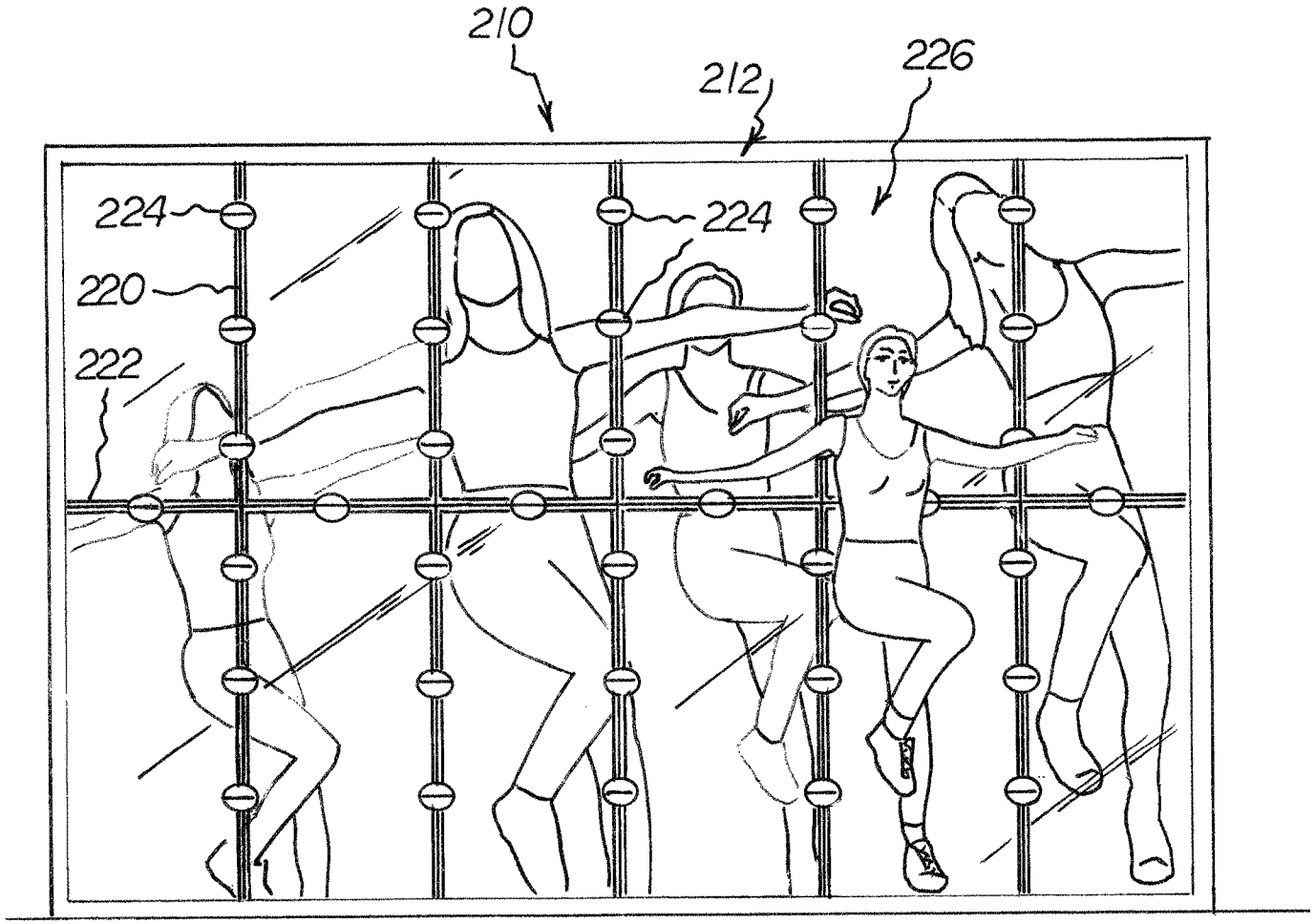
Figure 56:
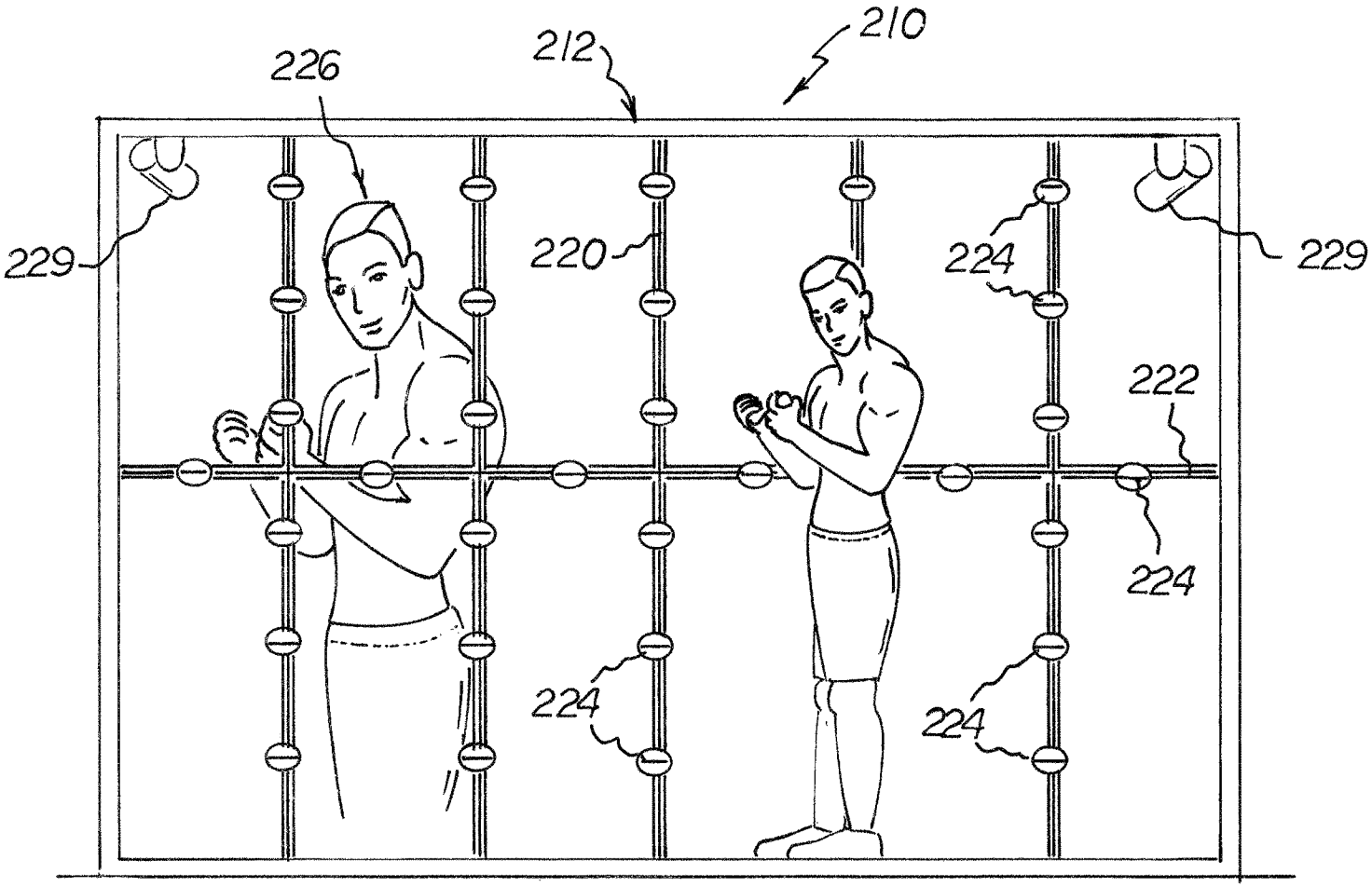
Figure 57:
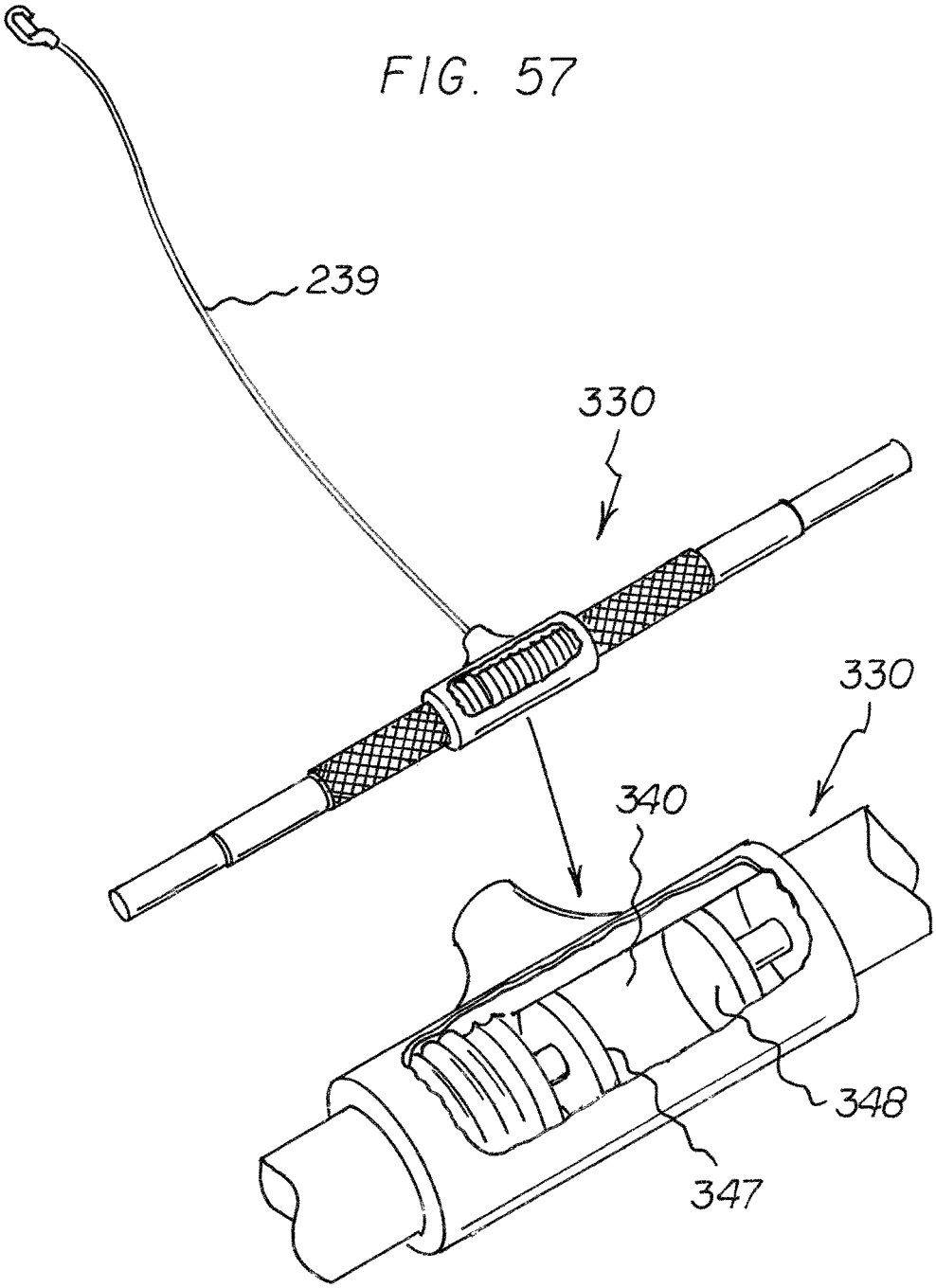
Figure 58:
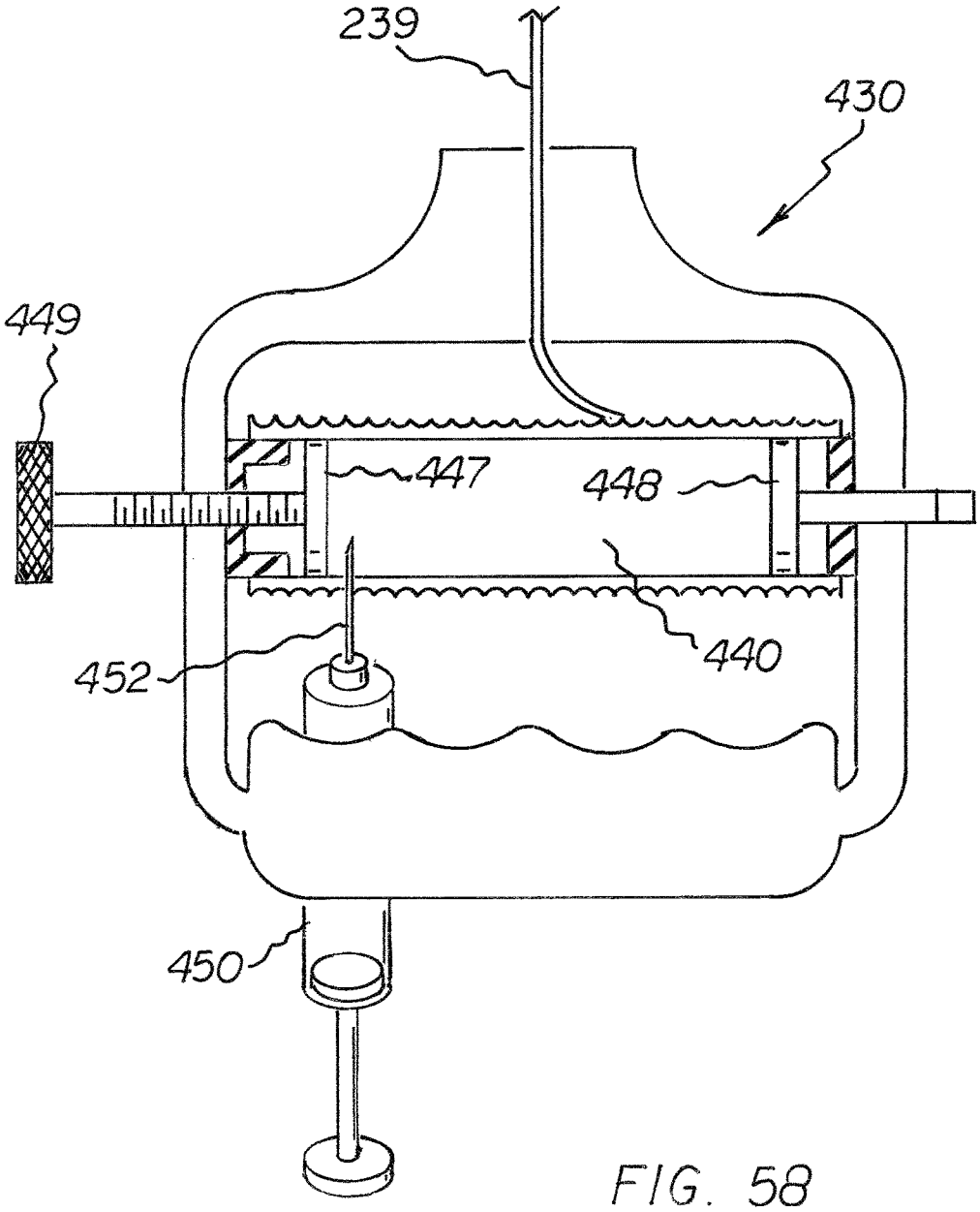
Figure 59:
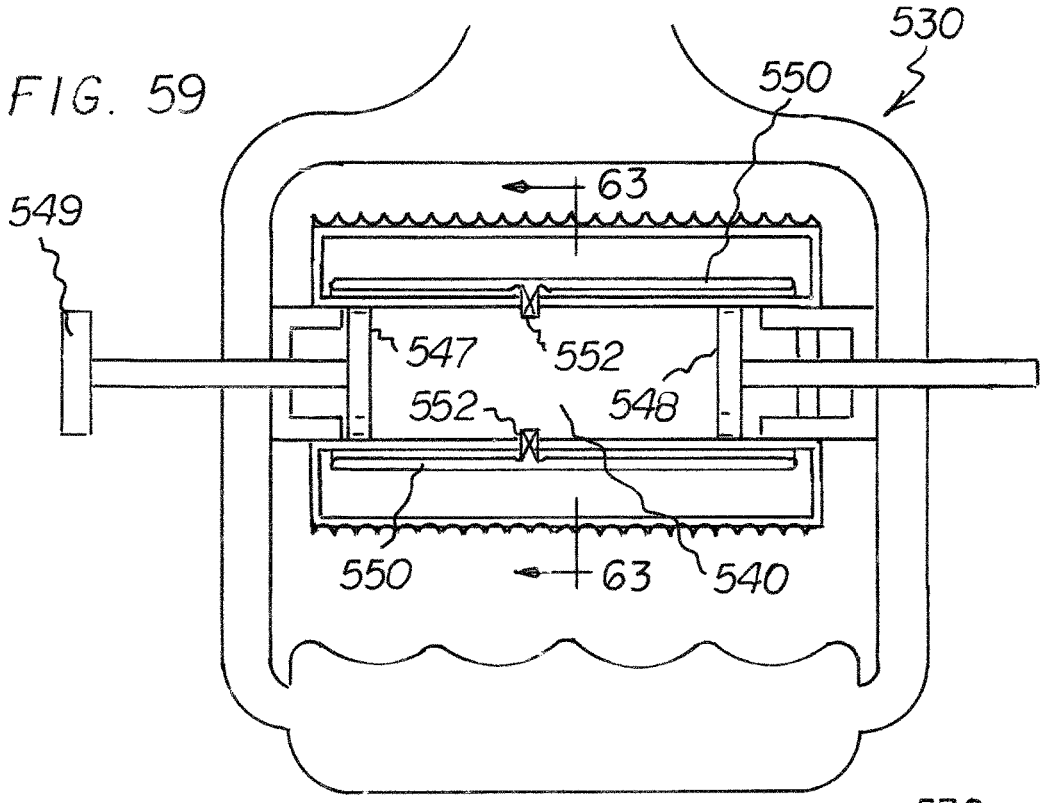
Figure 60:
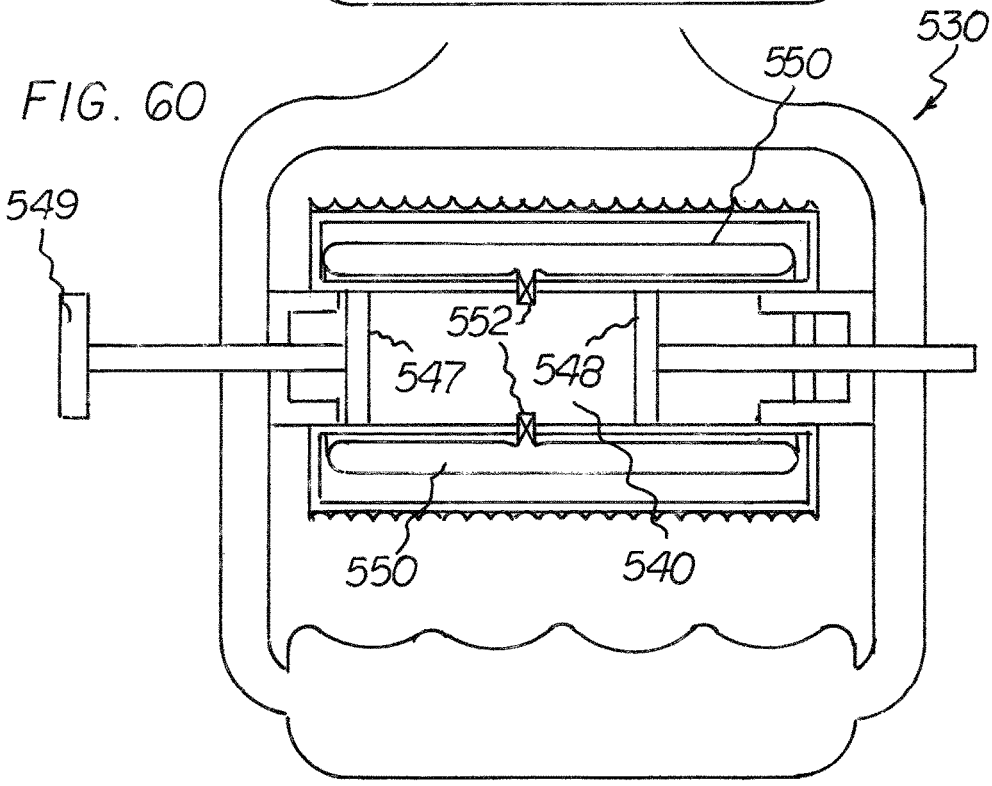
Figure 61:
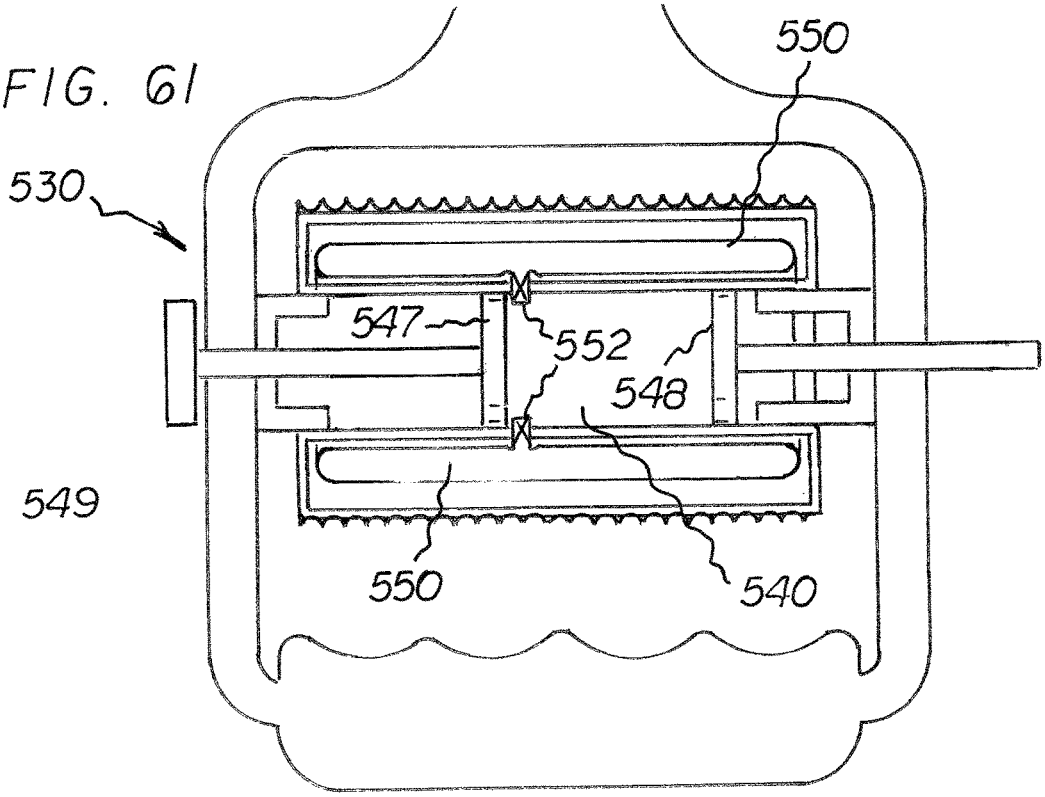
Figure 62:
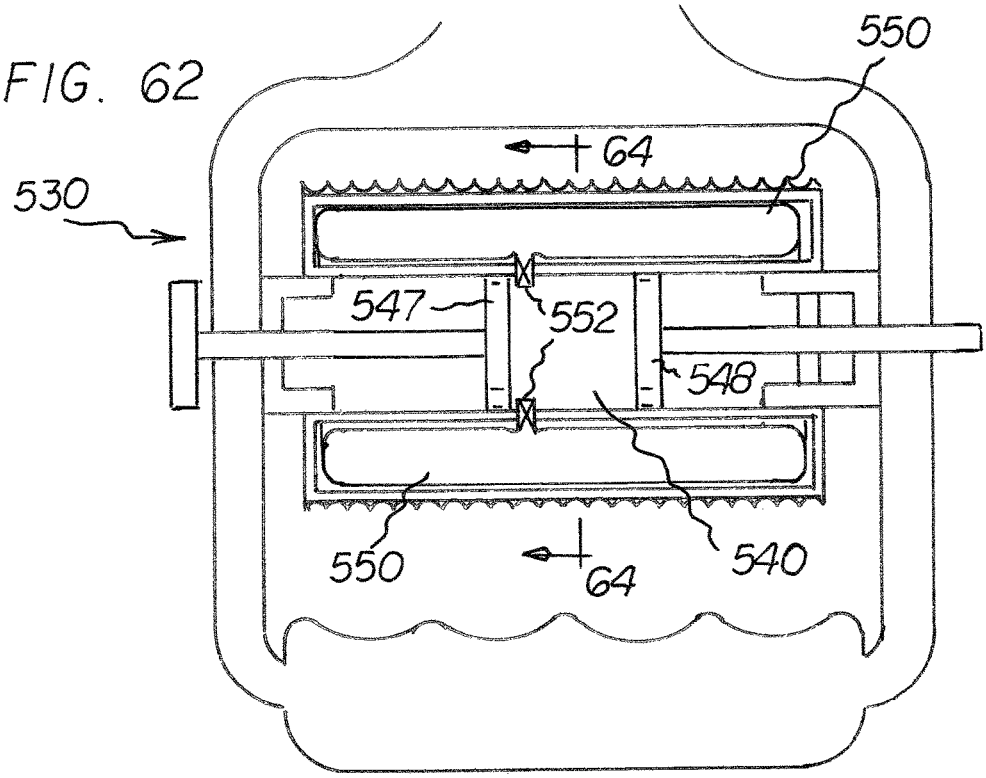
Figure 65:
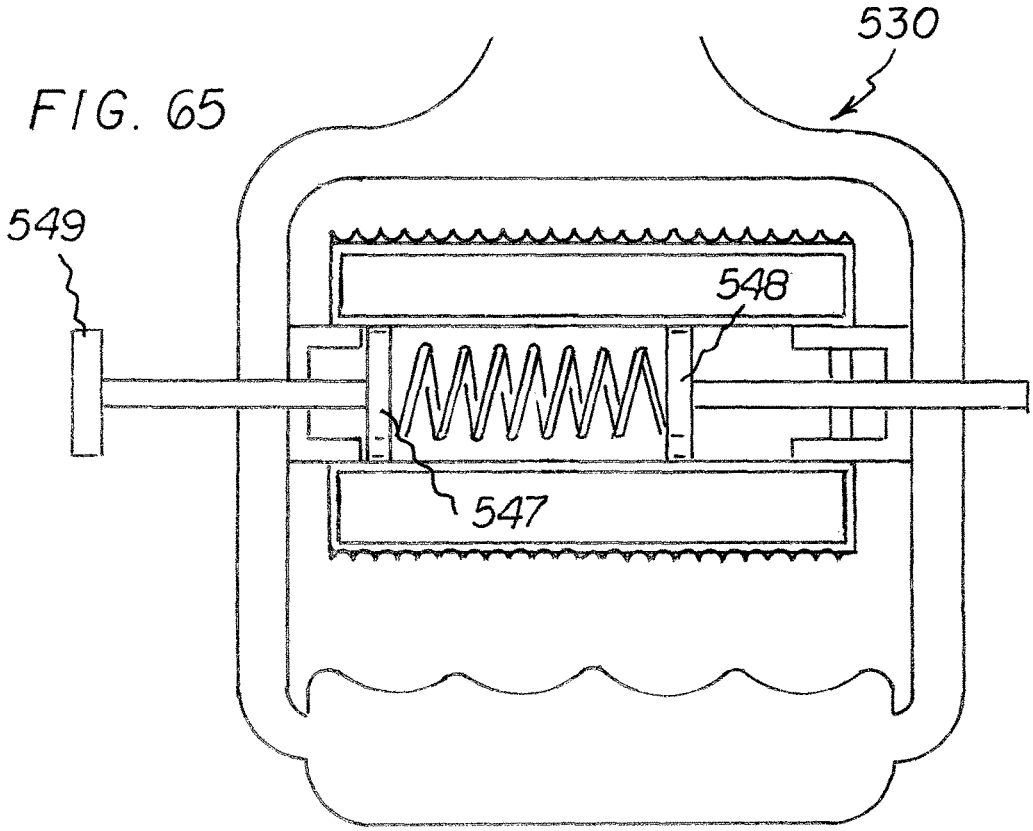
Figure 66:
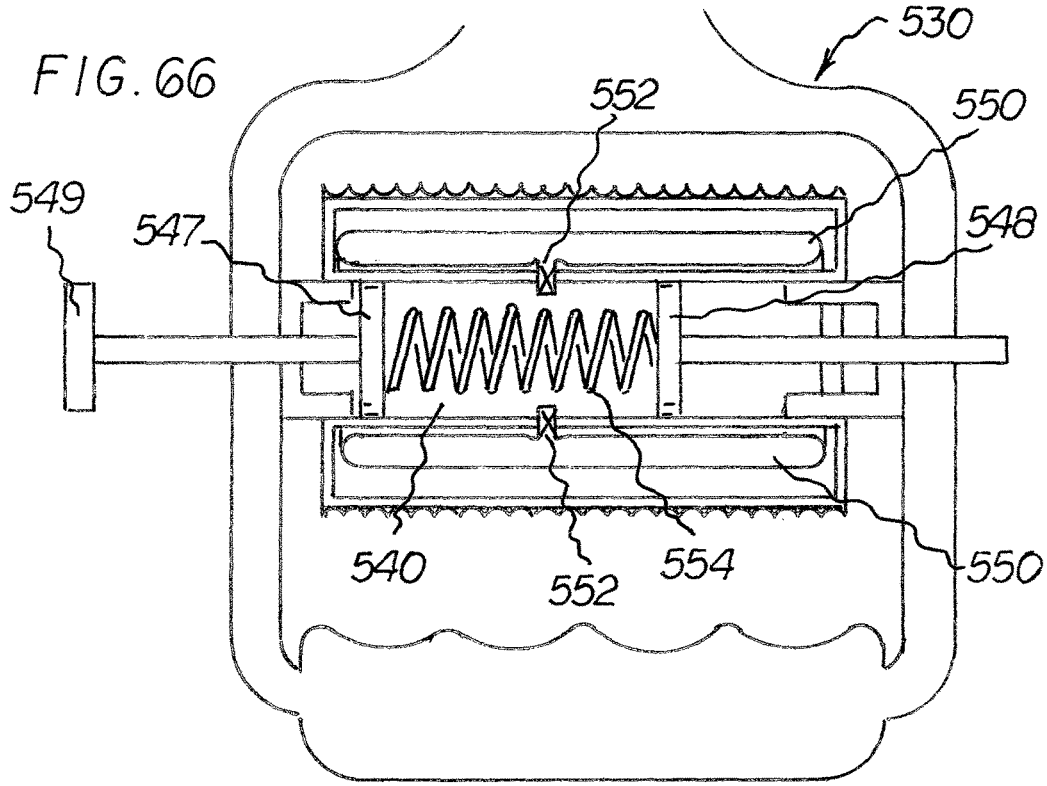
Figure 69:
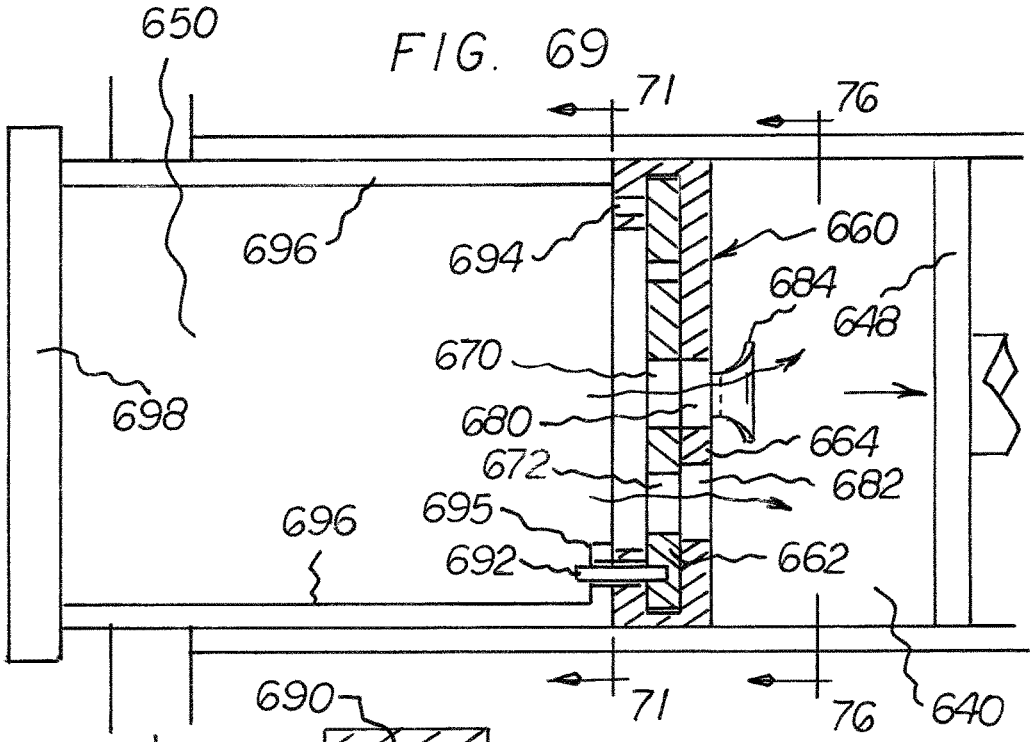
Figure 70:
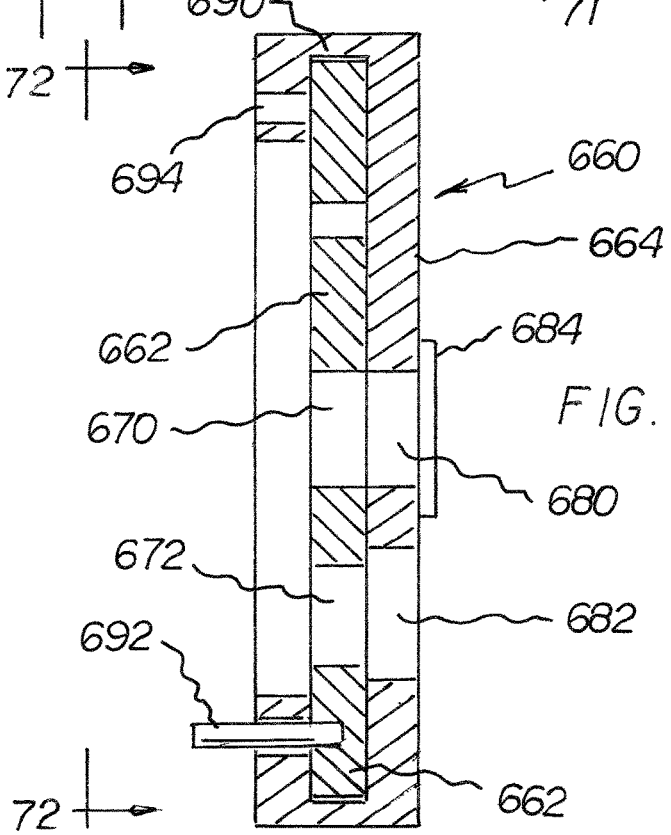
Figure 75:
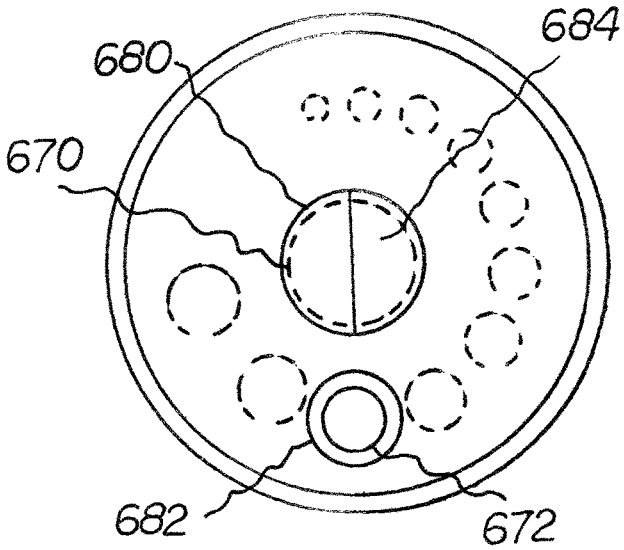
Figure 76:
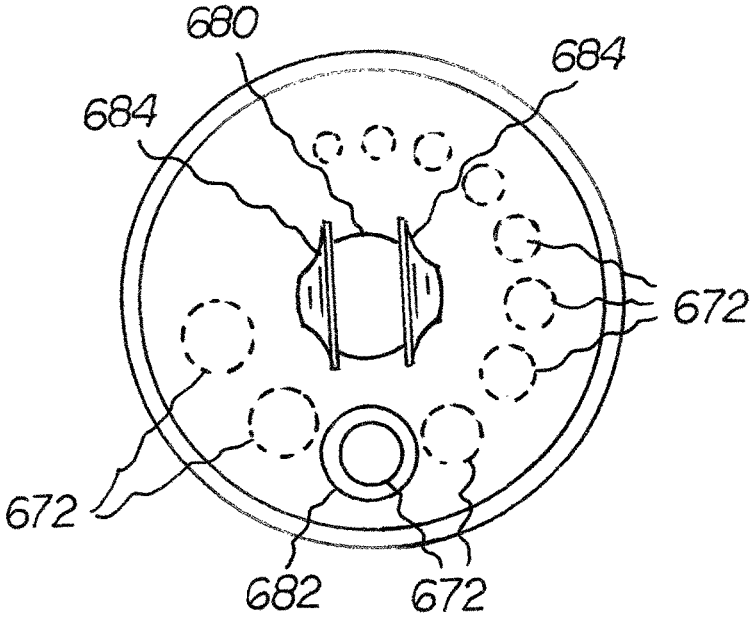
Figure 77:
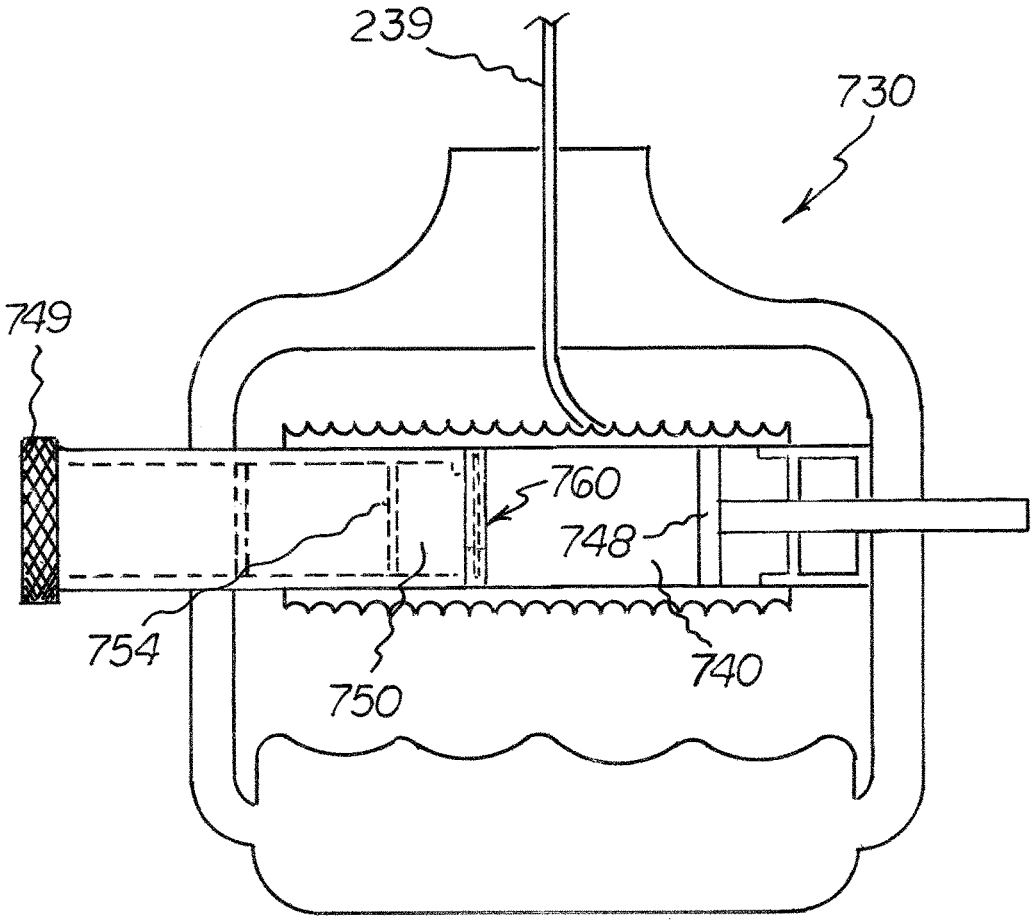
Figure 82:
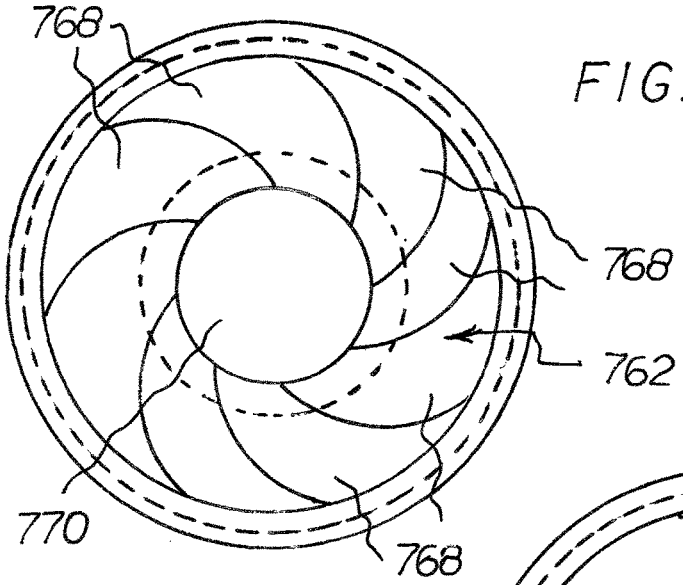
Figure 83:
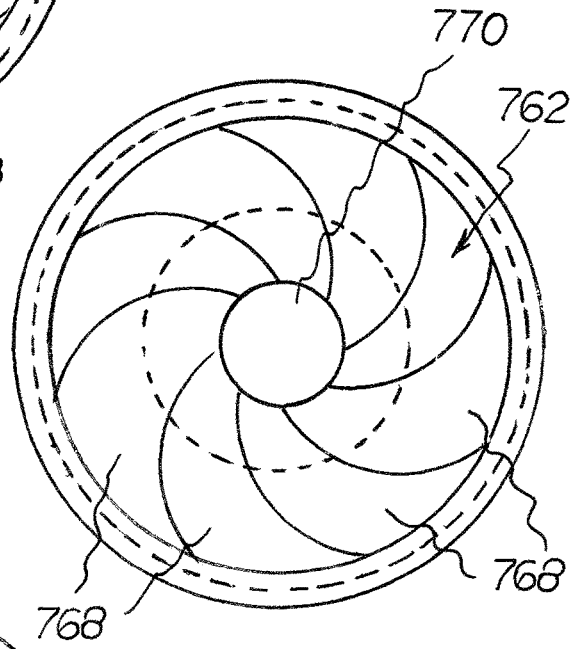
Figure 84:
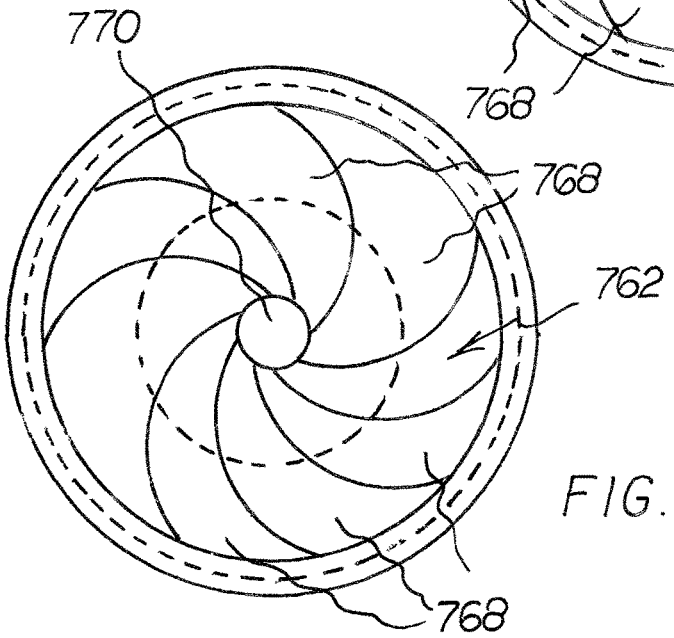

3 showing the coupler and inset attachment point of FIG. 3 and illustrating the quick connect coupler locked into the inset attachment point;

FIG. 5 is an isolated side elevational view, shown in partial cross section, showing the coupler quick release from the inset attachment point and illustrating one finger quick release of the coupler from the inset attachment point;

FIG. 6 is an isolated side elevational view showing an adjustable resistance handgrip connected to and extending from an inset attachment point of the gym cage structure and illustrating the cable of adjustable resistance handgrip extended in an operable position for performing an exercise;

FIG. 6A is a side elevational view, in partial cross section, showing the coupler stem firmly set into the handgrip cradle of the adjustable resistance handgrip enabling the user to connect to the inset attachment point using one hand;

FIG. 7 is a side elevational view showing an inline adjustable resistance device for use with the gym cage of the present invention;

FIG. 8 is an isolated front elevational view of a fixed hook attachment point on the gym cage of the present invention;

FIG. 9 is an isolated side elevational view of the fixed hook attachment point taken along the plane indicated as 9-9 in FIG. 8;

FIG. 10 is an isolated front elevational view of an adjustable hook attachment point on the gym cage illustrating the ability to reposition an attachment point up or down on a vertical bar of the gym cage;

FIG. 11 is an isolated side elevational view, shown in cross section, taken along the plane of the arrows indicated as 11-11 in FIG. 10 and illustrating release of a spring-loaded locking knob to allow up or down adjusted movement and repositioning of the adjustable hook attachment point;

FIG. 12 is an isolated elevational view of a dropdown ceiling in the gym cage illustrating a cord that is pulled to adjust the height of the dropdown ceiling relative to the sidewalls and top of the gym cage;

FIG. 13 is a bottom plan view of the dropdown ceiling taken along the plane indicated by the arrows 13-13 of FIG. 12;

FIG. 14 is an isolated side elevational view of the dropdown ceiling taken along the plane indicated by the arrows 14-14 in FIG. 12;

FIG. 15 is a cross sectional view of an interior locking mechanism of the dropdown ceiling taken along the plane indicated by the arrows 15-15 in FIG. 12;

FIG. 16 is a top plan view of a metal floor of the gym cage illustrating an arrangement of inset attachment points in the gym cage floor;

FIG. 17 is an isolated cutaway of the gym cage metal floor taken along the plane indicated by the arrows 17-17 in FIG. 16;

FIG. 18 is a front elevational view showing a chair with a first arm attachment device connected with the inline adjustable resistance devices and illustrating a range of movement of the arm attachment device for performing a shoulder exercise;

FIG. 19 is a side elevational view taken along the plane of the line indicated by the arrows 19-19 in FIG. 18 showing one of the arm members of the arm attachment device on the chair fitted with the inline adjustable resistance device of FIG. 7 for performing the shoulder exercise;

FIG. 20 is a front elevational view of the chair with the left and right arm members of the arm attachment device each fitted with the inline adjustable resistance devices shown connected to the inset attachment points on the floor of the gym cage;

FIG. 21 is a front elevational view showing the chair with a second arm attachment device thereon and wherein left and right arm members are each fitted with the inline adjustable resistance devices and illustrating a range of movement of the second arm attachment device in the performance of a shoulder exercise between a start position and end position;

FIG. 22 is a side elevational view of the chair and second arm attachment device of FIG. 21 illustrating movement of the second arm attachment device between the start and end positions in the performance of the shoulder exercise;

FIG. 23 is a rear elevational view of the chair and the second arm attachment device of FIG. 21 showing movement of the second arm attachment device while sliding upwardly in a groove within the back of the chair in the performance of the shoulder exercise between the start and end positions;

FIG. 24 is an isolated front elevational view showing a barbell supported within the rack hooks on the vertical bars of the gym cage;

FIG. 25 is a front elevational view showing a user exercising with the barbell wherein the inline adjustable resistance devices of FIG. 7 are connected near opposite ends of the barbell;

FIG. 26 is a front elevational view of a further embodiment of the gym cage of the present invention having solid walls, and illustrating a solid rear wall of the gym cage structure with inset attachment points on the rear wall and cameras to display exerciser images on a TV monitor mounted on the rear wall;

FIG. 27 is an isolated side elevational view, shown in cross section and taken along the plane of the line indicated by the arrows 27-27 in FIG. 26 showing front and rear cameras mounted within the gym cage and inset attachment points on a solid side wall of the gym cage, as well as the TV monitor mounted in the solid rear wall of the gym cage;

FIG. 28 is a side elevational view showing a user seated on the chair of the present invention and using two of the adjustable resistance handgrips connected to a center column adjustable positioning attachment point similar to the type shown in FIGS. 10 and 11 wherein the user is performing a chest and arm exercise;

FIG. 29 is an isolated top plan view taken along the plane indicated by the arrows 29-29 in FIG. 28;

FIG. 30 is a front elevational view showing the chair mounted to the floor of the gym cage with a leg attachment device fitted to the chair for use in performing various arm and leg exercises;

FIG. 31 is a side elevational view taken along the plane indicated by the arrows 31-31 in FIG. 30 and illustrating a range of adjusted movement and extension and retraction of the leg attachment device on the chair for performing various arm and leg exercises;

FIG. 32 is a side elevational view showing the leg attachment device fitted to the chair and a user performing a bicep exercise with the adjustable resistance handgrips attached to inset attachment points in the floor of the gym cage;

FIG. 33 is a front elevational view showing the user of the gym cage in FIG. 32 performing the bicep exercises with the adjustable resistance handgrips and leg attachment member fitted to the chair;

FIG. 34 is an isolated side elevational view showing the leg attachment device on the chair being used to perform a quad exercise wherein the inline adjustable resistance device is connected between an end of the leg attachment device and an inset attachment point on the floor of the gym cage;

FIG. 35 is a front elevational view showing the chair with the leg attachment device fitted thereto and the user performing the quad exercise as in FIG. 34, wherein two inline adjustable resistance devices are connected between the leg attachment device and inset attachment points in the floor of the gym cage;

FIG. 36 is an isolated side elevational view showing the chair and leg attachment device with a user performing a hamstring exercise, wherein the inline adjustable resistance devices are connected between an end of the leg attachment device an inset attachment point on a vertical frame member or wall of the gym cage;

FIG. 37 is an isolated top plan view taken along the plane indicated as 37-37 in FIG. 36 and showing the two inline adjustable resistance devices connected between the leg attachment device and attachment points on the vertical wall of the gym cage;

FIG. 38 is an isolated side elevational view of the chair and leg attachment device illustrating a user performing a calves exercise wherein two inline adjustable resistance devices are connected between the end of the leg attachment device and attachment points on the floor of the gym cage;

FIG. 39 is a front elevational view taken along the plane indicated by the arrows 39-39 in FIG. 38 showing the two inline adjustable resistance devices connecting between the leg attachment device and the attachment point in the floor of the gym cage;

FIG. 40 is an isolated side elevational view showing a range of adjusted movement and adjusted positions of the seatback of the chair between a vertical position, an inclined angle position and a horizontal bench position;

FIG. 41 is an isolated rear elevational view of the seatback on the chair taken along the plane indicated by the arrows 41-41 in FIG. 40;

FIG. 42 is a front elevational view of another embodiment of the gym cage of the present invention, wherein the front wall includes a metal frame with an inset or window formed of a transparent material and the right side revealing the entrance to the gym cage (it should be noted that the image seen through the transparent front window is not shown in this figure for purposes of illustration and to avoid confusion);

FIG. 43 is an interior view of the inside back wall of the gym cage showing a video wall depicting the image of a woman performing an exercise routine, wherein the video wall is positioned behind the reel frame structure of the gym cage and the arrangement of attachment points;

FIG. 44 shows an isolated view of the menu presented on the video wall in FIG. 43, allowing a user to view cumulative sets and repetitions of various exercises performed by the user in the gym cage;

FIG. 45 illustrates another embodiment of the attachment point on the frame structure and the attachment points are able to slide up and down the vertical bars and from left to right on the horizontal bars for adjusted positioning of the attachment points as desired by the user, and wherein the adjustable attachment points can be moved as desired while not in use in order to avoid obstructing the video wall;

FIG. 46 is an isolated elevational view, in cut-away, taken from the area indicated as 46 in FIG. 45, illustrating an adjustable positioning attachment point that can slide on the vertical or horizontal balls of the gym cage structure;

FIG. 47 is a cross-sectional view, taken along the plane indicated by the arrows 47-47 in FIG. 46;

FIG. 48 is an isolated side view of the gym cage showing the rear video wall in relation to the rear wall frame structure of the gym cage;

FIG. 49 is a front elevational view, taken along the plane of the line indicated by the arrows 49-49 in FIG. 48 illustrating a segmented transparent wall that is mounted behind the rear frame wall structure of the gym cage and in front of the video wall for purposes of protecting the video wall in the event the user inadvertently releases exercise equipment that may strike the video wall;

FIG. 50 is an elevational view of the rear wall of the gym cage, as seen from within the gym cage, illustrating a woman user exercising within the gym cage and in front of the video wall;

FIG. 51 is a top plan view illustrating a gym grip device of the present invention;

FIG. 52 is a top plan view illustrating another embodiment of the gym grip device of the present invention having a higher weight capacity;

FIG. 53 is an elevational view of the rear wall, as seen from within the gym cage, illustrating a woman user of the gym cage performing an aerobics dance exercise in front of the video wall which depicts several women performing the same aerobics dance exercise routine;

FIG. 54 is a top plan view showing a floor mat structure and an arrangement of attachment points on the floor of the gym cage;

FIG. 55 is an isolated perspective view showing the multiple floor mats that are placed on the floor of the gym cage;

FIG. 56 is an elevational view of the rear wall of the gym cage, as seen from within the gym cage, showing a male user of the gym cage performing an exercise routine in front of video cameras mounted within the gym cage that are recording the user's exercise activity and displaying live images of the exercise routine on the rear video wall;

FIG. 57 is a perspective view showing an adjustably resistance air chamber within a bar grip device of the present invention;

FIG. 58 is a top plan view illustrating one embodiment of a gym grip device of the present invention and showing a small rubber sealed hole in communication with a sealed air chamber within the gym grip device and a needle and syringe device used for pumping air into the interior sealed compression chamber of the device;

FIGS. 59-62 show an isolated cross sectional view of another embodiment of a gym grip device of the present invention that incorporates an air bladder within an air expansion chamber, wherein a sequence of operation is illustrated to show inflation of the air bladder from a deflated position in FIG. 59, to a fully inflated condition in FIG. 62 as an exercise operation is performed by the user using the gym grip device;

FIG. 63 is a cross sectional view taken along the plane of the line indicated as 63-63 in FIG. 59 showing the air bladder in the deflated condition;

FIG. 64 is a cross sectional view taken along the plane of the line 64-64 in FIG. 62 showing the air bladder in the fully inflated condition;

FIGS. 65-66 illustrate an isolated cross sectional view of yet a further embodiment of the gym grip device of FIGS. 59-62, wherein a spring is added to the air compression chamber between the piston heads for assisting urging the exercise stroke piston fully back to the original starting position after completion of the exercise stroke by the user;

FIG. 67 is an isolated elevational view of a further embodiment of the air expansion chamber, wherein an adjustment knob and rotating aperture ring linked to the adjustment knob are illustrated in broken lines;

FIG. 68 is an isolated cross sectional view illustrating another embodiment of the air expansion chamber of the gym grip device of the present invention including an adjustment feature for adjusting the rate of airflow into the air expansion chamber, and thus the resistance of the exercise stroke for a continuous resistance operation of the gym grip device;

FIG. 69 is an isolated cross sectional view of the embodiment of FIG. 68 showing the pressurized air in the air expansion chamber being released back into the air compression chamber after completion of the exercise stroke;

FIG. 70 is an isolated cross sectional view of the adjusting aperture ring taken from the embodiment of FIGS. 68-69;

FIG. 71 is an isolated end view of the adjusting knob and connecting pin taken along the plane of the line indicated by the arrows 71-71 in FIG. 69;

FIG. 72 is an end elevational view of the adjustable size aperture ring and connecting pin and cylinder taken along the plane of the line indicated by the arrows 72-72 in FIG. 70;

FIG. 73 is the same end elevational view of FIG. 72 showing the adjustable size aperture ring rotated to align a smaller size aperture and further illustrating a release door open for releasing the pressurized air from the air expansion chamber back into the air compression chamber at the end of the exercise stroke;

FIG. 74 is a cross sectional end elevational view taken along the plane of the line 74-74 in FIG. 68;

FIG. 75 is a cross sectional end elevational view similar to FIG. 74 showing the adjustment aperture disk rotated to align a smaller adjustment aperture with the fixed airflow aperture to allow for a third step reduction in airflow which is equivalent to increased exercise resistance;

FIG. 76 is a cross sectional end elevational view similar to FIG. 74 showing the airflow door on the airflow disk in an open position to allow escape of air from the air exchange chamber;

FIG. 77 shows an isolated cross sectional view of another embodiment of a gym grip device of the present invention that incorporates a resistance adjusting diaphragm between an air compression chamber and an air expansion chamber, and wherein the size of the aperture of the diaphragm is adjustably controlled to thereby control resistance of the piston force during a compression stroke using the gym grip device to perform an exercise;

FIG. 78 is an isolated cross sectional view of the resistance adjusting diaphragm shown in relation to the piston moving towards the diaphragm in a compression stroke wherein air is forced into an air expansion chamber and against a rubber wall causing the rubber wall to expand outwardly;

FIG. 79 is an isolated cross sectional view of the resistance adjusting diaphragm shown in relation to the piston moving away from the compression stroke wherein the rubber wall returns to a relaxed position as air within the air expansion chamber is returned back into the enlarging air compression chamber as the resistance adjusting diaphragm is able to flex to thereby enlarge the aperture and reduce resistance of airflow back into the air compression chamber;

FIG. 80 is an isolated cross sectional view showing the resistance adjusting diaphragm in relation to a diaphragm collar and a diaphragm support wall, and further illustrating an adjusting lever within an adjusting track for adjusting the size of the aperture of the resistance adjusting diaphragm;

FIG. 81 is an elevational view taken along the plane of the line indicated by the arrows 81-81 in FIG. 80, showing the resistance adjusting diaphragm and diaphragm support wall, and further showing an adjusting lever controlled by an adjusting lever controller for moving the adjusting lever within an adjusting track to vary the size of the aperture of the resistance adjusting diaphragm;

FIGS. 82-84 show an elevational view taken along the plane of the line indicated by the arrows 82-82 in FIG. 80, and illustrating various adjusted aperture sizes of the resistance adjusting diaphragm achieved by rotation of an adjusting knob to control movement of the adjusting lever controller and the adjusting lever within the adjusting track;

FIG. 85 is an isolated view showing a rotatable adjusting knob on an exterior of the piston cylinder for adjusting the size of the aperture of the resistance adjusting diaphragm; and FIG. 86 is a cross sectional view taken along the plane of the line indicated by the arrows 86-86 in FIG. 85.

Like reference numerals refer to like parts throughout the several views of the drawings.

DETAILED DESCRIPTION OF THE PREFERRED EMBODIMENTS

The gym cage of the present invention is shown and generally indicated as 10 throughout the drawings. The gym cage 10 includes at least one vertical wall structure and, in a preferred embodiment, includes a rear wall structure 12 and opposite side wall structures 14, 16 (i.e., left and right walls) extending upwardly from a floor 18 to a top 19 of the cage 10.

Figure 1:
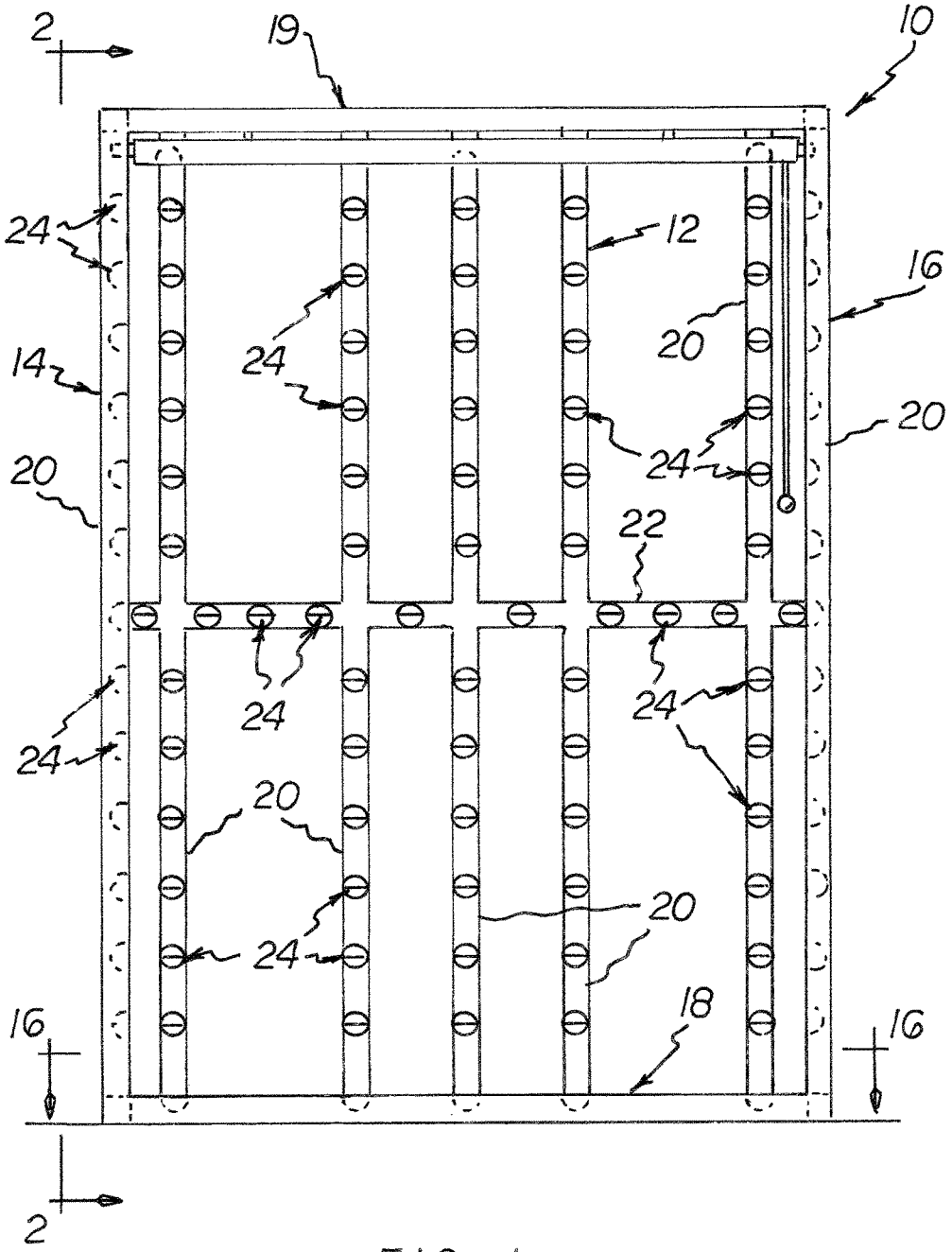
FIG. 1 is a front elevational view of the gym cage of the present invention illustrating a rear wall having an arrangement of vertical, spaced frame members and a horizontal frame member with inset attachment points on the frame members or bars of the cage.
Figure 2:
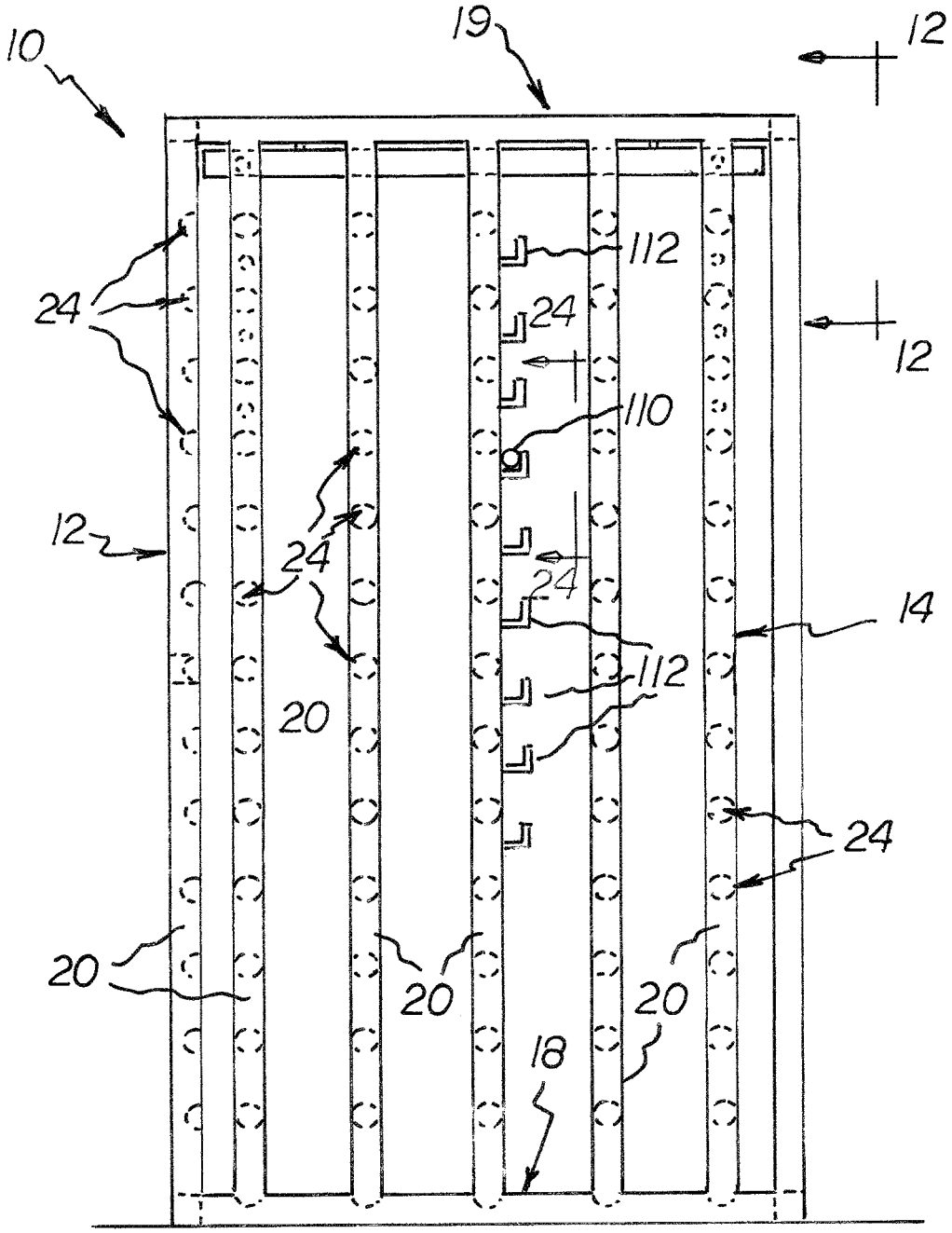
FIG. 2 is a side elevational view taken along the plane of the line indicated by the arrows 2-2 in FIG. 1 showing the inset attachment points on vertical bars forming side walls of the gym cage, along with rack hooks on at least one of the vertical bars for supporting a barbell.

As seen in FIGS. 1 and 2, the vertical side wall structures 14, 16 and rear wall structure 12 of the gym cage 10 may be formed by an arrangement of parallel vertically extending bars or frame members 20 that are spaced apart to allow visibility through the entire gym cage. The rear wall structure 12 and side wall structures 14, 16 may further include at least one horizontal bar or frame member 22, as seen in FIG. 1. The top 19 of the cage 10 may be formed by a similar arrangement of spaced and parallel bars or frame members or, alternatively, the top 19 may be a solid structure, similar to the floor 18 of the cage 10 which is shown in FIG. 16. The rear wall structure 12, opposite side wall structures 14, 16, top 19 and floor 18 provide for an arrangement of attachment points 24 for selective, interchangeable and removable attachment of resistance devices, such as the adjustable resistance handgrip device 30 shown in FIGS. 6 and 6A, as well as the inline adjustable resistance device 40 shown in FIG. 7. Attachment of these adjustable resistance devices to the various attachment points 24 on the vertical wall structures, top and floor of the gym cage 10 allow for virtually 360 degrees of attachment points to perform a wide variety of exercises for exercising, developing, toning and building different muscle groups and subgroups of the human body. The several embodiments of the adjustable resistance devices of the present invention, as illustrated in the drawings and described hereinafter, are based on improvements to my previous invention, as disclosed in U.S. Pat. No. 8,905,904, the contents of which is fully incorporated herein by reference. The gym cage 10 may further include an adjustable height ceiling 50, as shown in FIGS. 1, 2 and 12-15 to allow users of different heights to easily reach the attachment points 24 on the adjustable height ceiling 50 in order to attach the various adjustable resistance exercise devices (e.g., 30 and 40).

The attachment points 24 on the vertical wall structures (i.e., the back wall and opposite side walls) as well as the ceiling/top and floor of the gym cage 10 may be either fixed or adjustable in position. Moreover, the attachment points 24 may be recessed or inset, as seen in FIGS. 3-6 or exposed on a surface of the wall structures 12, 14 and 16, ceiling/top 19 and floor 18 of the cage 10, in the form of hook attachment points 70, as seen in FIGS. 8 and 9. Moreover, the attachment points may be adjustably positionable, such as adjustably positionable hook attachment points 80 shown in FIGS. 10 and 11.

Figure 4:
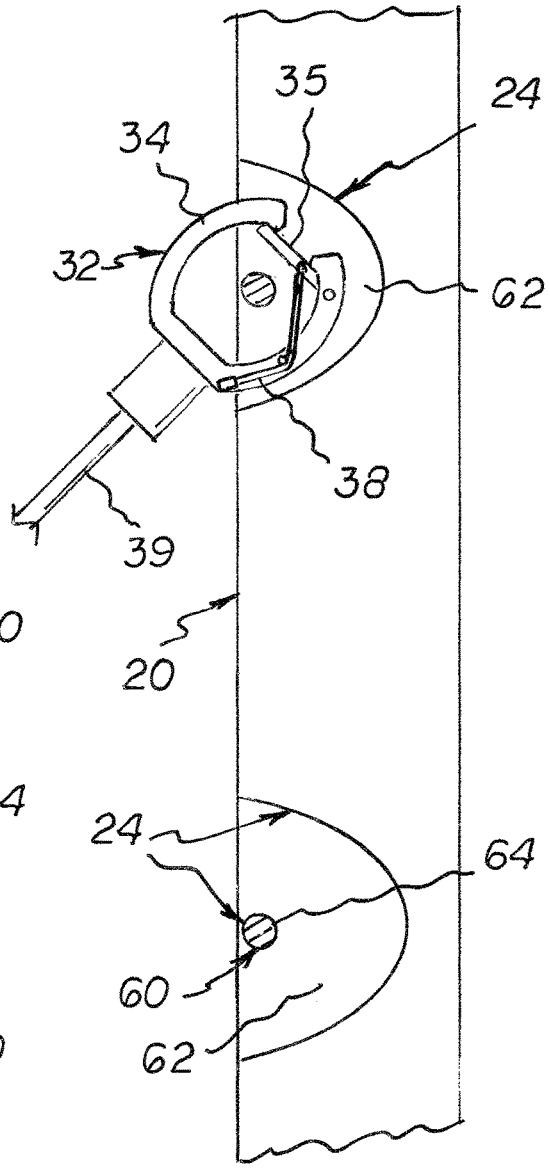
FIG. 4 is an isolated side elevational view in partial cross section taken along the plane indicated by arrows 4-4 in FIG.

The inset attachment points 60 generally consist of a pocket area 62 within the walls or frame members 20, 22 of the gym cage 10, such as within the frame members 20, 22 of the rear wall structure 12 and opposite side wall structures 14, 16, as well as within the ceiling/top 19 of the gym cage 10 and the floor 18 of the gym cage. The inset attachment points 60 further include a transverse attachment bar 64 that extends within the pocket 62, connecting to the frame member or other structure on opposite sides of the pocket 62 so that the transverse attachment bar 64 is inset from the surface of the walls, ceiling and floor of the gym cage. As seen in FIGS. 3-6A the inset attachment points 60 are particularly suited for attachment of a quick connect coupler 32 on the adjustable resistance handgrip device 30. In particular, the quick connect coupler 32 includes a generally C-shaped claw 34 fitted to a coupler stem 36 that is attached to a cable 39 extending from the spool 31 of the adjustable resistance handgrip device 30. The open mouth of the generally C-shaped claw 34 of the quick connect coupler is normally closed by a spring loaded latch 35, as seen in FIG. 4. The quick connect coupler 32 is easily attached to the attachment point 24 (either the inset attachment point 60 or the hook attachment point 70 or adjustable hook attachment point 80) by jamming the quick connect coupler 32 into the bar of the inset attachment point or hook and causing the bar of the attachment point 24 to move the spring loaded latch 35 open, until the bar passes within the enclosure of the claw 34 and clears the latch 35, whereupon the spring loaded latch 35 is urged back to the closed position, as seen in FIG. 4. To remove the quick connect coupler 32 from the attachment point, a one finger quick release mechanism 38 is operated to urge the latch 35 open so that the bar (i.e., inset or hook) of the attachment point 24 can be moved out through the open mouth of the claw 34 of the quick connect coupler, as illustrated in FIG. 5. Easy one handed attachment of the quick connect coupler 32 to the attachment point 24 is achieved by the structure of the quick connect coupler 32 and frame 33 of the handgrip device 30. Specifically, referring to FIG. 6A, the frame 33 of the handgrip device includes a cradle 37 that is specifically sized and configured for congruent receipt of the coupler stem 36 therein, holding the quick connect coupler 32 secure relative to the handgrip resistance device frame and grip handle, so that the user, with one hand grasping the handle 33*a* of the handgrip device, can jam the quick connect coupler 32 against the attachment point 24, with the bar of the attachment point 24 urging the spring loaded latch 35 open until the bar of the attachment point is secure within the grasp of the claw 34 of the quick connect coupler 32, as shown in FIG. 4.

Referring to FIG. 7, the inline adjustable resistance device 40 includes two separate attachment hooks 42, 44 for attachment to an item of equipment, such as a barbell 110, arm attachment device 120, 130 or leg attachment device 140, as well as one of the many attachment points 24 on the gym cage. One of the hooks 42 of the inline adjustable resistance device 40 is fitted to the end of a fixed cable 43, while the other hook 44 is fitted to a cable 45 that extends from the resistance spool 31 of the device.

The operation of the adjustable resistance handgrip device 30 and the inline adjustable resistance device 40 is consistent with the disclosure in U.S. Pat. No. 8,905,904. In general, the adjustable resistance is achieved by opposing piston heads 47, 48, as seen in FIG. 7, wherein resistance is created by either compression of air between the piston heads, a spring between the piston heads or a magnetic force created by opposing force magnets on each of the piston heads. Adjusting the distance between the piston heads 47, 48, by screw rotation of either or both pistons, with the use of an adjustment knob 49, allows for adjusting the resistance of force to rotate the spool 31. This in turn translates to a force of resistance of pulling the cable from the spool, as described in more detail in U.S. Pat. No. 8,905,904. In the instance magnets are used, an electromagnet may be positioned on the left side of the chamber within the spool and a standard magnet may be placed on the head of the piston on the right side of the chamber. The magnets create a repulsive field between them, and the strength of the repulsive field can be controlled by the electrical current flowing to the electromagnet, thereby controlling the force of resistance of pulling the cable from the spool.

Referring to FIGS. 10 and 11, the adjustable positionable hook attachment points 80 include a hook 82 fitted to a central hub 83 that is fastened to a guide block 84 by a bolt 85 that passes through a vertical slot 25 in a frame member 20 of the gym cage 10. The guide block 84 is specifically sized and configured for sliding movement within a hollow interior channel 23 of the frame member 20 of the gym cage. The adjustable positionable hook attachment point 80 further includes a locking pin 86 arrangement including a second bolt 87 that extends through the vertical slot 25 of the frame member and into the guide block. The portion of the bolt 87 extending exteriorly of the frame member, including the bolt head, is surrounded by a movable knob 88. A spring 89 is fitted between the bolt head and the inner end of the knob 88 so that the knob can be pulled outwardly against the force of the spring 89 away from the frame member 20. A collar 88*a* of the knob 88 is specifically sized and configured for selective receipt within any one of an arrangement of vertically spaced holes 27 formed along the open slot 25 of the frame member 20. To adjust the hook attachment point 80 up or down, the knob 88 is pulled outwardly against the force of the spring 89 and released from the hole 88 in the frame member 20 allowing the hook 82, guide block 84 and bolts 85, 87 to slide up or down until the knob 88 is aligned with one of the spaced holes 27 along the open slot 25 at the desired height or position of the hook attachment point. When reaching the desired position, the knob 88 is released and the knob collar 88*a* is allowed to snap into place within the aligned hole 27 on the open slot 25 of the frame member 20 thereby securing the hook attachment point 80 at the desired adjusted position.

Referring to FIGS. 12-15, an adjustable height dropdown ceiling 50 is shown. The dropdown ceiling 50 is provided with an arrangement of attachment points 24, either or both the inset attachment points 60 and/or hook attachment points 70, and is able to be adjusted in height relative to the floor 18, top 19 and vertical wall structure of the gym cage 10. The dropdown ceiling 50 secured in place by opposing locking pin members 52 on opposite ends of the dropdown ceiling which are received within any select set of a spaced arrangement of locking apertures or holes 54 on the same horizontal plane in the wall structure of the gym cage, as seen in FIG. 12. To adjust the height of the dropdown ceiling 50, the user pulls a cord 55 to operate a pulley and spring mechanism 57 (see FIG. 15) that urges the locking pins 52 inwardly towards the interior of the dropdown ceiling, and out of the locking holes 54 in the wall frame members 20 of the gym cage so that the dropdown ceiling 50 is free to move up or down while the cord 55 remains pulled and the locking pins 52 remain in the retracted position. To assist with raising or lowering the dropdown ceiling, a vertical bar 56 extends down from the dropdown ceiling 50 and can be grasped by the user. This vertical bar 56 assists users of different heights who may not otherwise be able to reach the ceiling 50 and is otherwise necessary to pull the ceiling 50 down to an adjusted lowered position. When the dropdown ceiling 50 is at the desired height, the cord 55 is released, causing the locking pins 52 to extend out from the sides of the ceiling 50 and into the aligned locking holes 54 in the frame structures 20 of the gym cage. The weight of the dropdown ceiling 50 is supported by a spring roller 58 or coil and cable 59, as seen in FIG. 14. Specifically, a spring loaded coil, pulley or roller 58 is mounted within the top of the gym cage frame structure and a cable 59 extends down and connects to the dropdown ceiling 50. This allows the user to raise or lower the dropdown ceiling 50 with minimal effort, while preventing the ceiling from falling down onto the user. A minimum amount of force is necessary to pull the ceiling 50 down, by grasping the vertical bar 56. Without pulling down on the bar 56, the ceiling 50 will remain either stationary or begin to rise upwardly as the spring loaded coil/pulley mechanism 58 supports the weight of the ceiling 50 and may in fact lift the ceiling 50 back to the fully raised position when the locking pins 52 are disengaged.

FIG. 15 illustrates the general schematic of an arrangement of the pulley and spring locking pin release mechanism 57 wherein the cord 55 extends about an arrangement of pulleys and connects to the arm members of the two locking pin structures which are urged against springs when pulling down on the cord, thereby allowing the locking pins 52 to retract into the ceiling. Upon release of the cord 55, the springs urge the locking pins 52 outwardly so that they can be received within the selected horizontally aligned set of locking holes on the gym cage frame members 20.

Referring to FIGS. 24 and 25, a barbell 110 is attached to two inline adjustable resistance devices 40 that are secured to attachment points 24 in the floor of the gym cage, allowing the user to perform overhead presses or other exercise movements with the barbell 110 against the force of resistance of the inline adjustable resistance devices 40. During periods of rest, between sets of overhead presses or other exercise movements, the user can place the barbell 110 into any of the rack hooks 112 on oppositely positioned frame members 20 of the gym cage 10, as shown in FIG. 25, while the barbell 110 still remains under tension exerted by the cables of the inline adjustable resistance devices 40.

FIGS. 26 and 27 illustrate an alternative embodiment of the gym cage 10A wherein the rear wall 12A, opposite side walls 14A, 16A and ceiling 19A are solid so that others cannot see into the sides or rear of the gym cage. The front may remain open to allow for ventilation and ease of access in and out of the gym cage 10A. Similar to the embodiment described above, the vertical walls, ceiling and floor 18A are provided with attachment points 24 for attaching the adjustable resistance devices. Additionally, cameras 160 may be provided at the four top corners of the gym cage 10A, to capture views of the exercises from various angles. Moreover, a TV monitor 162 is mounted to the rear wall 12A, allowing the user to view themselves while performing various muscle building exercises, so that they can verify that their posture and technique is proper.

FIGS. 18-23 and 28-40 show a chair 150 in accordance with the present invention for performing various arm, shoulder and leg exercises. The chair 150 removably mounts to the floor 18 of the gym cage and includes a seat base 152 and adjustably positionable seatback 154. In several embodiments, as seen in FIGS. 18-23 and 30-39, various arm attachment devices and leg attachment devices are provided for performing a variety of arm, shoulder and leg exercises. Specifically, a first arm attachment member 120, as seen in FIGS. 18-20, is attachable to the seatback for performing shoulder exercises, wherein left and right arm members 122, 124 of the arm attachment device 120 are each connected to inline adjustable resistance devices 40 that connect to attachment points 24 on the floor 18 of the gym cage 10, permitting the user to perform a shoulder exercise movement, as demonstrated in FIG. 18. Similarly, a second arm attachment member 130 is adapted to be installed on the rear side 155 of the seatback 154, and is slidably moveable within a guide slot 156 on the seatback, through a range of vertical movement, as seen in FIGS. 21 and 23. In this embodiment, the opposite left and right arm members 132, 134 of the second arm attachment device 130 are each connected to inline adjustable resistance devices 40 that are anchored to attachment points 24, such as inset attachment points 60, in the floor 18 of the gym cage, allowing the user to perform a shoulder exercise by moving the second arm attachment device 130 through the range of movement shown in FIGS. 22 and 23.

The invention further includes a leg attachment device 140, as shown in FIGS. 30-39 for performing various arm and leg exercises. The leg attachment device adjustably mounts to the seat base 152 and is adjustably positionable, as shown in FIG. 31, to allow for performance of various exercises. During the performance of leg exercises, the leg attachment device 140 is movable relative to the seat base 152. In another position, as shown in FIG. 32, the leg attachment device 140 may be fixed in the vertical upright position to provide support of the arms while performing a bicep curl exercise, wherein two adjustable resistance handgrip devices 30 are secured to attachment points in the gym cage floor and the user performs the curl exercise, as demonstrated in FIG. 32 while grasping the adjustable resistance handgrip devices in each hand. Various quad, hamstring and calf exercises can be performed using the leg attachment device 140, as shown in FIGS. 34-39, wherein two inline adjustable resistance attachment devices 40 are secured to the leg attachment device 140 and anchored to attachment points 24 in either the floor 18 of the gym cage 10 or a vertical wall structure or frame member 20 of the gym cage.

Referring to FIGS. 40-41, the seatback 154 of the chair 150 is adjustable through a range of positions, as shown in FIG. 40 and can be locked at any one of those positions including a vertically upright position, one or more angled or inclined positions and a horizontal bench position. A support leg 158 is hingedly or pivotally fitted to the rear side 155 of the seatback and folds down, as shown in FIG. 40 to engage the gym cage floor 18 and support the seatback 154 in the horizontal bench position.

Referring to FIGS. 42-50, a further embodiment of the gym cage of the present invention is shown and is generally indicated as 210. The gym cage 210 includes a video wall 226 along the back wall 212. As seen in FIG. 42, a front view of this embodiment of the gym cage 210 shows the left side of the front wall 213 having a front logo wall 215 and an entrance to the gym cage to the right of the front wall. The front wall 213 consists of a metal frame with inset see-through plexiglass 215. As seen in FIG. 42, the knee and foot of the woman displayed on a video wall 226 at the back of the gym cage can be seen through the entrance. A portion of the attachment point frame can also be seen through the entrance. It should be noted that an observer standing in front of the gym cage 210 could also see the entire video wall 226 and the entire attachment point frame 220, 222 through the front plexiglass wall 215. For purposes of clarity, and to avoid confusion, the images of the video wall and attachment point frame are not shown visible through the front transparent logo wall 215 in FIG. 42. Referring to FIG. 43, an elevational view of the attachment point frame 220, 222 of the rear wall 212 of the gym cage and the video wall 226, as seen from an observer within the gym cage, is shown. The image of the woman is an example of a display on the video wall 226. Additionally, a menu 227 is illustrated on the video wall. The menu image 227 appears when a button on the gym grip 230, 240 (described hereinafter) is pushed. An example of the menu is shown in FIG. 44, wherein an option is presented that allows the user to view cumulative sets/reps for an exercise routine.

The several embodiments of the gym grip device 230, 240 shown in FIGS. 51 and 52 are electronically connected to the video wall 226 via a low power (i.e., short range) wireless connectivity technology, such as BLUETOOTH®. The attachment point frame 220, 222 is positioned in front of the video wall 226 for direct access by the user to connect the one or more gym grips 230, 240 or other exercise devices thereto. The gym grip devices 230 and 240 further include control buttons 244 for entering various control input commands that are delivered as input signals by wireless connection to the video display equipment and other wireless connected electronic devices.

Referring to FIGS. 45-47, the attachment point frame 220, 222 that includes an arrangement of multiple attachment points 224 is shown, wherein the attachment points 224 can slide up and down on the vertical bars 220 of the attachment point frame, as well as left to right on the horizontal bars 222 of the attachment point frame. This feature enables the attachment points 224 that are not currently in use to be moved to positions that do not obstruct the video being presented on the video wall, as shown in FIG. 45. FIG. 46 shows an isolated front view of an adjustable positioning attachment point that is able to slide on the vertical or horizontal bars. FIG. 47 illustrates an isolated cross sectional view of the adjustable positioning attachment point, wherein a spring loaded pin 286 is provided for release to slide the attachment point 224 either vertically or horizontally, depending on whether it's a vertical bar or a horizontal bar.

In order to protect the video screen of the video wall 226, a segmented plexiglass wall 228 is mounted behind the attachment point frame and in front of the video wall 226, as shown in FIGS. 48 and 49. The purpose of the segmented plexiglass wall 228 is to protect the video wall 226 when an exerciser misses while connecting the gym grip 230, 240 to the attachment point frame or if the user inadvertently releases the gym grip during an exercise routine or allows the gym grip to be released and caused to swing against the rear wall 212 of the gym cage 210.

FIG. 50 illustrates a user exercising within the gym cage 210 in front of the video wall 226. The cables 239 from her gym grip devices 230 are connected to attachment points 224 on the attachment point frame. An observer standing in front of the gym would be able to see the user exercise, as well as the video wall image and the attachment point frame, through the transparent plexiglass of the front logo wall 215.

FIGS. 51 and 52 show different embodiments of the gym grip for use in conjunction with the gym cage, wherein the several embodiments of the gym grip are structured for connection to the attachment points 224 to perform the various exercise movements and routines. The gym grip 230 shown in FIG. 51 is a smaller scale gym grip device that may, for example, operate to a maximum operable resistance of 300 lbs. psi. This particular device may be useful by all users of the gym cage, regardless of size, strength and ability. The buttons 234 are programmable for wireless connectivity to the video wall. The gym grip device 240 shown in FIG. 52 anticipates the desire of very serious heavy lift users that want to differentiate themselves from others. It is purposely designed heavier and wider to be more visible as a heavy duty or high capacity device, for instance operating up to a maximum operable resistance of 400 lbs. psi. Similar to the gym grip 230 of FIG. 51, this heavy duty gym grip device 240 includes buttons 244 that are programmable for wireless connectivity (e.g., BLUTOOTH®) to the video wall. The level of resistance of either embodiment of the gym grip (230 or 240) is controlled by rotating a control knob 249.

The gym cage 210 may further be provided with optional flooring 218 to provide a better grip, impact absorption and comfort. For example, the flooring 218 may include rubber mats or similar material that covers the floor of the gym cage, yet allows access to the attachment points through the flooring material, as shown in FIGS. 54 and 55. The flooring material may be provided in rolled mats, as shown in FIG. 5, formed of a rubber or similar composition material and may further be provided with a decorative pattern or a textured top surface for better grip. Alternatively, the flooring 218 may be specifically suited for performing yoga and dance exercises, in which case the flooring material may be a smooth surface to allow sock covered feet to gently slide along the floor surface.

FIGS. 57 and 58 illustrate various embodiments of the exercise devices. In FIG. 57, a bar grip device 330 is illustrated and includes an adjustable resistance air chamber 340 with opposing pistons 347, 348. FIG. 58 illustrates an example of maintenance of the gym grip device 430, wherein a very small rubber sealed hole may be provided in communication with the interior sealed air chamber 440. The sealed hole should be at the minimal distance to the right of the prestroke piston head 447 so that the hole is exposed to minimal pressure in the chamber. As the prestroke piston head 447 is adjusted inward to the first exercise position, it moves past the rubber sealed hole, thereby segregating the hole from pressure in the chamber during the exercise stroke. The rubber sealed hole allows for routine maintenance of injecting air into the air chamber 340 using a syringe 450 and needle 452, so that a predetermined minimum pressure can be maintained in the air chamber 340 at the beginning of the exercise stroke when the prestroke piston head 447 is at the lowest resistance setting.

Referring to FIGS. 59-66, further embodiments of the gym grip device 530 of the present invention are shown. These particular embodiments of the gym grip 530 allow for constant pressure throughout the exercise stroke by adding an air expansion chamber 550 and allowing for air to flow from the air compression chamber 540 into the air expansion chamber 550 throughout the exercise stroke. In each of these embodiments, the air within the air expansion chamber 550 needs to be able to return to the air compression chamber 540 before the start of the next exercise stroke. At the beginning of the exercise stroke, the air pressure in the air compression chamber 540 and the air expansion chamber 550 are at equilibrium. As the exerciser applies force through the exercise stroke, the air in the air compression chamber 540 is further compressed to a level in which it exceeds the air pressure within the air expansion chamber 550. Air is forced from the air compression chamber 540 into the air expansion chamber 550 through a narrow air exchange valve 552. The diameter of the air exchange valve 552 controls the rate of airflow between the two chambers. A narrow diameter of the air exchange valve 552 creates resistance to airflow that is being forced from the air compression chamber 540 into the air expansion chamber 550. This resistance allows air to be transferred from the air compression chamber 540 into the air expansion chamber 550 at a steady rate. At the end of the exercise stroke, when force is no longer applied by the user, the compressed air in the air compression chamber 540 will begin expanding and pushing the exercise stroke piston 548 back toward its original starting point while the prestroke piston head 547 remains stationary at the user adjusted position. In addition, the compressed air in the air expansion chamber 550 will begin to reverse its flow back through the air exchange valve 552 and into the air compression chamber.

FIGS. 59-64 illustrate an embodiment wherein air is forced from the air compression chamber 540 into one or more air bladders defining the air expansion chamber 550. As the air bladder 550 expands, it creates resistance. However, this resistance is less than the resistance of air being forced through the narrow diameter of the air exchange valve 552. The resistance of the expansion of the air bladder is not felt by the user. The purpose of the air bladder 550 comes into play after the exercise stroke. The air bladder's expanded elasticity will contract, pushing the excess air back into the air compression chamber 540, forcing the exercise stroke piston 548 to retract.

FIGS. 65-66 illustrate a further embodiment wherein a coil spring 554 is added to the air compression chamber 540 and mounted between the prestroke adjusting piston 547 and the exercise stroke piston 548. The spring 554 has a resistance rating in excess of the drag created by the exercise stroke piston head's contact with the cylinder wall, as well as the drag created by the gearing system while converting rotational movement to linear motion. At the end of the exercise stroke, the coil spring 554 decompresses and expands, as air flows from the air expansion chamber 550 and into the air compression chamber 540. The expansion of the coil spring 554 overcomes the drag of the exercise stroke piston 548 when returning to the starting point of the exercise stroke and pushes the exercise stroke piston 548 fully back to the original starting position. The next exercise stroke will have as much power as the previous exercise stroke.

Referring to FIGS. 67-76, a further embodiment of the invention is shown incorporating an adjusting aperture assembly 660 for controlling airflow between an air compression chamber 640 and an air exchange chamber 650 (previously referred to in the earlier embodiments as an air expansion chamber). The adjusting aperture assembly 660 is incorporated within the gym grip device (e.g., 230 or 240) for allowing for constant pressure throughout the exercise stroke, similar to the previously described embodiment of FIGS. 59-66.

According to the embodiment of FIGS. 67-76, an adjustment aperture disk 662 and the air flow disk 664 work together in order to control the flow of air between the air compression chamber 640 and the air exchange chamber 650. The adjustment aperture disk 662 contains a fixed airflow aperture 670 in the center and an arrangement of adjustment apertures 672 of varying diameter around a radial arrangement relative to the center of the disk 662, as seen in FIGS. 72-76. The smaller diameters are used for creating increased resistance of airflow, whereas the larger diameter apertures reduce the resistance of airflow from the air compression chamber 640 into the air exchange chamber 650 during the exercise stroke. As best seen in FIG. 74, the airflow disk 664 contains two fixed airflow apertures including a central aperture 680 and a second airflow aperture 682 that is fixed in position and adapted for corresponding alignment with any selected one of the plurality of adjustment apertures 672 on the adjustment aperture disk 662. The central fixed airflow aperture 680 on the airflow disk 664 has an airflow door 684 that is forced shut during the exercise stroke by increasing air pressure from the air compression chamber 640. The airflow door 684 is forced open at the end of the exercise stroke (i.e., when force is no longer applied by the user) and air is allowed to expand out of the air exchange chamber 650 creating a reverse airflow. The second fixed airflow aperture 682 on the airflow disk 664 is always open and works in conjunction with the arrangement of adjustment apertures 672 on the adjustment aperture disk 662, wherein a selected one of the adjustment apertures 672 of desired size (i.e., resistance level) is aligned with the second fixed airflow aperture 682.

As seen in FIGS. 68-70, the adjustment aperture disk 662 is mounted behind the airflow disk 664 via a disk collar 690. When mounted together, the adjustment apertures 672 of the adjustment aperture disk 662 are obstructed by the airflow disk 664. As seen in FIG. 72, one of the adjustment apertures 672 on the adjustment aperture disk 662 is aligned with the fixed airflow aperture 682 on the airflow disk 664. In this particular example, the largest adjustment aperture on the adjustment aperture disk 662 is aligned with the fixed airflow aperture 682 on the airflow disk 664 to allow for the least amount of resistance and maximum airflow from the air compression chamber 640 into the air exchange chamber 650. FIG. 73 shows a smaller size adjustment aperture 672 on the adjustment aperture disk 662 aligned with the fixed airflow aperture 682 on the airflow disk 664. This allows for a third step reduction in airflow which is equivalent to increased exercise resistance compared to that of FIG. 72. FIGS. 68, 72-74, and 75 illustrate the exercise stroke which forces the airflow door 684 of the fixed airflow aperture 670 closed. The result is that air is only able to flow through the currently used adjustment aperture 672 that is aligned with the fixed airflow aperture 682 of the airflow disk 664.

FIG. 76 shows the arrangement of the airflow door 684 when the exercise stroke has been completed, and force is no longer applied by the user, wherein the air exchange chamber 650 is allowed to expand and force the airflow door 684 open, as illustrated in FIG. 69. Outbound airflow from the air exchange chamber 650 is now escaping at a more rapid rate than when it entered. There is a no drag/delay in the movement of the exercise stroke piston back to the original starting position. The user can then begin the next exercise stroke as quickly as he or she desires. Note that the air is also escaping the air exchange chamber 650 through the adjustment aperture 672 that is aligned with the fixed airflow aperture 682.

FIG. 72 shows the back side of the adjustment aperture disk 662 facing away from the air compression chamber 640. FIG. 72 also illustrates the back side of the disk collar 690 which binds the adjustment aperture disk 662 to the airflow disk 664. Also shown is the adjusting lever 692 and the adjusting track 694. FIGS. 68-69 show cross sectional views of the adjusting lever controller 695 which is connected to the adjusting knob 698 via the adjusting lever controller sleeve 696. Rotating the adjustment knob 698 rotates the adjusting lever controller sleeve 696, which in turn rotates the adjusting lever controller 695, the adjusting lever 692 and the adjustment aperture disk 662 so that a selected one adjustment aperture 672 can be substituted for another adjustment aperture 672 in alignment with the fixed airflow aperture 682 on the airflow disk 664.

Referring to FIGS. 77-86, a further embodiment for providing an adjustable constant pressure throughout the exercise stroke of the gym grip device of the present invention is shown and is generally indicated as 730. In this particular embodiment, a variable size aperture 770 is achieved with an adjustable diaphragm design similar to that of an aperture design of a camera. Specifically, an adjustable size aperture 770 is achieved by a diaphragm 762 that has a plurality of leaves 768 that are very thin and overlap with each other. In a preferred embodiment, the diaphragm leaves 768 are of a light metal that is pliable and able to bend. Referring to FIG. 81, the diaphragm 762 is shown from the back side. A diaphragm support wall 764 prevents the diaphragm leaves 768 from bending when air is being pushed through the diaphragm opening 770 during the exercise stroke. At the end of the exercise stroke, when air is allowed to flow back through the diaphragm opening 770, the diaphragm leaves 768 bend from the air pressure causing the diameter of the opening 770 to increase, as seen in FIG. 79. This allows the air to move back through the opening 770 more quickly. The diaphragm 762 bends from the reverse airflow because it does not have a diaphragm support wall 764 on the piston side of the diaphragm 762. The diaphragm adjusting mechanism, as seen in FIGS. 80-81 and 85-86, is similar to that of the previously described adjustable size aperture design. When the adjusting knob 749 is turned, it moves the adjusting lever 792 which forces the diaphragm leaves 768 to open wider to larger diameters or closer to achieve more narrow apertures. A rubber wall 754 (see FIGS. 78-79) helps to push the airflow back through the opening in the support wall 764 and aligned adjusted aperture opening 770 at the end of the exercise stroke. FIGS. 85-86 show various means of adjusting the diaphragm. The diaphragm collar 749*a* is on the outside of the device, as seen in FIG. 85. The user turns the collar 749*a* by hand, which in turn moves the diaphragm leaves 762 within the device.

Referring to FIGS. 82-84, a sequence of adjusted positions of the adjustable diaphragm 762 is shown to achieve different size aperture openings 770, and therefor, a different degree of resistance. Specifically, FIG. 82 shows the aperture 770 adjusted to the largest size to allow the least amount of resistance of airflow from the air compression chamber to the air expansion chamber. FIG. 83 shows a reduction in airflow from the air compression chamber to the air expansion chamber offering some resistance during the exercise stroke. FIG. 84 shows a greater reduction in airflow from the air compression chamber to the air expansion chamber with a small aperture 770. There can be several adjusting positions between each of these displayed positions in FIGS. 82-84. The optimal size aperture will present a constant or near constant resistance to airflow in accordance with the speed of the exercise stroke and the force exerted by the exercise stroke.

FIGS. 77-86 illustrate an internal view of the resistance adjusting diaphragm from the left side of the gym grip. In particular, FIG. 80 shows a diaphragm collar 766 which is where the diaphragm leaves 768 are mounted. An adjusting track 794 is cut into the diaphragm collar 766 which allows an adjusting lever 792 to travel left to right within the track 794. The travel of the adjusting lever 792 controls the motion of the diaphragm leaves 768, thereby controlling the size of the aperture 770 of the diaphragm 762. FIG. 80 shows in internal side view of the diaphragm collar. In particular, FIG. 80 illustrates the controlling aspects of the adjusting knob 749 to the aperture 770 of the resistance adjusting diaphragm 762. The adjusting knob 749 is connected to a circular sleeve 796 which connects to the adjusting lever controller 795. The adjusting lever controller 795 pushes the adjusting lever 792 left to right (i.e., within the adjusting track) or vice versa in accordance with the motion of the adjusting knob 749. In summary, the adjusted diameter of the aperture 770 controls the level of resistance during the exercise stroke. By providing a constant adjusted size aperture, a constant resistance is achieved throughout the entire exercise stroke. Incorporating the rubber wall 754 within the air expansion chamber 750 allows for sufficient pressure during the exercise stroke in order to help dispel the pressure within the air expansion chamber 750 more quickly back through the diaphragm aperture 770 after the exercise stroke is completed, thereby pushing the exercise stroke piston 748 fully back to the starting position in a timely manner. In the event resistance created by the buildup of air pressure behind the rubber wall 754 during the exercise stroke is found to overcome the resistance imparted by the diaphragm aperture 770 due to the rubber wall 754 bulging and reducing the volume in the chamber on the back side of the rubber wall 754 (see FIG. 78), an opening can be created in the chamber behind the rubber wall 754, to the left of the air expansion chamber 750 (see FIGS. 78-79). This opening would relieve the back pressure on the rubber wall 754 by allowing air to escape in the chamber behind the rubber wall 754. Moreover, the elasticity of the rubber wall 754 can be governed so as to never buildup resistance in excess of the resistance exerted by the diaphragm aperture 770.

It should further be noted that the embodiment of FIGS. 77-86, incorporating the variable size aperture 770, may further be modified to include a second diaphragm. The second diaphragm would be an open air skeletal wire diaphragm that does not impede the flow of air. The size of an aperture in this skeletal diaphragm can be adjusted manually using an adjusting knob on the gym grip device. The first diaphragm, which is the same as the adjustable diaphragm 762 in the embodiment of FIGS. 77-86, is controlled by rotating motion of the cable spool. The leaves 768 close as the cable spool spins during the exercise stroke and open as the cable spool reverse spins during recovery from the exercise stroke. The leaves 768 on this first diaphragm function to impede the flow of air from the compression chamber into the air expansion chamber. The adjusted size of the aperture in the skeletal wire diaphragm limits closure of the leaves 768 during the exercise stroke so that the leaves 768 stop at the adjusted aperture size to thereby allow passage of air from the compression chamber into the air expansion chamber at an adjusted resistance level that remains constant during the exercise stroke. This further embodiment, while not shown in the drawings, would allow the leaves 768 on the adjustable diaphragm to reach maximum aperture closure early in the exercise stroke and maintain that closure throughout the exercise stroke, while automatically returning to a full open aperture at the end of the exercise stroke to allow air within the air expansion chamber to expand out of the air expansion chamber with little resistance.

The present invention further contemplates a portable gym exercise device that measures approximately 6 inches by 48 inches and which can be folded for travel to a size of approximately 6 inches by 24 inches. The portable gym exercise device is designed to be pressed against two adjacent walls in the corner of a room, including a hotel room during travel, wherein two sides of the device are pressed snugly against the adjoining walls and locked into place, while exerting sufficient pressure to hold the portable gym device in place against the adjoining walls during exercise. The two sides of the device each include several attachment points for removably attaching the gym grip device of the present invention thereto to allow the user to perform various exercises while traveling. The device can be positioned high up in the corner of the walls so as to allow for pull down exercise motions as needed to work, for example, the triceps. The portable gym device can be positioned chest high in the corner of the walls so as to allow a motion to exercise the chest. Moreover, the device can be positioned low in the corner of the adjacent walls so as to allow a pull-up motion to exercise, for example, the biceps. Attaching the portable gym device at varying levels on the wall achieves the same effect as utilizing the multiple attachment points spaced all over the gym cage walls described earlier in connection with the various embodiments disclosed throughout the drawings. The portable gym device is limited to the confines of the user's reach, as well as the confines of the 24 inch breadth of the device supported on the wall.

While the present invention has been shown in accordance with several preferred and practical embodiments, it is recognized that departures from the instant disclosure are fully contemplated within the spirit and scope of the present invention which is not to be limited except as defined in the following claims.

What is claimed is:

1. An exercise apparatus comprising:

at least one vertical wall structure and a floor;

at least one resistance creation device for performing a variety of exercise movements against a force of resistance with the at least one resistance creation device attached to a structure to thereby exercise different muscle groups of the human body, the at least one resistance creation device being structured for maintaining the force of resistance constant throughout the performance of any one of the selected variety of exercise movements;

a plurality of attachment points on the at least one vertical wall structure and the floor for selective attachment and detachment of the at least one resistance creation device thereto for performing the variety of exercise movements;

said at least one resistance creation device comprising:

a grip portion;

a cable spool;

a cable having a first end fixed to the cable spool and an opposite second end, and the cable spool being structured to wind the cable about an exterior thereof;

a quick connect fitting on the opposite second end of the cable for releasable attachment to any select one of at least some of the plurality of attachment points;

an adjustment resistance mechanism for selectively adjusting an amount of force needed to pull the wound cable from the cable spool as the grip portion is forcibly moved away from the selected one of the plurality of attachment points with the quick connect fitting attached thereto, and thereby selectively adjusting the force of resistance while performing the variety of exercise movements;

the adjustment resistance mechanism including a first piston having a piston head that moves against pressure within a variable volume compression chamber upon rotation of the cable spool and a second piston defining a resistance adjustment piston having a piston head that is adjustably moveable within the air compression chamber for varying the volume of the air compression chamber, and thereby changing the air pressure therein and the force of resistance against the inward movement of the first piston within the air compression chamber; and the adjustable resistance mechanism further including an air expansion chamber communicating with the air compression chamber for allowing air to escape, under pressure, from the air compression chamber and into the air expansion chamber at an adjustably controlled rate during inward movement of the first piston within the compression chamber while performing any selected one of the variety of exercise movements, wherein the force of resistance remains constant throughout inward movement of the first piston within the air compression chamber.

2. The exercise apparatus as recited in claim 1 wherein the adjustable resistance mechanism further comprises:

at least one aperture between the air compression chamber and the air expansion chamber.

3. The exercise apparatus as recited in claim 2 wherein the at least one aperture between the air compression chamber and the air expansion chamber is adjustably variable in size to control the level of resistance against inward movement of the first piston within the compression chamber as air is forced from the compression chamber, through the at least one aperture and into the air expansion chamber while performing the selected one of the variety of exercise movements.

4. The exercise apparatus as recited in claim 1 wherein the adjustable resistance mechanism further comprises:

a plurality of apertures of varying size between the air compression chamber and the air expansion chamber;

a wall between the air compression chamber and the air expansion chamber and including at least one fixed size aperture formed therethrough; and wherein the plurality of varying size apertures are adjustably positionable to be selectively aligned with the fixed aperture in the wall to allow passage of the air from the air compression chamber into the air expansion chamber at the adjustably controlled level of resistance during inward movement of the first piston within the compression chamber while performing the selected one of the variety of exercise movements.

5. The exercise apparatus as recited in claim 3 wherein the adjustable resistance mechanism further comprises:

a mechanism for urging the first piston back to a starting, prestroke position after completion of inward movement of the first piston in the performance of the selected one of the variety of exercise movements.

6. An exercise apparatus comprising:

at least one vertical wall structure and a floor;

at least one resistance creation device for performing a variety of exercise movements against a force of resistance with the at least one resistance creation device attached to a structure to thereby exercise different muscle groups of the human body;

a plurality of attachment points on the at least one vertical wall structure and the floor for selective attachment and detachment of the at least one resistance creation device thereto for performing the variety of exercise movements;

said at least one resistance creation device comprising:

a grip portion;

a cable spool;

a cable having a first end fixed to the cable spool and an opposite second end, and the cable spool being structured to wind the cable about an exterior thereof;

a quick connect fitting on the opposite second end of the cable for releasable attachment to any select one of at least some of the plurality of attachment points;

an adjustment resistance mechanism for selectively adjusting an amount of force needed to pull the wound cable from the cable spool as the grip portion is forcibly moved away from the selected one of the plurality of attachment points with the quick connect fitting attached thereto, and thereby selectively adjusting the force of resistance while performing the variety of exercise movements;

a video display positioned at the at least one vertical wall structure; and the at least one resistance creation device being structured for wireless communication with the video display and the at least one resistance creation device further including at least one input control for sending wireless input command signals to the video display.

7. The exercise apparatus as recited in claim 6 wherein the video display is approximately the same size as the at least one vertical wall structure.

8. The exercise apparatus as recited in claim 6 further comprising at least one video camera for capturing video images of the user of the exercise apparatus and transmitting the video images to the video display for displaying the video images thereon.

* * * * *